US012241716B2

(12) United States Patent
Hyde et al.

(10) Patent No.: US 12,241,716 B2
(45) Date of Patent: Mar. 4, 2025

(54) CAM SYNCHRONIZATION DEVICE FOR ARCHERY BOW

(71) Applicant: Bowtech, LLC, Eugene, OR (US)

(72) Inventors: Tony Hyde, Potlatch, ID (US); Joshua Stevens, Harrisburg, OR (US); Jacob Jurasevich, Eugene, OR (US); Brian Owens, Creswell, OR (US)

(73) Assignee: BOWTECH, LLC, Eugene, OR (US)

( * ) Notice: Subject to any disclaimer, the term of this patent is extended or adjusted under 35 U.S.C. 154(b) by 0 days.

(21) Appl. No.: 17/944,917

(22) Filed: Sep. 14, 2022

(65) Prior Publication Data

US 2024/0085140 A1 Mar. 14, 2024

(51) Int. Cl.
*F41B 5/10* (2006.01)
*F41B 5/14* (2006.01)

(52) U.S. Cl.
CPC ..... *F41B 5/105* (2013.01); *F41B 5/10* (2013.01); *F41B 5/1403* (2013.01)

(58) Field of Classification Search
CPC ..... F41B 5/10; F41B 5/105; F41B 5/123
See application file for complete search history.

(56) References Cited

U.S. PATENT DOCUMENTS 3,945,368 A * 3/1976 Jones ..... F41B 5/10 124/90
4,781,167 A * 11/1988 Martin ..... F41B 5/10 124/90
4,926,833 A * 5/1990 Darlington ..... F41B 5/105 124/900
5,307,787 A * 5/1994 LaBorde ..... F41B 5/10 124/90
5,381,777 A * 1/1995 Mitchell ..... F41B 5/10 124/90
5,390,655 A * 2/1995 Mitchell ..... F41B 5/105 124/90
5,606,963 A * 3/1997 Wenzel ..... F41B 5/10 124/25.6
5,809,984 A * 9/1998 Johnson ..... F41B 5/105 124/25.6

(Continued)

OTHER PUBLICATIONS https://www.apaarchery.com/about/technology/, 1 page. Accessed Dec. 1, 2022.

*Primary Examiner* — John A Ricci
(74) *Attorney, Agent, or Firm* — Husch Blackwell LLP

(57) ABSTRACT

A timing adjustment assembly for a compound archery bow is provided. The timing adjustment assembly is coupled with a pulley assembly and power cable of the archery bow. The timing adjustment assembly includes an adjustable component and a stationary component. The stationary component is attached to either the pulley assembly, the power cable, or the riser of the archery bow. The adjustable component is configured to move in a linear direction between multiple positional arrangements relative to the stationary component. The movement of the adjustable component changes the effective length of the power cable by moving the termination anchor point of the power cable or deflecting the power cable. The timing adjustment assembly adjusts the effective length of the power cable and relative synchronization of the pulley assembly with the archery bow in a brace position through the change in termination anchor point or deflection.

22 Claims, 36 Drawing Sheets

(56) References Cited

U.S. PATENT DOCUMENTS

| | | | | |
|---|---|---|---|---|
| 7,637,256 | B2 * | 12/2009 | Lee | F41B 5/10 124/25.6 |
| 8,037,876 | B1 | 10/2011 | Yehle | |
| 8,826,894 | B1 | 9/2014 | Darlington et al. | |
| 9,739,562 | B1 | 8/2017 | Obteshka | |
| 10,260,833 | B1 | 4/2019 | Rinker et al. | |
| 11,927,422 | B2 * | 3/2024 | Hahn | F41B 5/10 |

* cited by examiner

CAM SYNCHRONIZATION DEVICE FOR ARCHERY BOW

CROSS-REFERENCE TO RELATED APPLICATIONS

None.

BACKGROUND OF THE INVENTION

The field of the present invention relates generally to compound archery bows and particularly to timing adjustment mechanisms for synchronizing the cams or pulley assemblies of a compound archery bow.

Cam or pulley synchronization is one of the most important steps in tuning any dual cam, binary cam, or hybrid cam archery bow. When initially setting up an archery bow, often one of the first steps is to adjust the pulley assemblies for synchronization. Typically, to tune a bow, a bow technician or archer would put the bow in a bow press, compress the limbs in order to relieve tension from the string and/or cables, and add or remove twists from the string and/or cables in order to change their effective lengths, thereby slightly changing the rotational orientation of one cam with respect to the other. The timing and synchronization can subsequently be checked by drawing the bow back by hand or with a drawboard to check that the cams "stop" at the same time when at full draw. This is to ensure that the forces the cams transfer in the system are balanced throughout the draw and shot process. Additionally, synchronizing the cams has a benefit to what the archer feels at full draw. Cams that are out of sync or not properly timed may cause the draw to have a spongey feel to the shooter, or they can cause the bow to feel "jumpy," thereby signaling a decrease in effective let-off of the bow. If, after initial adjustment, the bow is still not properly timed, the bow must be placed back in a bow press and the process is repeated until proper timing and synchronization is achieved. While this is not necessarily a difficult process, it is time consuming and requires specialized tools.

There have been devices and inventions designed to enable cam and pulley synchronization through timing adjustment mechanisms that do not required the use of a bow press or other specialized tools. Examples of such devices are disclosed in U.S. Pat. Nos. 9,739,562 and 10,260,833 entitled "Adjustable Pulley Assembly for a Compound Archery Bow" and have been marketed by Bowtech, LLC under the Micro Sync Dial' name. However, some previously developed devices only allow for limited adjustment, while others do not adjust the orientation of the cam or pulley systems at brace. This can make it more difficult to determine proper synchronization.

Accordingly, a need exists for a timing adjustment mechanism that can synchronize a compound archery bow and adjust the timing of its cam or pulley assemblies at the brace position without the use of a bow press or any specialized tools. A further need exists for a timing adjustment mechanism that provides an adequate degree of adjustment.

BRIEF SUMMARY OF THE INVENTION

The present invention is directed generally to a timing adjustment assembly for a compound archery bow. The timing adjustment assembly can be configured to selectively adjust the effective length of a power cable incorporated into the bow. The change of power cable effective length can be utilized for synchronizing and fine-tuning the alignment and timing of the cam or pulley assemblies on the bow. In particular, the timing adjustment can change the effective length of a power cable while the bow is in the brace position and enables cam timing and synchronization to be performed without derigging the bow and without the need of a bow press or other specialized tools.

According to a first embodiment, the timing adjustment assembly can include an adjustable anchor component that is moveably coupled to a pulley assembly of a compound bow. The adjustable anchor component can be received within a stationary receiving slot formed into the cam body of the pulley assembly and configured to move between multiple different positions within the receiving slot. The adjustable anchor component includes an anchor post for receiving an end loop of a power cable and anchoring the power cable to the pulley assembly. The adjustable anchor component can be adjusted between one of several different positions within the receiving slot through the use of an adjustment fastener or the like. Each different position results in a different anchor point on the pulley assembly for the power cable and corresponding effective length of the power cable.

According to a second embodiment, the timing adjustment assembly can include a stationary housing secured to a pulley assembly of a compound bow and an adjustable pusher component that is moveably coupled to the housing. The adjustable pusher component is configured to engage the power cable and cause a deflection thereto by selectively moving the adjustable pusher component into and out of the housing. By imparting a deflection to the power cable, the timing adjustment assembly changes the effective length of the power cable. The adjustable anchor component can be selectively placed into any one of a set of multiple deflection positions to adjust the amount of deflection applied to the power cable, which results in a change in effective length of the power cable.

According to a third embodiment, the timing adjustment assembly can be incorporated into a compound archery bow along the length of a power cable connected between two pulley assemblies. The timing adjustment assembly includes a stationary coupler component and a yoke component that is adjustable in position relative to the coupler component. The adjustable yoke component can be positioned within an interior of the coupler component and configured to move in a linear path relative to the coupler component. The coupler component can include an end portion for receiving and anchoring a looped end of the power cable. The adjustable yoke component can be configured to receive a second end portion of the power cable with its opposing end anchored to the pulley assembly. The adjustable yoke component can be adjusted between one of several different positions within the interior of the coupler component through the use of an adjustment fastener or the like. Each different position results in a different effective length of the power cable by moving the two portions of the power cable closer together or further apart.

According to a fourth embodiment, the timing adjustment assembly can be incorporated into, or otherwise attached to, the riser of a compound bow. The timing adjustment assembly can include an idler pulley component incorporated along the length of a power cable of the compound bow to split the power cable into two segments, with one end anchored to a pulley assembly of the compound bow. The timing adjustment assembly can also include a mounting component on the riser for receiving the second end of the power cable. The mounting component can include a mounting fastener fixedly attached to the riser and an adjustable termination block moveably coupled to the mounting fastener. The adjustable termination block can include an anchor post for anchoring the second end of the power cable to the mounting assembly. The adjustable termination block can be adjusted between one of several different positions along the length of the mounting fastener through the use of an adjustment fastener. Each different position results in a different effective length of the power cable by increasing or decreasing the length of the first end of the power cable between the idler pulley component and the pulley assembly.

Each embodiment of the timing adjustment assembly can enable a user to adjust and change the effective length of a power cable for a compound bow. By changing the effective length of a power cable, the timing adjustment assembly can be utilized for synchronizing and fine-tuning the alignment and timing of the compound archery bow, and particularly, the cam or pulley assemblies of the bow. The timing adjustment assembly can be advantageously employed with any type of compound archery bow, including dual cam, binary cam, solo cam, and hybrid cam bows. The timing adjustment assembly can further be employed to cause a change in the effective length of the bow string or draw cable of the compound bow by coupling the timing adjustment assembly to the bow string in place of the power cable. It will be appreciated that various embodiments of the present invention are suitable to be employed in vertical bows, crossbows, hybrid bows, and other bows having cam or pulley assemblies, irrespective of whether such cam or pulley assemblies are mounted on the limbs, riser, frame, or other bow structure.

Objects and advantages pertaining to the pulley and cam synchronization and adjustment for archery bows may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DESCRIPTION OF THE SEVERAL VIEWS OF THE DRAWINGS

In the accompanying drawings, which form a part of the specification and are to be read in conjunction therewith in which like reference numerals are used to indicate like or similar parts in the various views.

DETAILED DESCRIPTION OF THE INVENTION

Figure 1A:
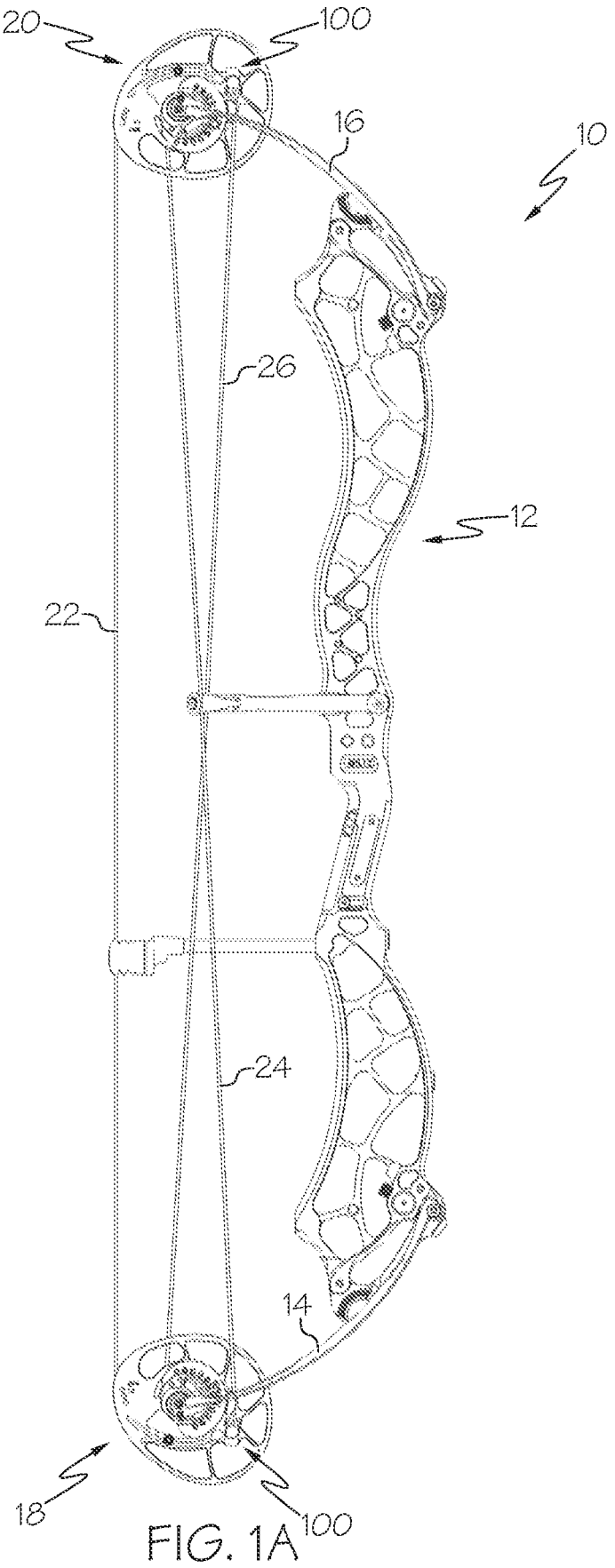
FIG. 1A is a right side elevation view of a compound bow incorporating a timing adjustment assembly in accordance with a first embodiment of the present invention, illustrating the compound bow in a brace position.

Various embodiments of the present invention are described and shown in the accompanying materials, descriptions, instructions, and drawings. For purposes of clarity in illustrating the characteristics of the present invention, proportional relationships of the elements have not necessarily been maintained in the drawings. It will be understood that any dimensions included in the drawings are simply provided as examples and dimensions other than those provided therein are also within the scope of the invention.

The description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

The present invention is directed generally to a timing adjustment assembly for a compound archery bow, and particularly, a timing adjustment assembly for adjusting the effective length of one or more power cables or bow strings incorporated into the compound archery bow. By changing the effective length of a power cable and/or bow string, the timing adjustment assembly can be utilized for synchronizing and fine-tuning the alignment and timing of the compound archery bow. In particular, the various embodiments of the timing adjustment assembly of the present invention enable the timing adjustment and synchronization of the one or more of the cam or pulley assemblies of the bow. For example, the timing adjustment assembly of the present invention can be used to fine-tune and adjust the effective length of a power cable and/or bow string while the bow is in the brace position. The change in effective length can result in changing the orientation of one or more of the pulley assemblies of the bow so that the two pulley assemblies are properly timed and synchronized both at brace and when drawn. Significantly, each of the different embodiments of the timing adjustment assembly can enable the adjustment of the power cable and/or bow string effective length, and resulting synchronization and timing of the pulley assemblies, without derigging the bow (i.e., without removing one or more cables from the bow) and without the need of a bow press or other specialized tools.

The present invention is directed to several different embodiments 100, 200, 300 and 400 of a timing adjustment assembly for a compound bow, and each of the different embodiments 100-400 of the timing adjustment assembly can be incorporated into any configuration or arrangement of a compound archery bow. In embodiments 100 and 200, the timing adjustment assembly is incorporated into one or both of the pulley assemblies of the bow. In another embodiment 300, the timing adjustment assembly is incorporated along the length of a power cable or bow string and not directly attached to a pulley assembly. In yet another embodiment 400, the timing adjustment assembly is incorporated into the riser of the bow rather than the pulley assembly.

Turning to the several figures, the timing adjustment assembly 100-400 of the present invention can be incorporated into any type of compound archery bow, including dual cam, binary cam, solo cam, and hybrid cam bows. The several figures illustrate one exemplary type of compound archery bow 10 configured with the timing adjustment assembly of the present invention; however, the specific configuration of bow 10 disclosed herein is not intended in any way to limit the application and use of the timing adjustment assembly of the present invention, which can be incorporated into any type of compound archery bow. It will be appreciated that various embodiments of the present invention are suitable to be employed in, for example, vertical bows, crossbows, hybrid bows, and other bows having cam or pulley assemblies, irrespective of whether such cam or pulley assemblies are mounted on the limbs, riser, frame, or other bow structure.

Figure 1B:
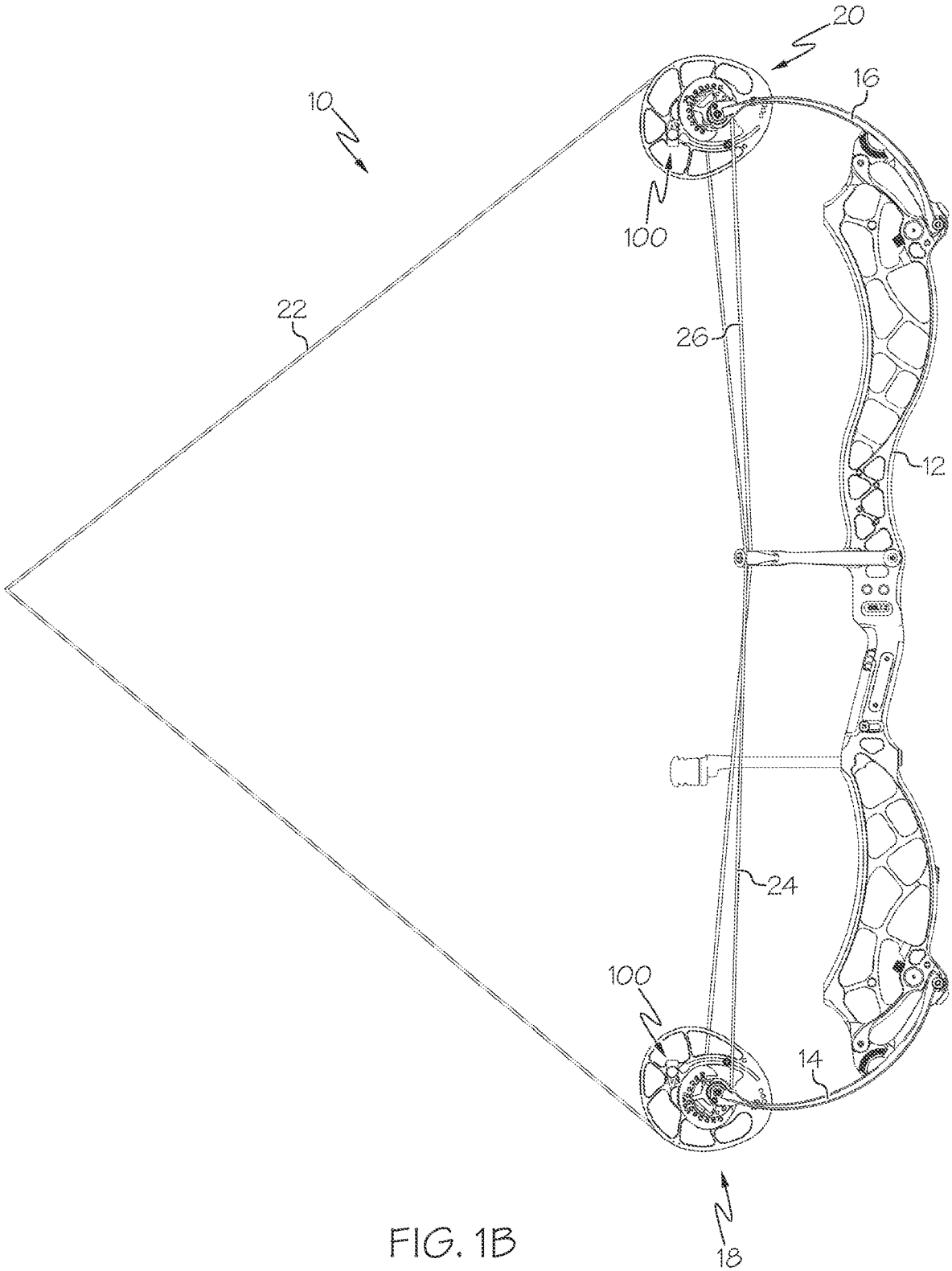
FIG. 1B is a right side elevation view of the compound bow and timing adjustment assembly of FIG. 1A illustrating the compound bow in a drawn position.

FIGS. 1A-1B (as well as FIGS. 5A-5B, 9A-9B, and 13A-13B) illustrate a standard compound bow 10 with a timing adjustment assembly 100, 200, 300 or 400 incorporated therein. The general components of compound bow 10 are well-known and not necessarily considered part of the present invention for the timing adjustment assembly 100, 200, 300, or 400. As shown in FIGS. 1A-1B, compound bow 10 can include a central riser 12, first and second bow limbs 14 and 16 secured to opposing ends of riser 12, first and second pulley assemblies 18 and 20 rotatably mounted on the first and second bow limbs 14 and 16, respectively, a draw cable (or bow string) 22, and first and second power cables 24 and 26. FIGS. 1A-1B illustrate compound bow 10 configured as a so-called dual cam archery bow, where first and second pulley assemblies 18 and 20 are configured as cams and may optionally be substantially identical or substantially mirror images of each other. Starting from a rest position (FIG. 1A), upon drawing dual cam compound bow 10 (FIG. 1B), the draw cable 22 is let out by both pulley assemblies 18 and 20, first power cable 24 (which is attached, directly or indirectly, to second pulley assembly 20 and/or to the second bow limb 16) is taken up by first pulley assembly 18, and second power cable 26 (which is attached, directly or indirectly, to first pulley assembly 18 and/or first bow limb 14 as described below) is taken up by second pulley assembly 20.

While not shown herein, timing adjustment assembly 100, 200, 300, or 400 can also suitably be incorporated into so-called solo cam bows where the second pulley assembly 20 is configured as an idler wheel instead of a cam, or a so-called hybrid cam bow where the bow includes an additional coupling cable connected between the first and second pulley members 18 and 20. Further, the various embodiments 100-400 of the inventive timing adjustment assembly disclosed herein, or equivalents thereof, can be advantageously employed with any type of compound archery bow, including dual cam, binary cam, solo cam, and hybrid cam bows described. In a dual or binary cam bow, the various embodiments of the inventive timing adjustment assembly can be employed for both pulley assemblies; in a solo or hybrid cam bow, the various embodiments of the inventive timing adjustment assembly can be employed for only one pulley assembly, or in some instances of a hybrid cam bow for both pulley assemblies.

Further, while the timing adjustment assembly embodiments 100-400 disclosed herein are directed particularly to a power cable (and changing the effective length thereof), such timing adjustment assembly embodiments can also suitably be incorporated and adapted to adjust the effective length of the drawstring or bow string of a compound bow in alternative embodiments.

First Embodiment of Timing Adjustment Assembly

Turning to FIGS. 1A-4C, a timing adjustment assembly 100 in accordance with a first embodiment of the present invention is illustrated and described herein. FIGS. 1A and 1B illustrate a standard compound bow 10 with timing adjustment assembly 100 incorporated therein. As described above, the general components of compound bow 10 are well-known and not necessarily considered part of the present invention for the timing adjustment assembly 100.

As best shown in FIGS. 1A and 1B, compound bow 10 is configured as a dual cam archery bow, with first and second pulley assemblies 18 and 20 configured as cams and first and second power cables 24 and 26. In such a configuration, a timing adjustment assembly 100 can be incorporated into both pulley assemblies 18 and 20, which operate as mirror images of one another, to allow to the adjustment and change in the effective length of each power cable 24 and 26. However, it is recognized that timing adjustment assembly 100 can also suitably be incorporated into different configurations of a bow 10 with different configurations of pulley assemblies as described above.

Turning to FIGS. 2A-4C, pulley assembly 18 is illustrated with timing adjustment assembly 100 illustrated in additional detail. Pulley assembly 18 (with the exception of the inventive timing adjustment assembly 100 incorporated therein) can be configured as any standard or suitable cam or pulley configuration now known or hereafter developed. It is further recognized that pulley assembly 20 can be configured as a mirror image of pulley assembly 18 and the following description can apply to both pulley assemblies 18 and 20 with like reference numbers referring to like components, particularly for a dual cam bow 10 as illustrated in FIGS. 1A and 1B.

Figure 2A:
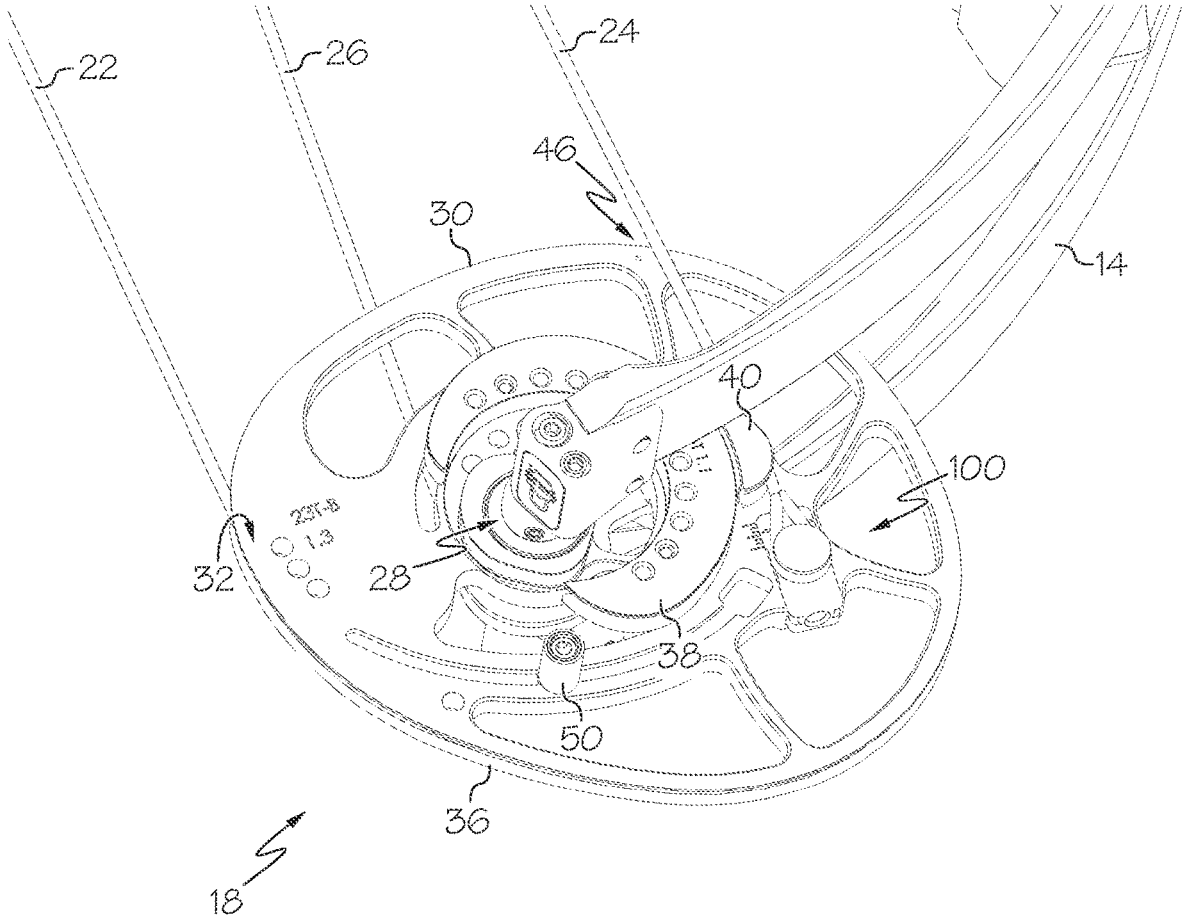
FIG. 2A is a partial right side perspective view of the compound bow of FIG. 1A illustrating a pulley incorporating the timing adjustment assembly.
Figure 2B:
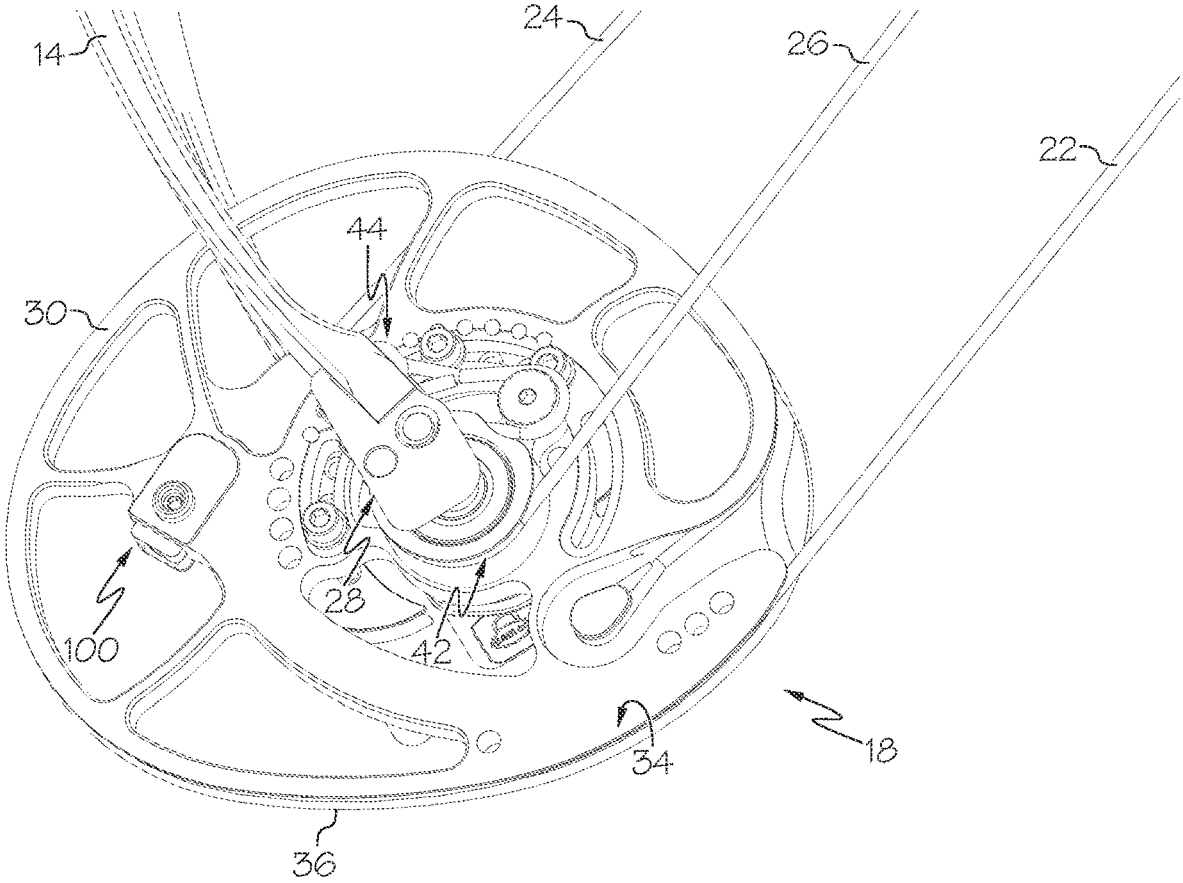
FIG. 2B is a partial left side perspective view of the compound bow of FIG. 1A illustrating a pulley incorporating the timing adjustment assembly.

As best shown in FIGS. 2A and 2B, pulley assembly 18 is rotatably mounted to bow limb 16 at an axle assembly 28 and can include a cam body 30 having a first side 32 (see FIG. 2A) and a second side 34 (see FIG. 2B). Cam body 30 includes a perimeter draw string track or groove 36 extending around the periphery of the pulley assembly 18 and configured to receive the draw string 22 that is anchored at an anchor post provided on the cam body 30 (see FIG. 2B). Pulley assembly 18 can be configured to anchor and receive draw string 22 and one end of both first and second power cables 24 and 26. In particular, pulley assembly 18 includes timing adjustment assembly 100 formed within pulley assembly 18 for both anchoring first power cable 24 and adjusting the effective length of first power cable 24 as described in greater detail below.

As shown in FIG. 2A, first side 32 of cam body 30 can be configured as the take-up side for first power cable 24. Cam body 30 can include a cam module 38 formed around axle 28 on and secured on the first side 32 of cam body 30. Cam module 38 can operate as a take-up means for first power cable 24 and can include a groove or track that receives a portion of first power cable 24 when pulley assembly 18 rotates during operation. Cam module 38 can be optionally adjustable for modifying the draw length of draw string 22. Cam body 30 can include an intermediate secondary post or routing post 40 formed onto or coupled to the first side 32 of cam body 30 with a formed track or groove for receiving first power cable 24 before it terminates at timing adjustment assembly 100.

As shown in FIG. 2B, second side 34 of cam body 30 can be configured as the let-out side for second power cable 26. Cam body 30 can include a power cable track 42 formed around and adjacent the opening for axle 28 that is configured to receive and let out second power cable 26 on second side 34 of cam body 30. Cam body 30 can further include an anchor post 44 formed onto or coupled to cam body 30 for securing the end of second power cable 26 to cam body 30. As further shown in FIG. 2B, second side 34 of cam body 30 can include an intermediate anchor post between anchor post 44 and power cable track 42 around which second power cable 26 is passed. Collectively, power cable track 42 and anchor post 44 form the let out means for second power cable 26. It is also recognized that pulley assembly 18 can alternatively be configured with any suitable let-out means for securing second power cable 26 to cam body 30 and letting out second power cable 26 during operation of bow 10 and, thus, it will be further recognized that the configuration shown in the figures and described above is for exemplary purposes only.

Figure 3A:
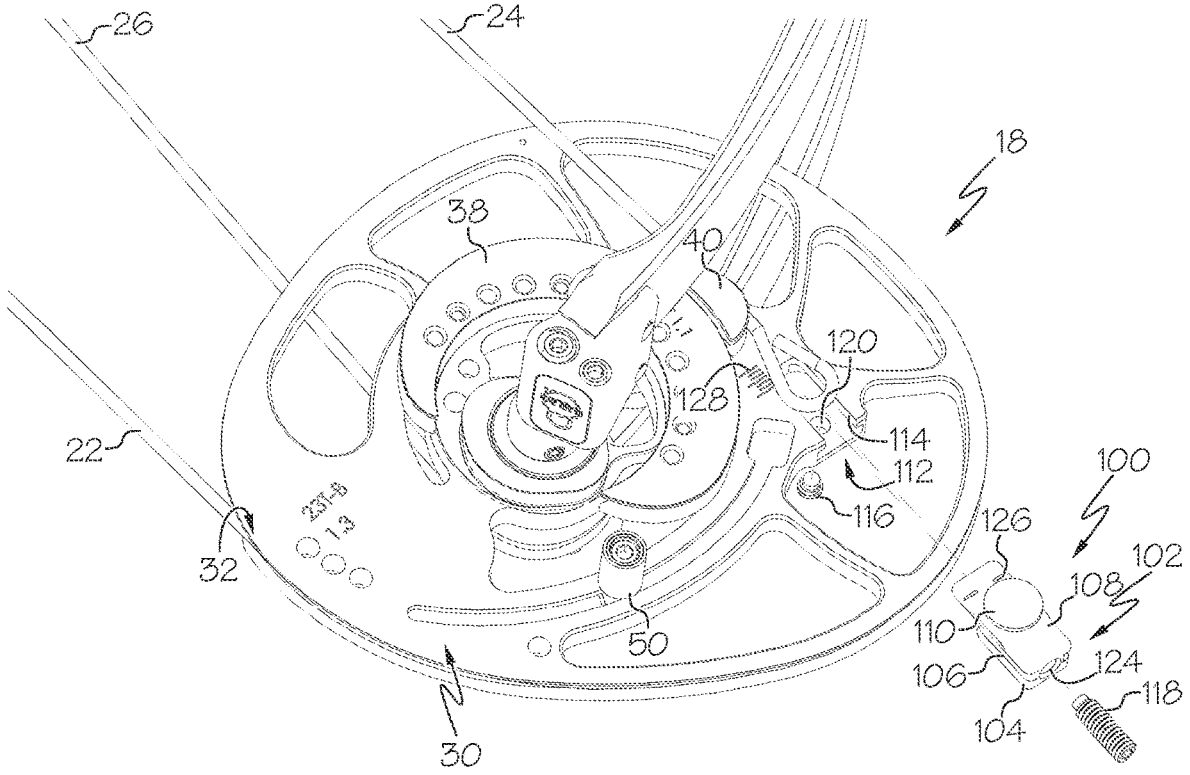
FIG. 3A is an exploded partial right side perspective view of the compound bow of FIG. 1A illustrating a pulley incorporating the timing adjustment assembly.
Figure 3B:
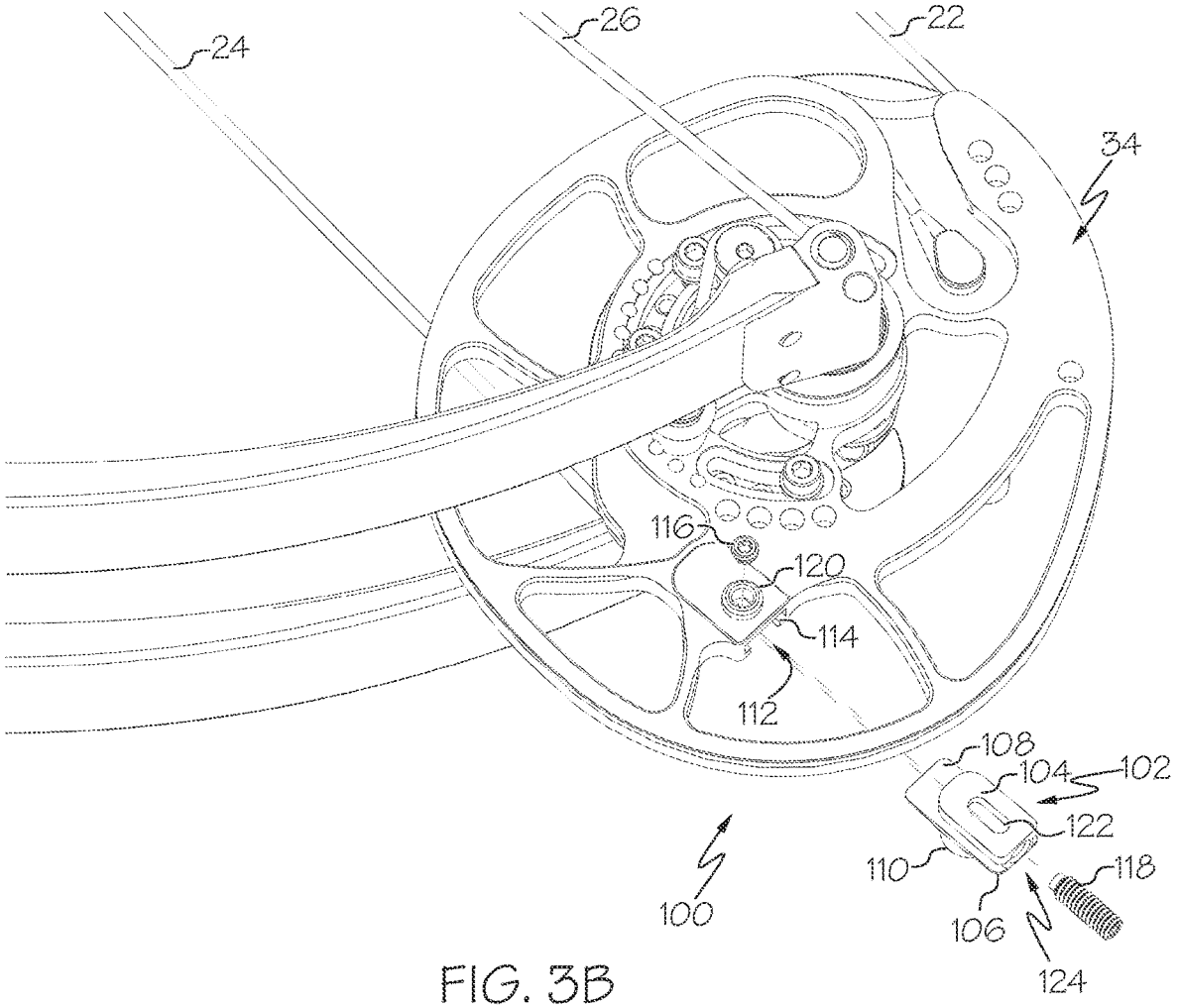
FIG. 3B is an exploded partial left side perspective view of the compound bow of FIG. 1A illustrating a pulley incorporating the timing adjustment assembly.

Timing adjustment assembly 100 will now be described in greater detail with reference to FIGS. 2A-4C. As best shown in FIGS. 2A and 2B, timing adjustment assembly 100 can be secured to, or otherwise incorporated into cam body 30 of pulley assembly 18 (and similarly pulley assembly 20 at the other end of bow 10). As shown, timing adjustment assembly 100 can be located in the interior of cam body 30 radially inward of draw string peripheral groove 36 and offset from the axle 28 so that clockwise rotation of pulley assembly 18 will result in take-up of first power cable 24. As best shown in FIGS. 3A and 3B, timing adjustment assembly 100 can include an adjustable anchor component 102 that is adjustably securable to cam body 30 and configured to anchor the end of first power cable 24 to pulley assembly 18. As described herein, adjustable anchor component 102 can be configured to be at least partially received in and slide linearly (parallel along the surface of cam body 30) with respect to cam body 30.

As shown, adjustable anchor component 102 can include a base portion 104, a connecting portion 106, an extended or top sliding portion 108, and an anchor post 110. Base portion 104 can be configured to be received within (and slide along)

a slot 112 formed into the surface of cam body 30 on its first side 24 (see FIG. 3A). Slot 112 can be configured and operate as a stationary component that adjustable anchor component 102 moves in a translating motion relative thereto. As shown in FIGS. 3A and 3B, base portion 104 can have a generally rectangular shape with a length, width, and thickness generally conforming to the shape of slot 112. In particular, base portion 104 can have a thickness that enables adjustable anchor component 102 to be at least partially received within slot 112 and articulate or move linearly therein. It is also recognized that base portion 104 (and adjustable anchor component 102 generally) can be configured with any suitable shape and need not necessarily be rectangular or orthogonal.

Connecting portion 106 can extend beyond or upward from the upper surface of base portion 104 and sliding top portion 108 can extend from connection portion 106. As best shown in FIG. 3A, connecting portion 106 operates to connect sliding top portion 108 to base portion 104 in a spaced apart arrangement. As shown, connecting portion 106 can be configured with a width slightly less than the width of base portion 104 so that it forms a narrowed groove or channel between base portion 104 and sliding top portion 108. This arrangement can assist in maintaining base portion 104 within slot 112 while adjustable anchor component 102 slides relative to cam body 30.

In one embodiment, sliding portion 108 can be configured to translate linearly (i.e., move or slide in a straight path) along the surface of cam body 30 above slot 112 and base portion 104. When adjustable anchor component 102 is adjusted (as described below), base portion 104 moves within slot 112 while sliding top portion 108 moves equally with base portion 104 (and connecting portion 106) above slot 112 and across cam body 30. Sliding top portion 108 can be configured with a length slightly longer than the length of base portion 104 so that one end extends a distance beyond receiving slot 112 in cam body 30 when adjustable anchor component 102 is connected to cam body 30. As further shown in FIGS. 3A and 3B, anchor post 110 can extend beyond or upward from sliding top portion 108 and be configured to allow cable 24 to be anchored or secured thereto.

Adjustable anchor component 102 can be configured as one integral component with base portion 104, connecting portion 106, sliding top portion 108 and anchor post 110 all integrally formed together from a single material. However, it is also recognized that one or more of the individual portions 104-110 of adjustable anchor component 102 can be separately formed and secured or otherwise coupled or attached to the remaining portions in alternative suitable embodiments.

As best shown in FIG. 3A, slot 112 can be formed into cam body 30. Slot 112 can be configured as an indentation, channel, groove or other recessed configuration formed into the thickness of cam body 30 and can have a shape generally conforming to that of adjustable anchor component 102, and specifically, base portion 104 and connecting portion 106. Slot 112 can also be formed onto cam body 30 and positioned onto the surface of cam body 30 in certain embodiments of the invention (not shown). In such a configuration, slot 112 can include raised sidewalls and end walls formed or otherwise attached to cam body 30 that define the perimeter of slot 112. As further shown, slot 112 can include a lip 114 that partially defines the upper edge of slot 112 so that the width between the edges of lip 114 is slightly less than the width between the edges of the lower portion of slot 112. Further, the width of lip 114 can be configured to generally conform to the width of connecting portion 106 of adjustable anchor component 102 and enable base portion 104 to slide within slot 112 while also be retained therein.

As further shown in FIGS. 3A and 3B, adjustable anchor component 102 can be secured and retained within slot 112 by a locking fastener 116 and adjustment fastener 118. Locking fastener 116 can be configured to extend vertically or perpendicular relative to slot 112 and base portion 104 while adjustment fastener 118 can be configured to extend horizontally or parallel relative to slot 112 and base portion 104. As best shown in FIG. 3A, slot 112 can include a locking fastener opening 120 defined through its lower portion (opposite lip 114) that is configured to receive locking fastener 116 when inserted therein. As best shown in FIG. 3B, base portion 104 can include an elongated opening 122 that is configured to receive locking fastener 116 when inserted therein. Elongated opening 122 can be configured with an elongated or slotted shape in order to allow base portion 104 to be adjusted linearly within slot 112 (and relative to cam body 30) while still allowing locking fastener 116 to be received within base portion 104.

Locking fastener 116 can be configured as a screw, bolt, pin, or other threaded-type fastener, or any other suitable threaded or non-threaded fastening means that can be inserted and secured within openings 120 and 122. As shown, locking fastener 116 is inserted through slot opening 120 and then into base portion elongated opening 122 and operates to secure base portion 104 (and adjustable anchor component 102 generally) in a fixed position relative to slot 112 and cam body 30. Both slot opening 120 and base portion elongated opening 122 can have a diameter or width approximately equal to that of locking fastener 116 (and/or retaining threads) so that locking fastener 116 can be inserted therethrough and generally retained by openings 120 and 122.

As also shown in FIG. 3A, adjustable anchor component 102 can include an adjustment fastener opening 124 extending generally horizontally through base portion 104 and/or connecting portion 106 for receiving adjustment fastener 118. Similar to locking fastener 116, adjustment fastener 118 can be configured as a bolt, screw, pin, or other threaded-type fastener or any other suitable fastening means that can be inserted and secured within opening 124. Adjustment fastener opening 124 can also be configured with a diameter (and/or retaining threads) to securely receive adjustment fastener 118 and enable adjustment fastener 118 to be fully or partially inserted, adjusted, and retained by opening 124.

As further shown in FIGS. 2A-4C, timing adjustment assembly 100 can include guide markers 126 and 128 configured to enable a user to easily determine and track the position of timing adjustment assembly and the resulting effective length of power cable 24/26 secured thereby. As best shown in FIG. 3A, adjustable anchor component 102 can include a movement guide marker 126 provided on sliding top portion 108. Movement guide marker 126 can be configured as any suitable indicator means to indicate the linear position of adjustable anchor component 102 relative to cam body 30. Movement guide marker 126 can be defined into the surface of top portion 108 and/or applied to the surface of top portion 108. Similarly, cam body 30 can include a slide position indicator 128 configured as any suitable indicator means and can be defined into the surface of cam body 30 and/or applied to the surface of cam body 30. According to certain embodiments, slide position indicator 128 can be configured as a series of markings designating specific lengths or distances under the metric or imperial systems. When adjustable anchor component 102 is positioned within slot 112 and on cam body 30, movement guide marker 126 can be aligned with slide position indicator 128 in order to indicate the precise position of adjustable anchor component 102 relative to cam body 30 and the resulting change in the "effective length" of power cable 24/26 due to the adjustment of timing adjustment assembly 100.

Figure 4A:
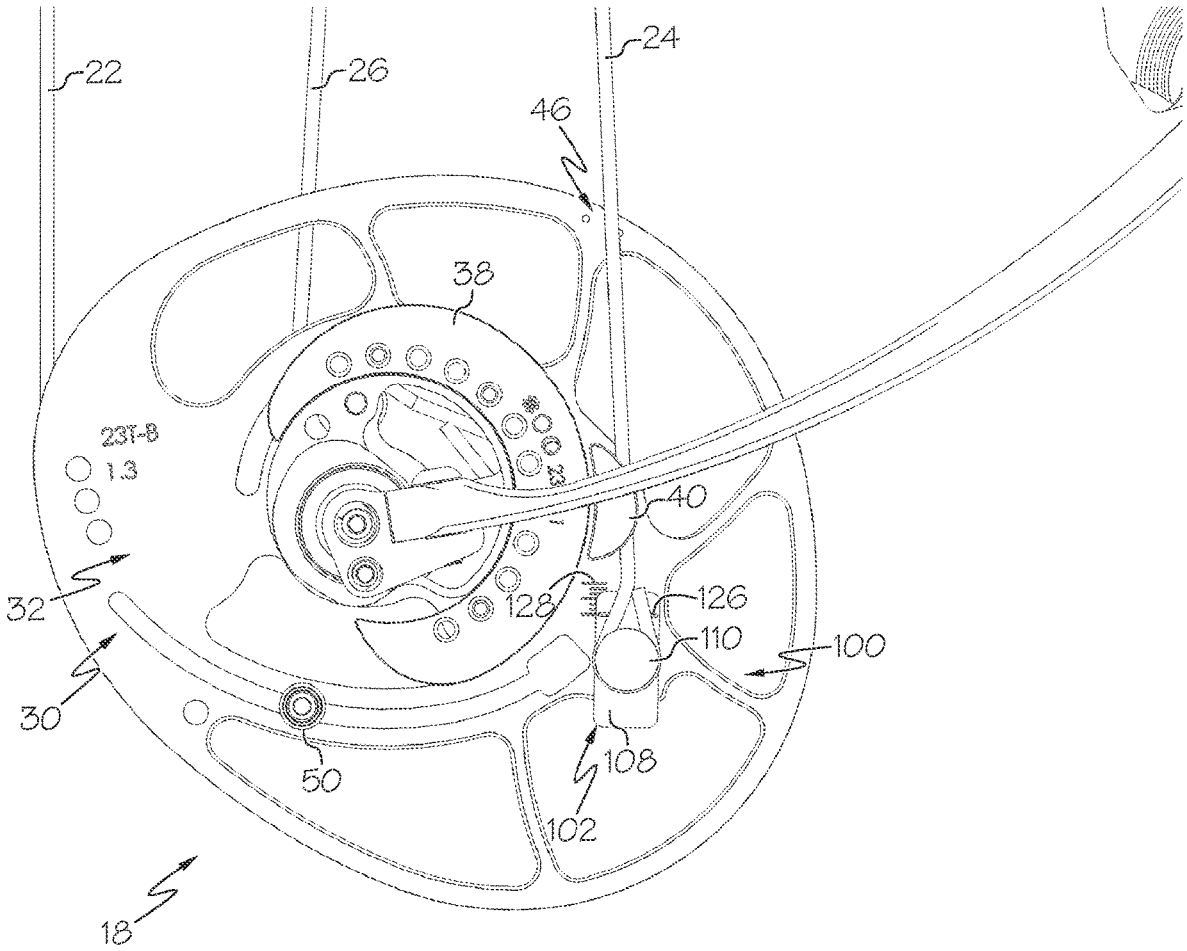
FIG. 4A is a partial right side elevation view of the compound bow of FIG. 1A illustrating the pulley and timing adjustment assembly in a first adjusted position.
Figure 4B:
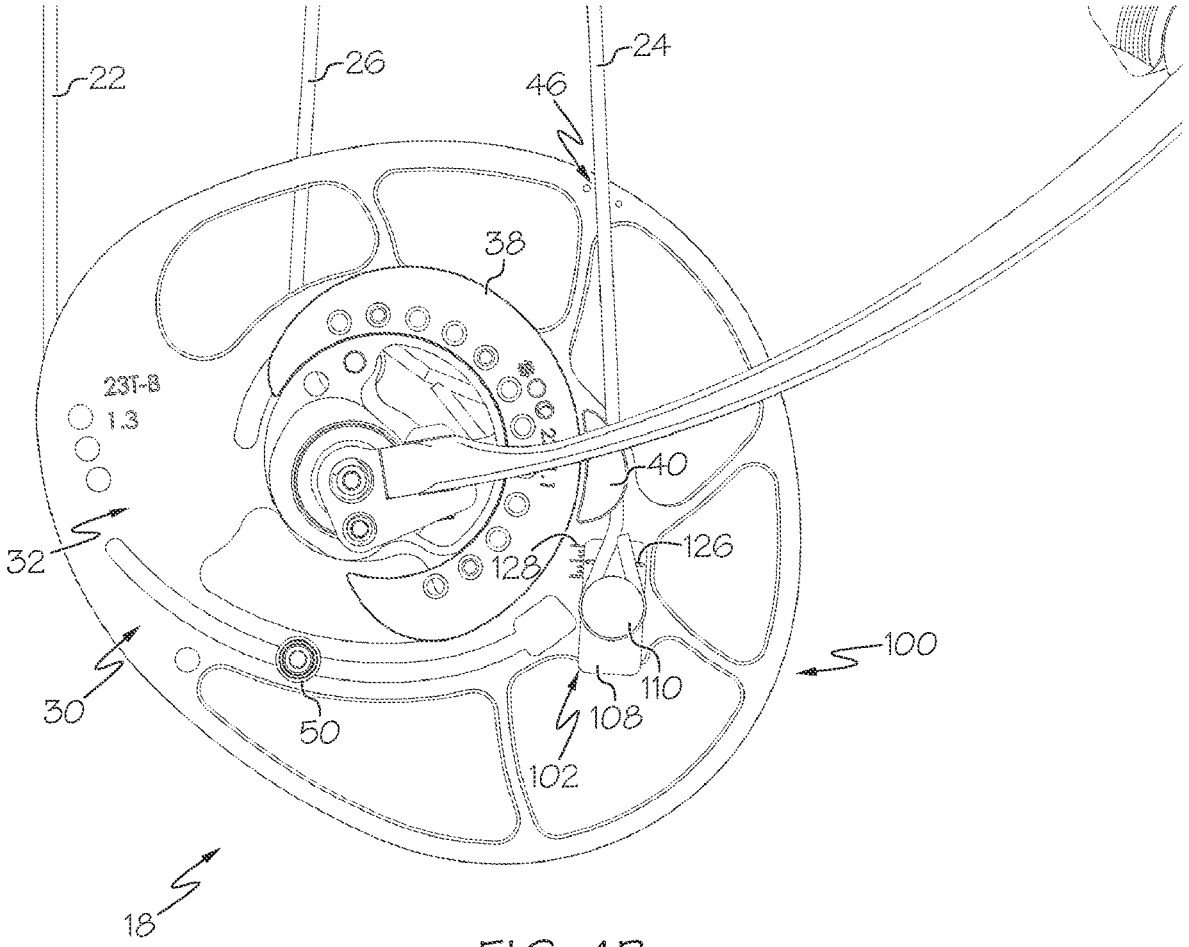
FIG. 4B is a partial right side elevation view of the compound bow of FIG. 1A illustrating the pulley and timing adjustment assembly in a second adjusted position.
Figure 4C:
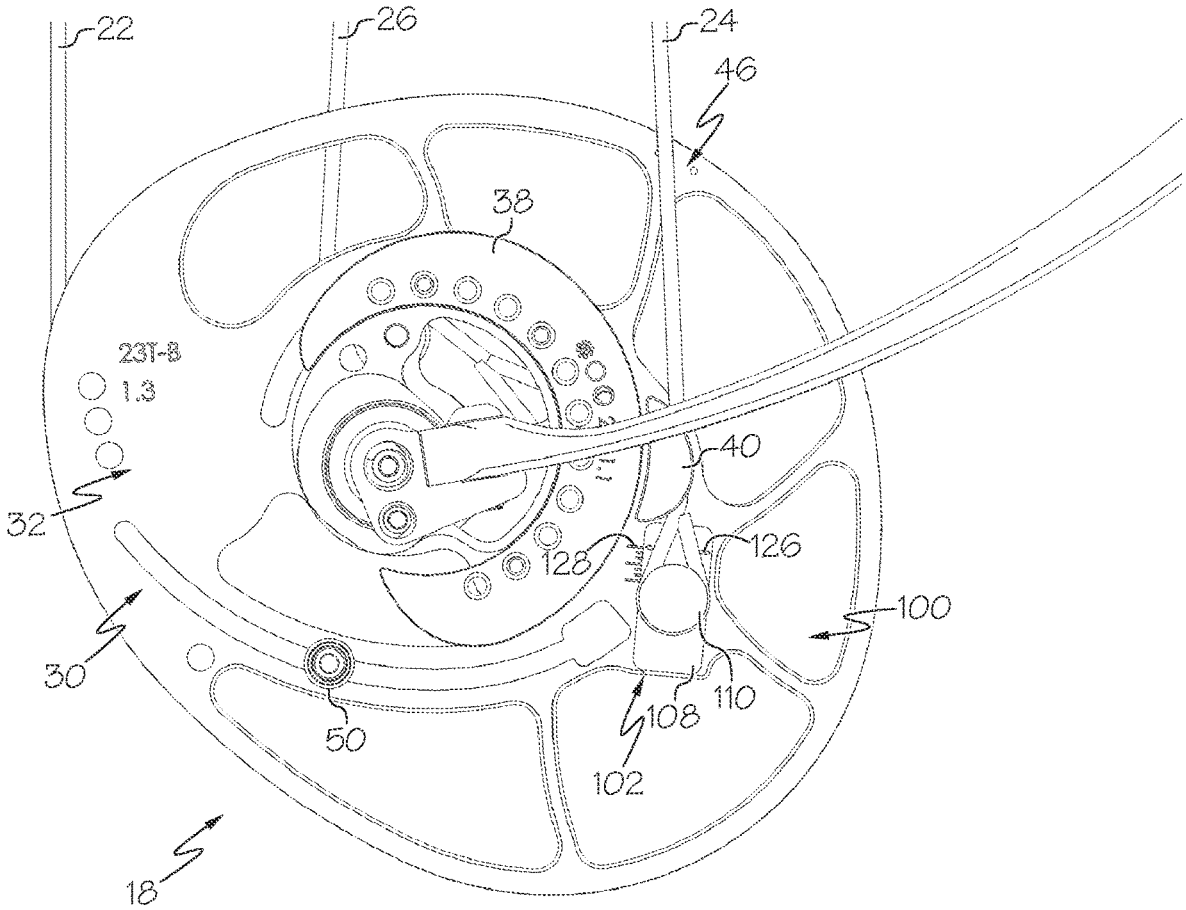
FIG. 4C is a partial right side elevation view of the compound bow of FIG. 1A illustrating the pulley and timing adjustment assembly in a third adjusted position.

Turning to FIGS. 4A-4C, the operation of timing adjustment assembly 100 will now be described in greater detail. As shown, power cable 24 is anchored to anchor post 110 of adjustable anchor component 102, which is secured within slot 112 to cam body 30. The effective length power cable 24 can be defined as the length of power cable 24 from its engagement to anchor post 110 on pulley assembly 18 to its engagement to anchor post 44 on second pulley assembly 20. When draw string 22 is drawn and pulley assemblies 18 and 20 rotate with the draw of draw string 22, power cable 24 is taken-up by first pulley assembly 18 and let-out by second pulley assembly 20 (similarly, power cable 26 is let-out by first pulley assembly 18 and taken-up by second pulley assembly 20 as depicted in FIGS. 1A and 1B). If the take-up and let-out of both power cables 24 and 26 is not properly timed and synchronized due to the rotational arrangement of pulley assemblies 18 and 20, the operation of bow 10 can be adversely affected. The timing and synchronization of pulley assemblies 18 and 20 can be achieved by increasing or decreasing the effective length of one or both of power cables 24 and 26.

Timing adjustment assembly 100 can allow a user to easily adjust and synchronize pulley assemblies 18 and 20 in by changing the "effective length" of either power cable 24 or 26. Specifically, timing adjustment assembly 100 enables the terminating anchor position of power cable 24 or 26 on pulley assembly 18 or 20 (i.e., at anchor post 110) to be moved, which increases or decreases the effective length of the power cable 24/26. In order to adjust timing adjustment assembly (and change the anchored position of power cable 24 or 26, locking fastener 116 can be unwound or otherwise let out of openings 120 and 122 to unlock adjustable anchor component 102 from receiving slot 112. Then adjustment fastener 118 can be inserted further into or let out from opening 124 (e.g., wound or unwound) to slide the adjustable anchor component 102 forward or backward linearly relative to cam body 30 and as indicated by markers 126 and 128. Locking fastening means 116 can then be re-secured into openings 120 and 122 once adjustable anchor component 102 is in the desired position to secure it in place. Timing adjustment assembly 100 can be structurally arranged to allow for any desired positional arrangements of anchor post 110 (relative to cam body 30) by moving adjustable anchor component 102 within receiving slot 112. Three such positional arrangements are shown in FIGS. 4A-4C for exemplary purposes. However, it will be appreciated that anchor component 102 may be continuously adjustable within receiving slot 112 and, therefore, the present invention is suitable for making micro adjustments. As shown in FIG. 4A, power cable 24 can be anchored to anchor post 110 and adjustable anchor component 102 can be secured at a first position on cam body 30 of pulley assembly 18 as indicated by indicator markings 126 and 128. This provides a "first effective length" of power cable 24. If this "first effective length" does not establish a synchronized arrangement of pulley assemblies 18 and 20, which can be indicated by the alignment indicator markings 46 commonly applied to pulley assemblies, then timing adjustment assembly 100 can be adjusted. FIG. 4B illustrates adjustable anchor component 102 in a second position to define a "second effective length" of power cable 24. In this second position, it will be noted that power cable 24 is between the two alignment indicator markings 46 when the bow is at brace position, thereby indicating proper cam timing. FIG. 4C illustrates adjustable anchor component 102 in a third position to define a "third effective length" of power cable 24. To achieve either the first, second or third positions (or any positional arrangement therebetween), locking fastener 116 is simply released and adjustment fastener 118 is adjusted to the desired position indicated by markings 126 and 128. As the dynamics of the bow 10 may change over time due to various factors (e.g., cable stretch, etc.), the user can make subsequent adjustments such that cam body 30 and power cable 24 are properly oriented and the power cable 24 is between the two alignment indicator markings 46 when the bow is at brace. At the same time, when the bow is a full draw, the user may ensure that the draw stop 50 of the first pulley assembly 18 contacts the first power cable 24 at the same time the draw stop 50 of the second pulley assembly 20 contacts the second power cable 26, as illustrated in FIG. 1B, to ensure proper cam timing.

Each different positional arrangement of anchor post 110 of timing adjustment assembly 100 results in a different effective length of first power cable 24 (or second power cable 26 with a respect to a timing adjustment assembly 100 at pulley assembly 20). This results in different effective lengths of the power cable 24 (or second power cable 26) during draw of bow 10 and differing relative synchronizations (with the bow at brace) of first pulley assembly 18 with second pulley assembly 20. As a result, a user can change the orientation and synchronization of pulley assemblies 18 and/or 20 by adjusting the effective length of power cable 24 and/or 26 through timing adjustment assembly 100. The adjustment (i.e., moving anchor post 110 of timing adjustment assembly 100 to a new positional arrangement and securing it in place relative to pulley assembly 18) can also be performed without using a bow press and without derigging the bow (i.e., without removing one or more cables from the bow), even though the power cable 24/26 is under tension when bow 10 is rigged and resists lateral deflection. The ability to make the adjustment without derigging the bow or using a bow press is highly advantageous and can be facilitated by using a torque-applying tool to operate locking fastener 116 and/or adjustment fastener 118. For example, either or both of locking fastener 116 and adjustment fastener 118 can include a hex socket head (or similar-type indention) for receiving a hex head driver or Allen wrench and applying torque with the driver or wrench to adjustment fastener 118 to change the position of adjustable anchor component 102 within receiving slot 112.

While not illustrated or specifically described herein, timing adjustment assembly 100 can similarly be used in connection with draw string 22. In such a configuration, timing adjustment assembly can be incorporated into cam body 30 of pulley assembly 18 or 20 to replace the standard draw cable anchor position arranged on the pulley assembly.

Second Embodiment of Timing Adjustment Assembly

Turning to FIGS. 5A-8C, a timing adjustment assembly 200 in accordance with a second embodiment of the present invention is illustrated and described herein. Timing adjustment assembly 200 operates in a similar manner to timing adjustment assembly 100 to enable an adjustment of the "effective length" of a power cable (and/or draw string) and synchronization of the pulley assemblies and power cables of a bow without the need of a bow press or other specialized tools.

Figure 5A:
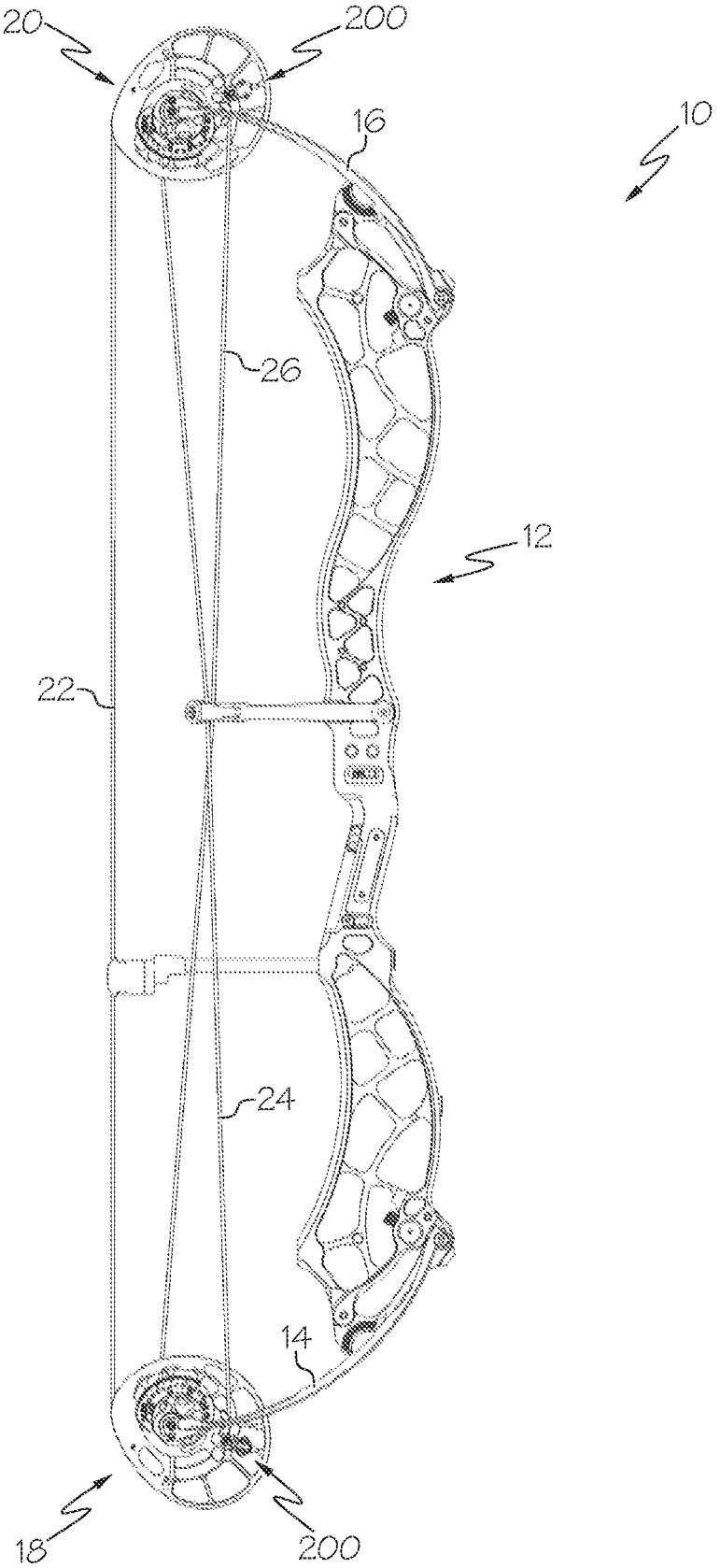
FIG. 5A is a right side elevation view of a compound bow incorporating a timing adjustment assembly in accordance with a second embodiment of the present invention, illustrating the compound bow in a brace position.
Figure 5B:
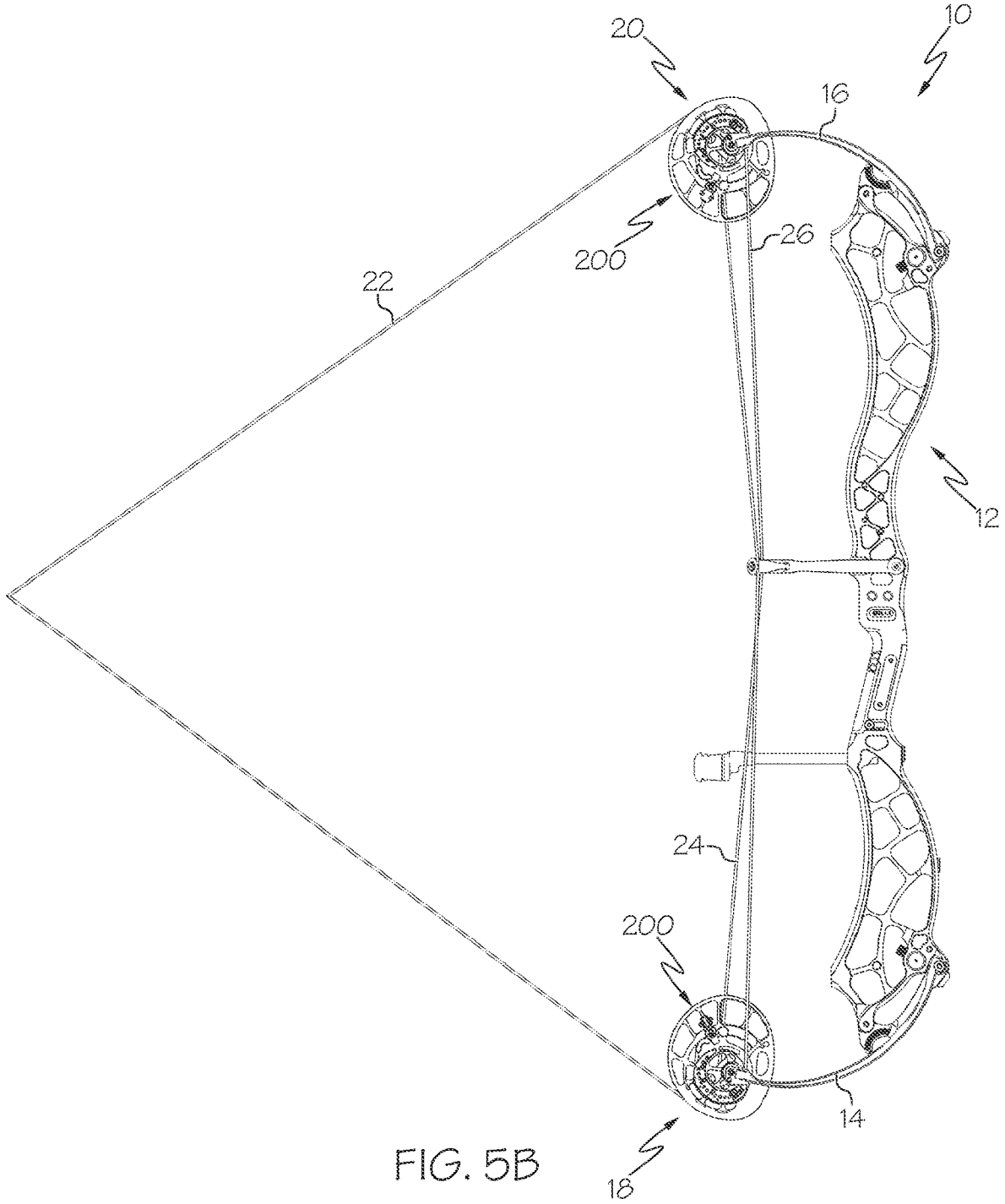
FIG. 5B is a right side elevation view of the compound bow and timing adjustment assembly of FIG. 5A illustrating the compound bow in a drawn position.

FIGS. 5A and 5B illustrate timing adjustment assembly 200 incorporated into a standard compound bow 10, which is configured similarly to bow 10 illustrated and described above (with respect to timing adjustment assembly 100 of FIGS. 1A-4C) and the same reference numbers refer to the similar components of bow 10 and pulley assemblies 18 and 20. As further illustrated in FIGS. 5A and 5B, timing adjustment assembly 200 can be incorporated into one or both pulley assemblies 18 and 20, which can operate as mirror images of one another, in a manner similar to that described above.

Figure 6A:
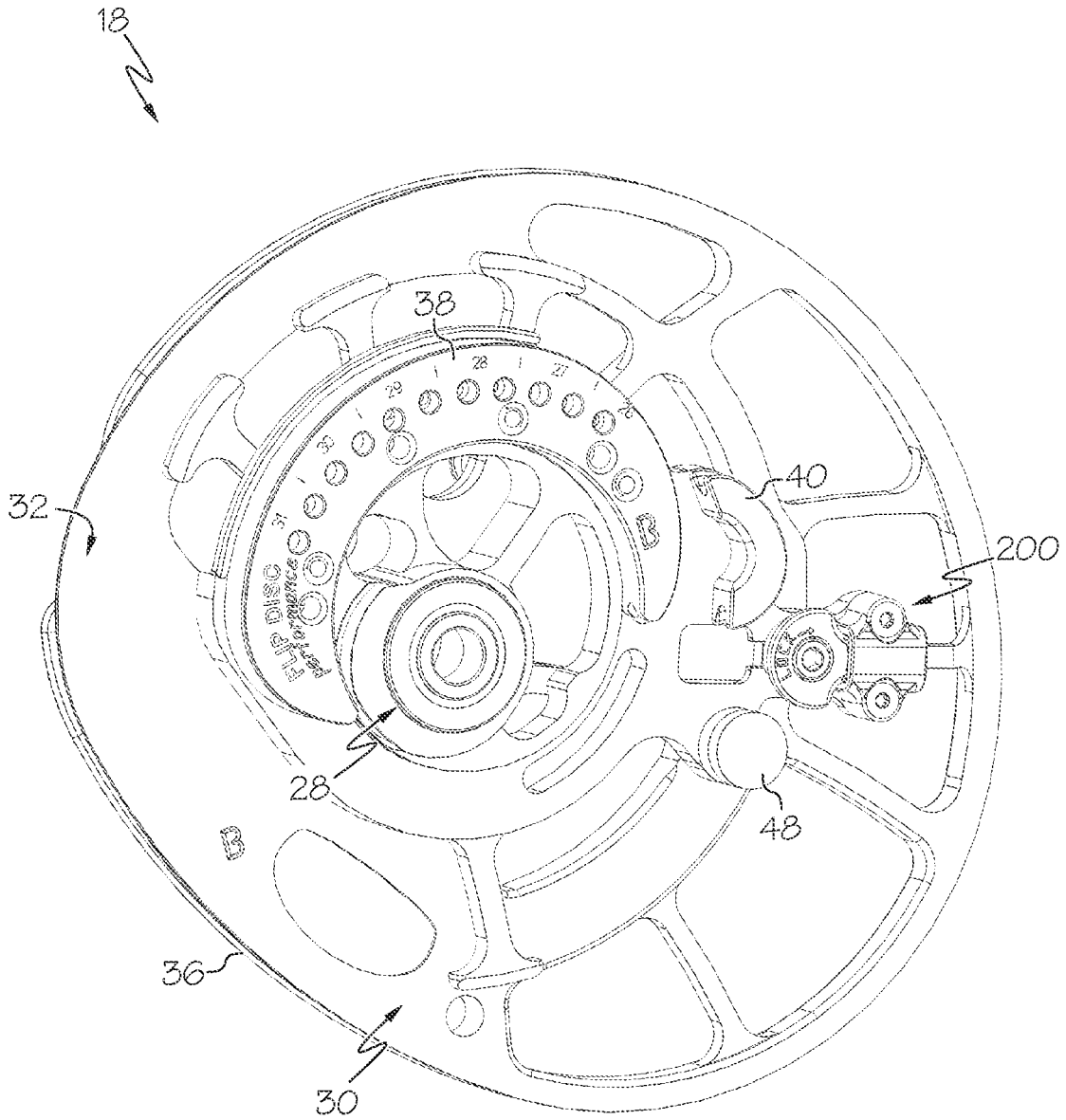
FIG. 6A is a right side perspective view of a pulley of the compound bow of FIG. 5A, the pulley incorporating the timing adjustment assembly.
Figure 6B:
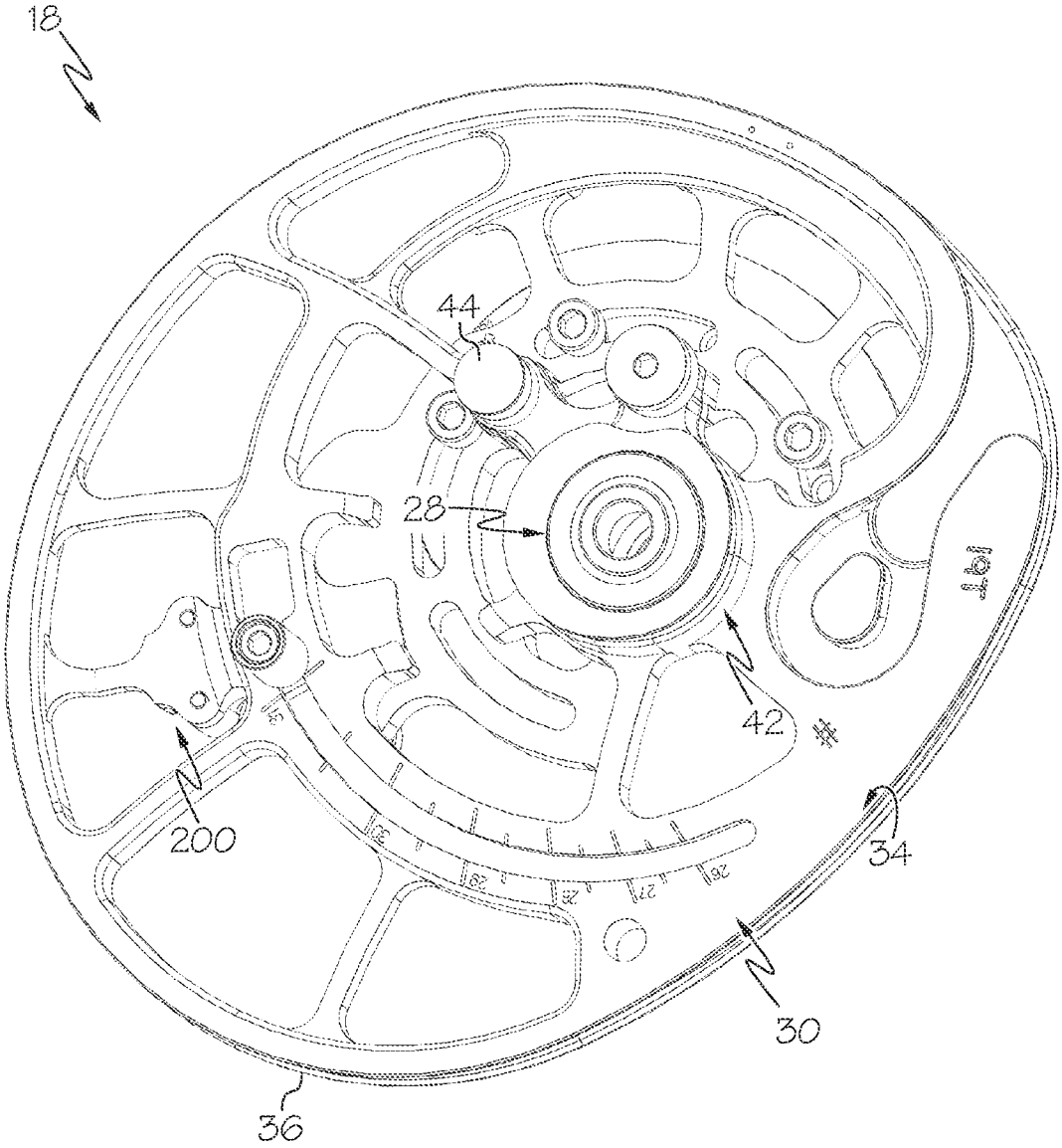
FIG. 6B is a left side perspective view of a pulley of the compound bow of FIG. 5A, the pulley incorporating the timing adjustment assembly.

FIGS. 6A and 6B illustrate pulley assembly 18 with timing adjustment assembly 200 incorporated therein. Pulley assembly 18 (with the exception of the inventive timing adjustment assembly 200 incorporated therein) can be configured as any standard or suitable cam or pulley configuration, and opposite pulley assembly 20 can be configured as a mirror image of pulley assembly 18 or as a different pulley configuration). As shown, pulley assembly 18 according to one embodiment can include a cam body 30 having a first side 32 (see FIG. 6A) and a second side 34 (see FIG. 6B).

Figure 8A:
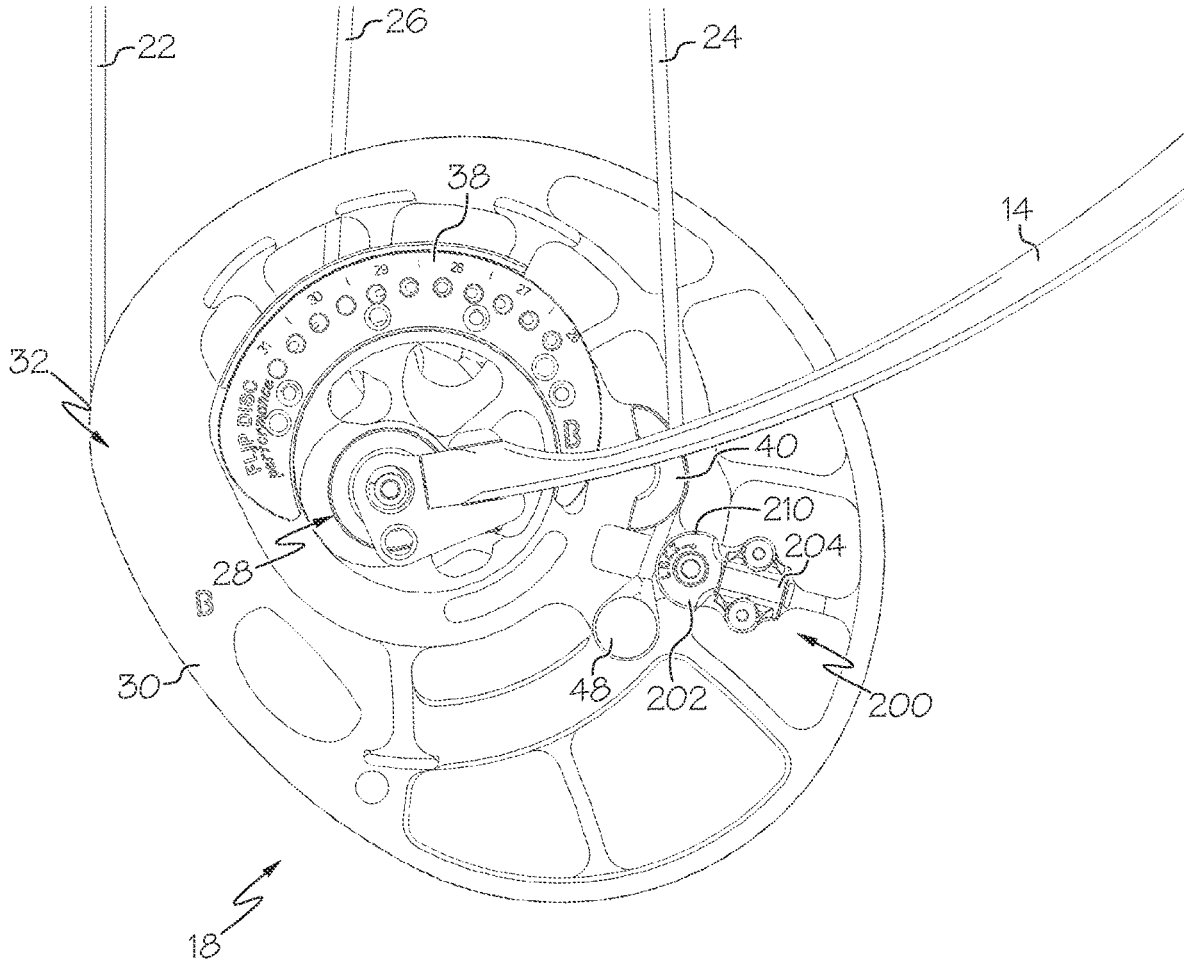
FIG. 8A is a partial right side elevation view of the compound bow of FIG. 5A illustrating the pulley and timing adjustment assembly in a first adjusted position.
Figure 8B:
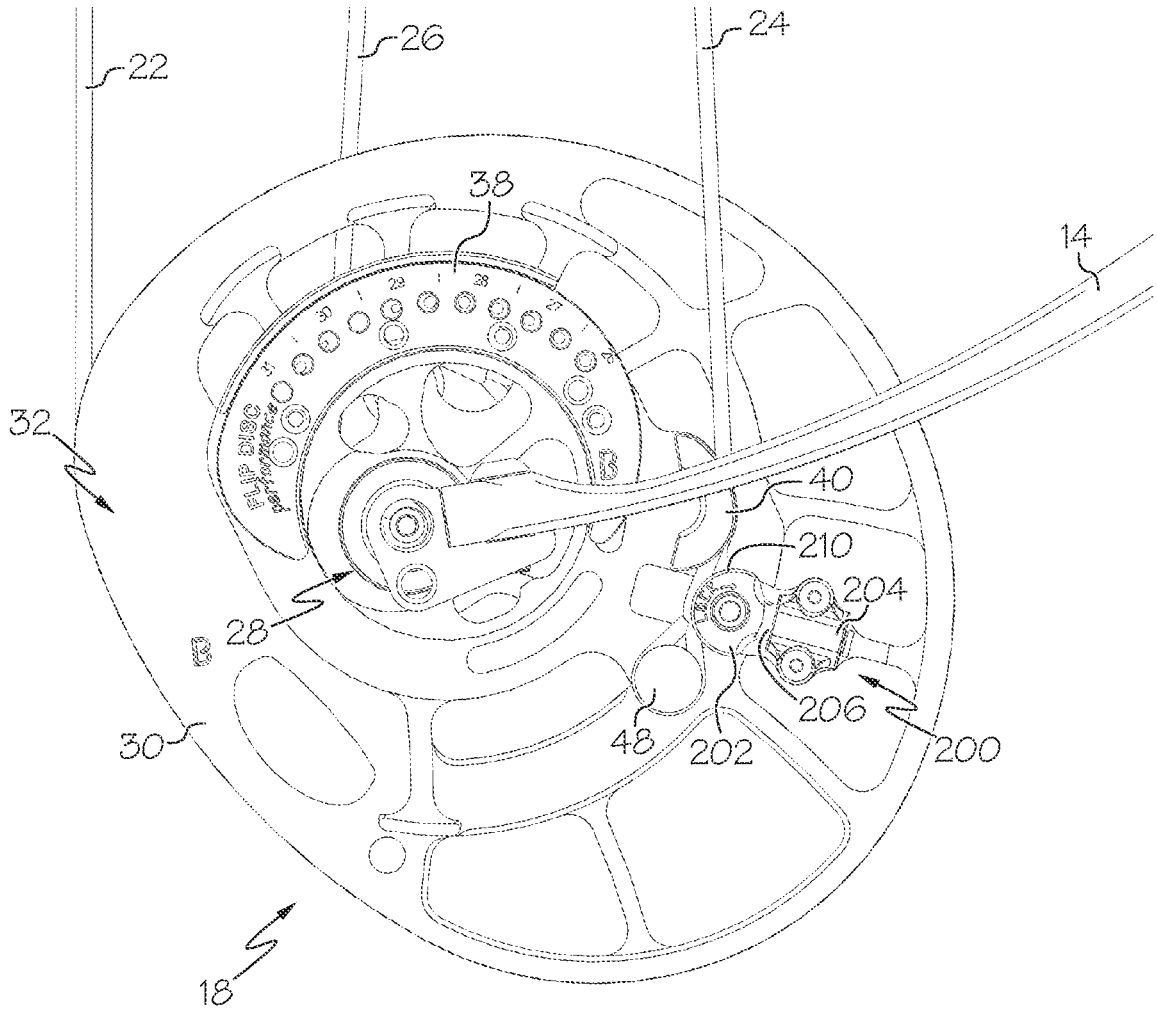
FIG. 8B is a partial right side elevation view of the compound bow of FIG. 5A illustrating the pulley and timing adjustment assembly in a second adjusted position.
Figure 8C:
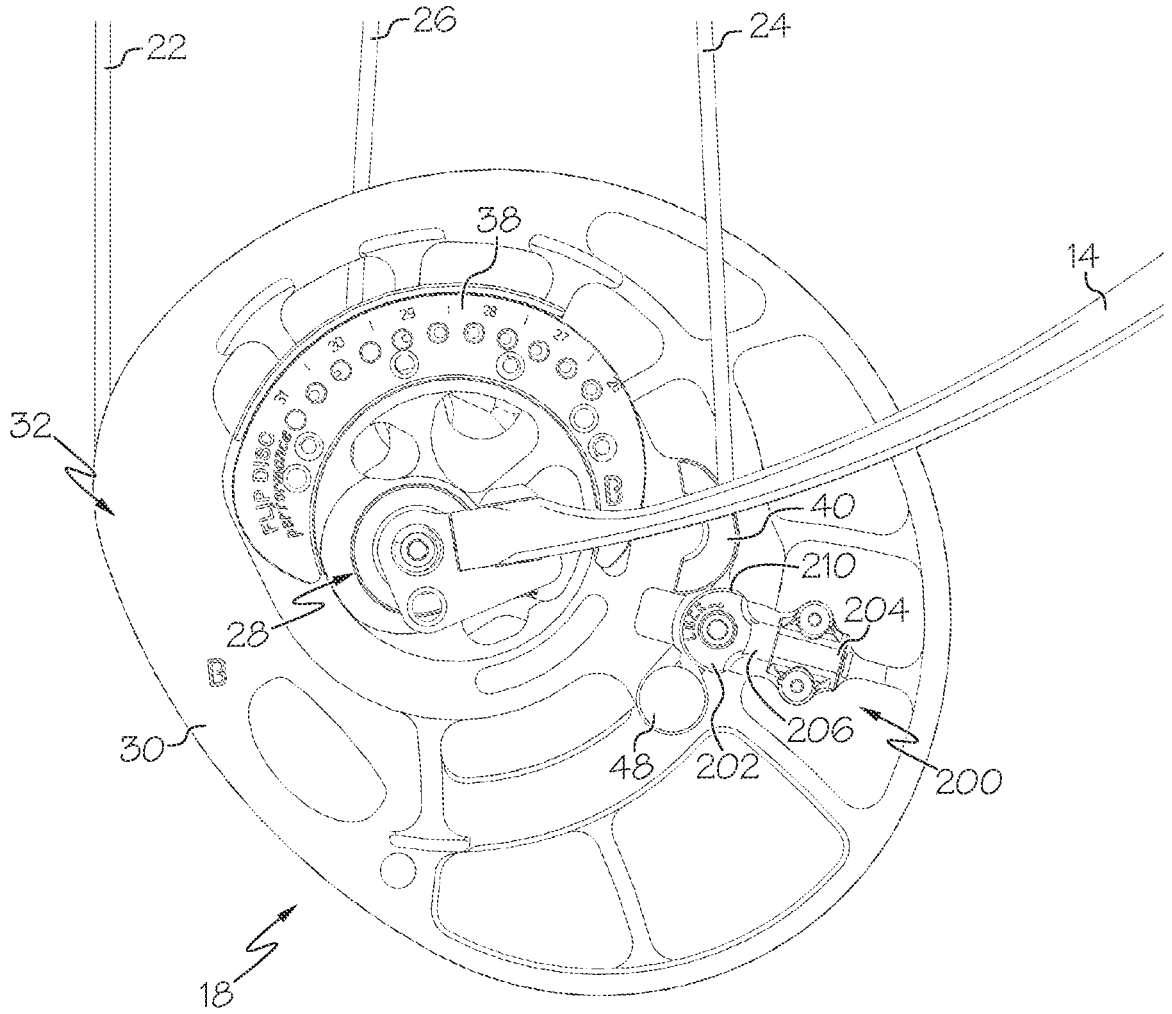
FIG. 8C is a partial right side elevation view of the compound bow of FIG. 5A illustrating the pulley and timing adjustment assembly in a third adjusted position.

As best shown in FIG. 6A, the first side 32 of cam body 30 can be configured as the take-up side for first power cable 24 and can include a cam module 38 provided adjacent the opening for axle 28, an intermediate routing post 40, and an anchor post 48. Each of cam module 38, routing post 40, and anchor post 48 can be integrally formed onto cam body 30 or coupled or secured thereto depending on the desired configuration and can be configured as any standard component typically incorporated for cam pulley assemblies known in the art. As illustrated in FIGS. 8A-C, first power cable 24 can be anchored to and terminate at anchor post 48 and extend to engage along a track or guide formed along the edge of routing post 40. Further, as illustrated in FIG. 5B, as pulley assembly 18 rotates during operation of bow 10, first power cable 24 can engage cam module 38.

As best shown in FIG. 6B, the second side 34 of cam body 30 can be configured as the let-out side for second power cable 26. Cam body 30 can include a power cable track 42 formed round and adjacent the opening for axle 28, an intermediate routing post, and an anchor post 44. Track 42, routing post, and anchor post 44 can be integrally formed on cam body 30 or attached or secured thereto. Second power cable 26 can extend around power cable track 42, then around the routing post, before terminating at anchor post 44 so that they collectively form the let-out means for second cable 26 in a manner similar to that described above.

As further shown in FIGS. 6A and 6B, timing adjustment assembly 200 can be positioned onto cam body 30 between anchor post 48 and routing post 40 in order to selectively engage with first power cable 24. As described in greater detail below, cam assembly 200 can be configured to deflect power cable 24 at brace in order to adjust the "effective length" of first power cable 24 to synchronize power cables 26 and 26 and pulley assemblies 18 and 20. Notably (as best illustrated in FIGS. 8A-8C, timing adjustment assembly 200 changes the effective length of power cable 24 (and/or power cable 26) both while bow 10 is in the brace position and during draw of bow 10. Timing adjustment assembly 200 can be secured to, or otherwise incorporated into, cam body 30 on first side 32 and located radially inward from the peripheral edge of pulley assembly 18. A similar timing adjustment assembly 200 can similarly be provided at pulley assembly 20 for second power cable 26 in certain embodiments as illustrated in FIGS. 5A and 5B.

Figure 7A:
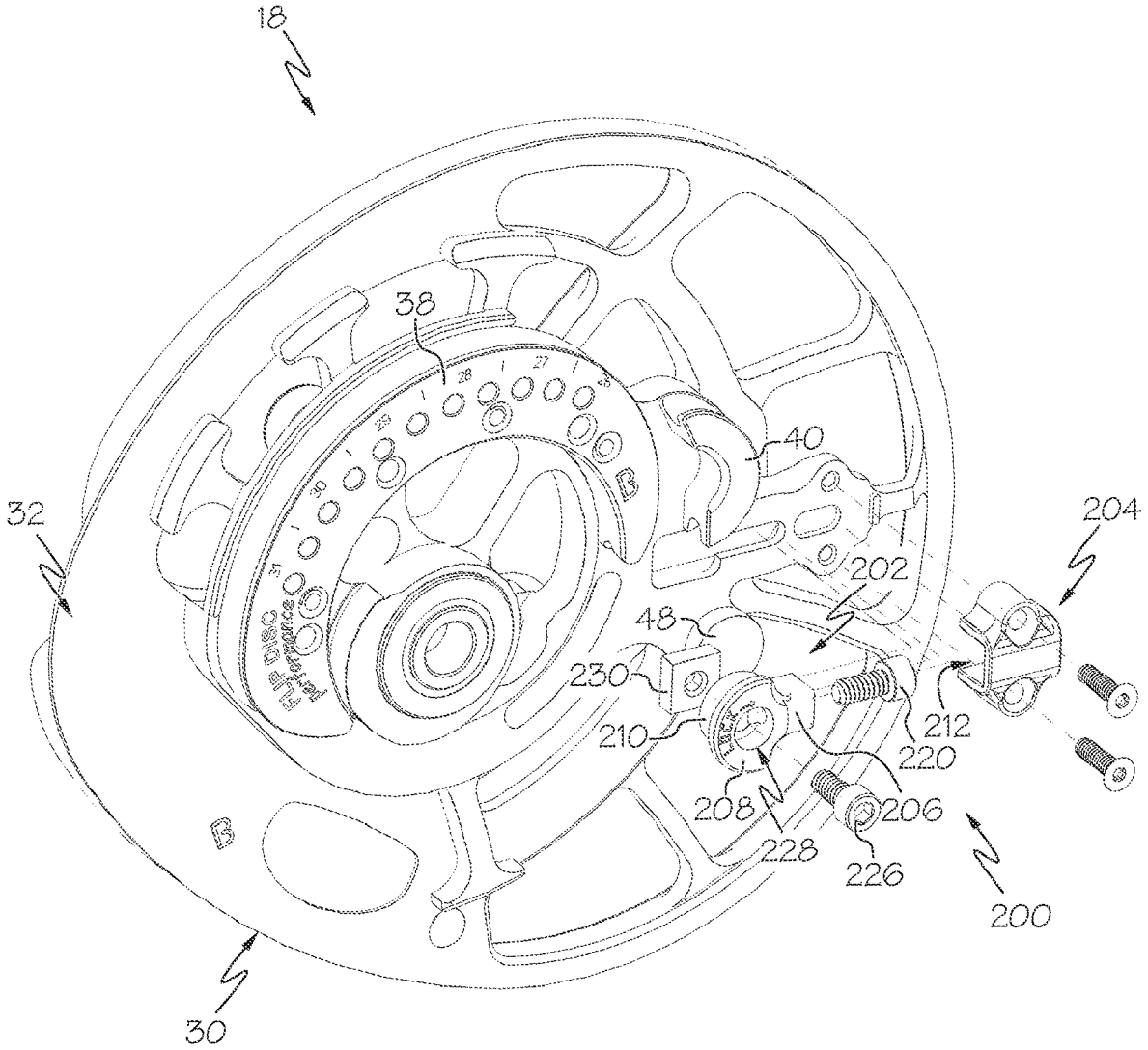
FIG. 7A is an exploded right side perspective view of a pulley of the compound bow of FIG. 5A, the pulley incorporating the timing adjustment assembly.
Figure 7B:
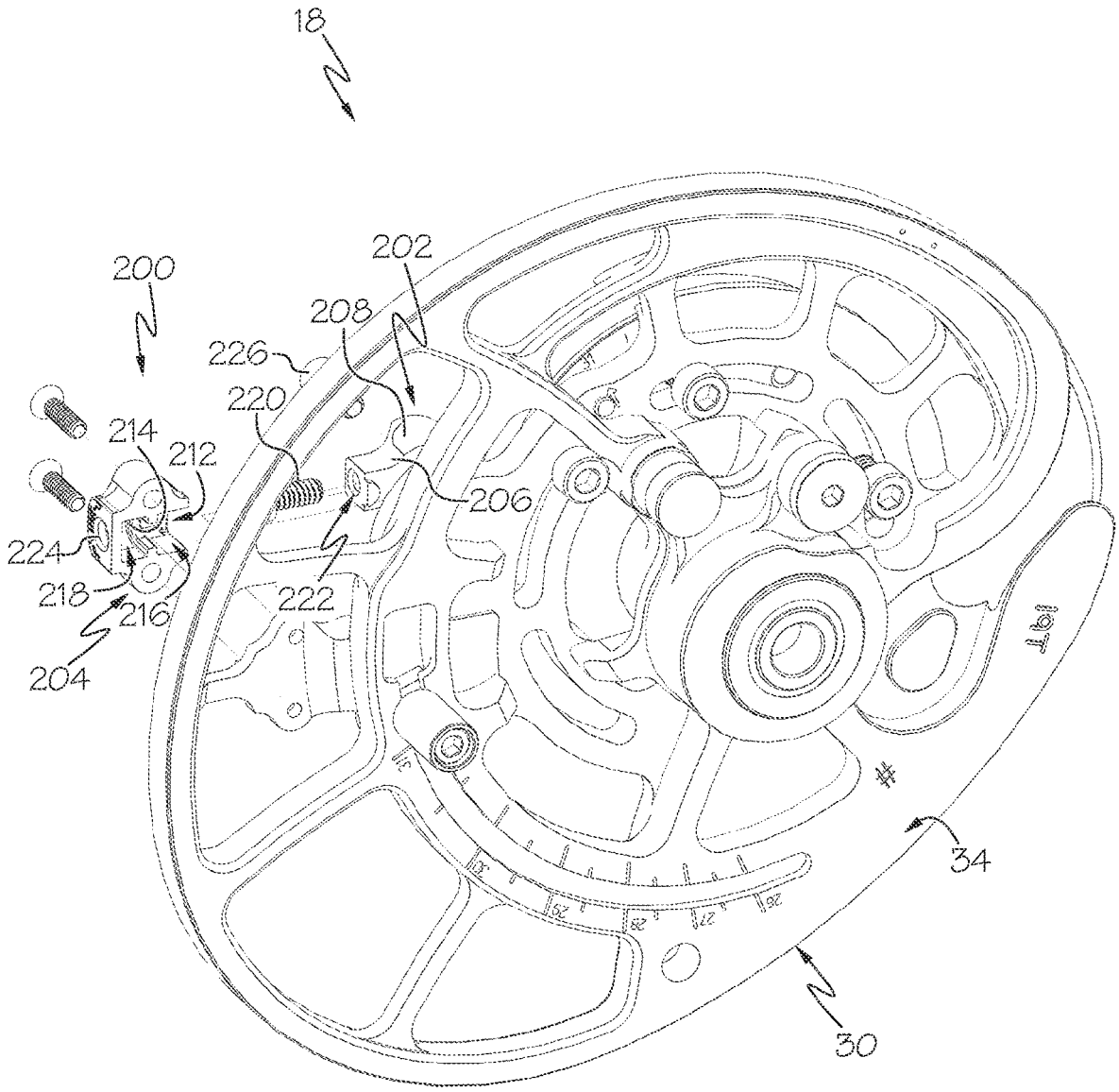
FIG. 7B is an exploded left side perspective view of a pulley of the compound bow of FIG. 5A, the pulley incorporating the timing adjustment assembly.

As shown in FIGS. 7A and 7B, one embodiment of timing adjustment assembly 200 can include an adjustable pusher component 202 and a bracket or housing 204. Housing 204 can be fixedly mounted or coupled to cam body 30 by one or more fasteners, bolts, screws, pins, or any other suitable means for securely attaching housing 204 to cam body 30. Housing 204 can further be configured and operate as a stationary component that adjustable pusher component 202 moves in a translating motion relative thereto. According to one embodiment as shown in FIGS. 7A and 7B, housing 204 can be attached to cam body 30 by two threaded fasteners that are inserted through openings in both the housing 204 itself and cam body 30 and secured thereto. Any other suitable configuration can also be used to secure housing 204 to cam body 30. Alternatively, housing 204 may be integrally formed onto or as part of cam body 30. In another embodiment, the bracket or housing 204 is not present. In such an embodiment, cam body 30 may include a slot (similar to slot 112 described above) into which adjustable pusher component 202 is received and may be slidably adjusted (similar to anchor component 12 described above).

Adjustable pusher component 202 can be configured to selectively slide or move linearly (i.e., move in a straight line path) across the surface of cam body 30 by sliding relative to housing 204, which may be fixedly secured to cam body 30. As shown, adjustable pusher component 202 can include a base portion 206 and a pusher or deflector member 208 extending from one end of base portion 206. Base portion 206 can be configured to be partially positioned within housing 204 and slide or move into and out of housing 204. Deflector member 208 extends from the end of base portion 206 that is opposite of housing 204 and positioned away therefrom. As best shown in FIG. 7A, deflector member 208 can include an engaging or pushing surface 210 that is configured to engage with power cable 24 (or power cable 26 on second pulley assembly 20) when adjustable pusher component 202 is adjusted into contact with power cable 24. According to one embodiment, engaging surface 210 can have a rounded, arcuate shape to evenly distribute the forces applied to power cable 24 and increase the deflection of power cable 24 relative to the movement of adjustable pusher component 202. However, engaging surface 210 can have any other suitable shape and profile in alternative embodiments of the invention.

As further shown in FIGS. 7A and 7B, housing 204 can include an outer retaining sidewall and an interior receiving cavity or slot 212 defined by the outer retaining wall. Receiving cavity 212 can be configured for receiving and slidably retaining the base portion 206 of adjustable pusher component 202. Receiving cavity 212 can have a size and shape generally conforming to the size and shape of base portion 206 to allow base portion 206 to be both retained by housing 204 and slide linearly into and out of housing 204. As shown in FIGS. 7A and 7B, base portion 206 of adjustable pusher component 202 can have a generally orthogonal cubic shape and receiving cavity 212 of housing 204 can have a substantially similar shape defined by the outer retaining sidewall of housing 204; however, a rounded or any other suitable shape and arrangement may alternatively be used.

As best shown in FIG. 7B, receiving cavity 212 of housing 204 can include an inner seating edge or lip 214 that separates cavity 212 into a first portion 216 and a second portion 218. Inner lip 214 can be configured as a protruding edge that extends partially inward into cavity 212 as best illustrated in FIG. 7B. Inner lip 214 can also extend from or otherwise form a part of the inner surface of the outer retaining sidewall of housing 204. First portion 216 can be configured to receive base portion 206 of adjustable pusher component 202 so that when base portion 206 is fully inserted into cavity 212 it seats against and is restrained by inner lip 214. One end of first portion 216 can be defined by lip 214 and the second end of first portion can remain open to allow base portion 206 to move relative to housing 204. Second portion 218 of cavity 212 can be configured to receive the end portion of an adjustment fastener 220 that can be used to selectively move and adjust adjustable pusher component 202 as described below.

As further shown in FIGS. 7A and 7B, timing adjustment assembly 200 can include an adjustment fastener 220 configured to selectively move or slide adjustable pusher component 202 into and out of housing 204. Adjustment fastener 220 can be configured as a threaded (or unthreaded) screw, bolt, fastener, pin, or any other suitable fastening means and can be received within a corresponding opening or hole 222 defined into the end of base portion 206 of adjustable pusher component 202. Adjustment fastener 220 can positioned within cavity 212 of housing 204 and inserted into opening 222 of adjustable pusher component 202. As best shown in FIG. 7B, the end wall of housing 204 opposite base portion 20 of adjustable pusher component 202 can include an opening or slot 224 that enables a user to insert a screwdriver, Allen wrench, hex key, or similar torque-style tool or adjustment means into second cavity portion 218. When the user inserts the adjustment means into cavity 218 and in contact with adjustment fastener 220, the user can adjust the position of adjustable pusher component 202 relative to housing 204 and cam body 30 by twisting adjustment fastener 220, which in turn causes adjustable pusher component 202 to slide (or move parallel along the surface of cam body 30) into or out of housing 204. As adjustable pusher component 202 moves out of housing 204, the engaging surface 210 of deflector member 208 contacts and deflects power cable 24 to alter the path of power cable 24 and change its effective length.

As best shown in FIG. 7A, timing adjustment assembly 200 can include a locking fastener 226 for securing or locking adjustable pusher component 202 in its current position relative to housing 204, cam body 30, and power cable 24. As shown, deflector member 208 can include an opening or hole 228 defined perpendicularly into its surface for receiving locking fastener 226. Locking fastener 226 can be configured as a threaded (or non-threaded) screw, bolt, or any other suitable fastening means. Opening 228 into deflector member 208 can extend through the interior of deflector member 208 and in communication with opening 222 extending horizontally through adjustable pusher component 202 from base portion 206. As a result, locking fastener 226 can restrict or prevent the further movement of adjustment fastener 220 into adjustable pusher component 202 and effectively lock the position of adjustable pusher component 202 in place (relative to housing 204, cam body 30, and power cable 24). Locking mechanism for timing adjustment assembly 200 can also include a locking nut or anchor 230 that engages with the end of locking fastener 226 within opening 228. Collectively, locking fastener 226 and locking nut 230 can secure adjustment fastener 220 in its current location within adjustable pusher component 202 and lock adjustable pusher component 202 in place.

Turning to FIGS. 8A-8C, the operation of timing adjustment assembly 200 will now be described in greater detail. As shown in FIG. 8A, timing adjustment assembly 200 is provided on cam body 30 with housing 204 fixedly secured to cam body 30 and adjustable pusher component 202 provided in a retracted position with base portion 206 located entirely within cavity 212 of housing 204. As further shown, in this retracted position, engaging surface 210 of deflector member 208 may be in contact or engagement with power cable 24 between routing post 40 and anchor post 48; however, engaging surface 210 does not deflect power cable 24. In the event that pulley assembly 18 is out of sync and requires adjustment to synchronize pulley assemblies 18 and 20 and/or power cables 24 and 26, a user can easily change the "effective length" of power cable 24 by using timing adjustment assembly 200. Similar to the previous embodiment, the effective length power cable 24 can be defined as the length of power cable 24 from its engagement to anchor post 48 on pulley assembly 18 to its engagement to anchor post 44 on second pulley assembly 20.

Similar to the previous embodiment, timing adjustment assembly 200 can be structurally arranged to allow for any number of different deflection amounts of power cable 24 by changing the positional arrangement of pusher component 202 relative to power cable 24 (as well as housing 204 and the surface of cam body 30). The different deflection amounts result in different effective lengths of power cable 24. FIGS. 8A-8C illustrate a few exemplary different deflection amounts and resulting effective lengths of power cable 24. FIG. 8A illustrates timing adjustment assembly 200 with adjustable pusher component 202 in a fully retracted position where power cable 24 is not deflected and defines a "first effective length" of power cable 24. FIG. 8B illustrates timing adjustment assembly 200 with adjustable pusher component 202 in a partially extended (or partially retracted) position where power cable 24 is slightly deflected and defines a "second effective length" of power cable 24. As shown in FIG. 8B, base portion 206 of adjustable pusher component 202 has been extended partially from cavity 212 of housing 204 and engaging surface 210 of deflector member 208 has engaged and deflected power cable 24. FIG. 8C illustrates timing adjustment assembly 200 with adjustable pusher component 202 in a fully extended position where power cable 24 is deflected and defines a "third effective length" of power cable 24. As shown in FIG. 8C, base portion 206 of adjustable pusher component 202 has been extended fully from cavity 212 of housing 204 and engaging surface 210 of deflector member 208 has engaged and deflected power cable 24 an amount greater than the deflection occurring in the partially extended position.

To adjust timing adjustment assembly 200 and the effective length of power cable 24, a user can loosen or untighten locking fastener 226 from opening 228 and subsequently adjusting adjustment fastener 220 by either loosening or tightening fastener 220. When tightening adjustment fastener 220, pusher component 202 will extend outward from housing 204 and engaging surface 210 of deflector member 208 will deflect power cable 24 by engaging and "pushing" on power cable 24. When loosening adjustment fastener 220, pusher component 202 will retract inward into housing 204 and reduce the amount of deflection of power cable 24. By increasing or decreasing the deflection amount of power cable 24 created by adjustable pusher component 202 and timing adjustment assembly, a user can change the "effective length" of power cable 24 to synchronize bow 10, pulley assemblies 18 and 20, and power cables 24 and 26. Once the desired change to the effective length of power cable 24 by achieving the desired deflection due to timing adjustment assembly 200, locking fastener 226 can be tightened within opening 228 to lock the position of adjustable pusher component 202 relative to housing 204.

The adjusted deflection amount of power cable 24 caused by timing adjustment assembly 200 results in a change in the effective length of power cable 24 as described above. This allows timing adjustment assembly 200 to be used to properly time and synchronize bow 10 and pulley assemblies 18 and 20. Notably, the deflection of power cable 24 imparted by timing adjustment assembly 200 occurs while bow 10 is at the brace position, which allows a user to determine a necessary adjustment to the effective length of power cable 24 to properly time and synchronize the pulley assemblies. The timing and synchronization of pulley assemblies 18 and 20 can be achieved by using timing adjustment assembly 200 to increase or decrease the amount of deflection applied to power cable 24 and/or 26 thereby increasing or decreasing the effective length of one or both of power cables 24 and 26.

Third Embodiment of Timing Adjustment Assembly

Turning to FIGS. 9A-12D, a timing adjustment assembly 300 in accordance with a third embodiment of the present invention is illustrated and described herein. Similar to the embodiments of timing adjustment assemblies 100 and 200, timing adjustment assembly 300 can enable an adjustment of the "effective length" of a power cable (and/or compound bow string) and synchronization of the pulley assemblies and power cables of a bow without the need of a bow press or other specialized tools. As described in greater detail herein, timing adjustment assembly 300 can be located along the path of one or both of the power cables of a bow and can be separate from each pulley assembly. As a result, timing adjustment assembly 300 need not be provided on or otherwise attached or connected to one of the pulley assemblies as in the embodiments of timing adjustment assemblies 100 and 200 disclosed previously. Accordingly, timing adjustment assembly 300 may be included as a standard or optional original equipment feature for new bows when manufactured, may be implemented as an add-on feature, or may be used to retrofit existing bows.

Figure 9A:
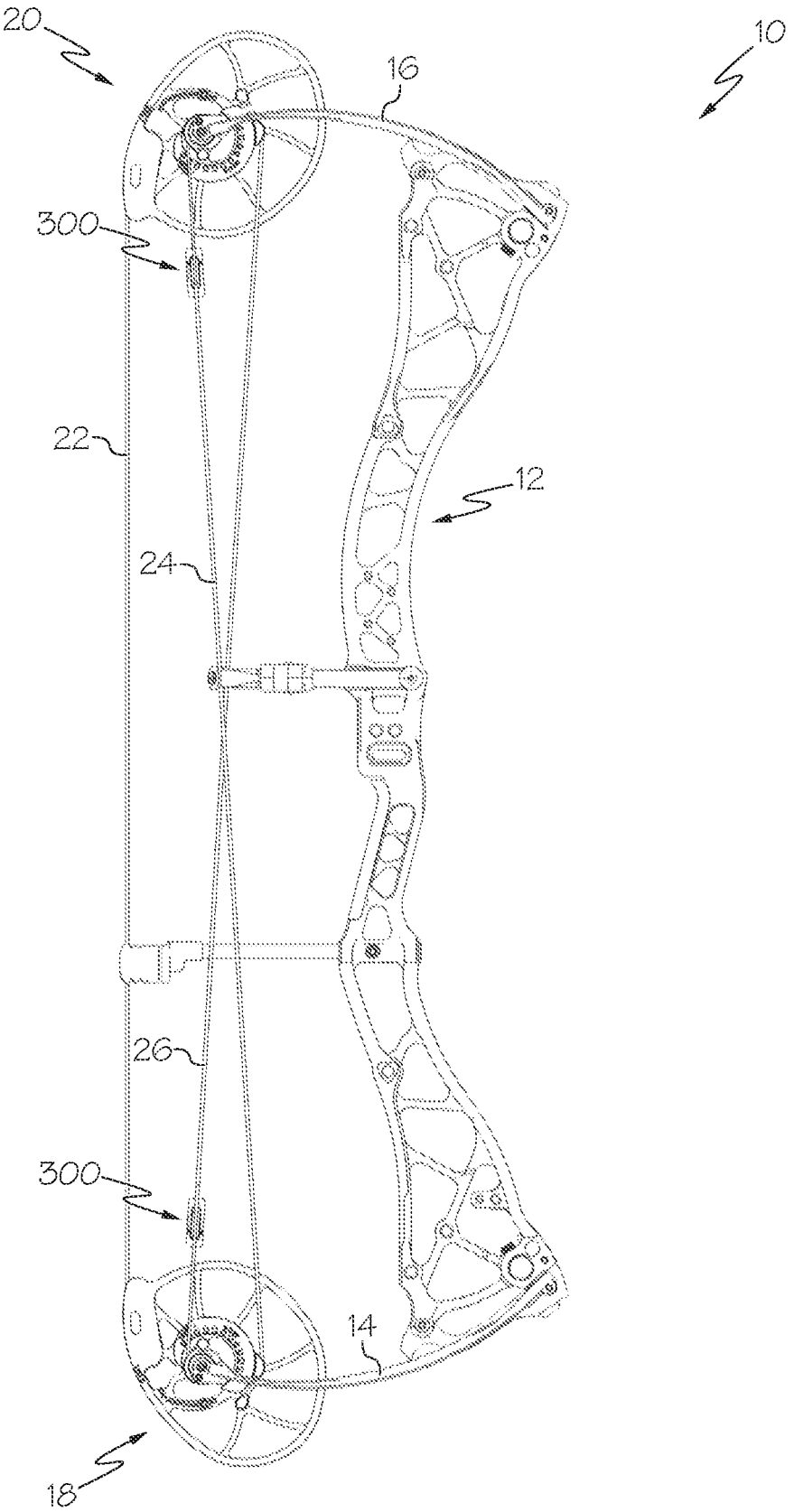
FIG. 9A is a right side elevation view of a compound bow incorporating a timing adjustment assembly in accordance with a third embodiment of the present invention, illustrating the compound bow in a brace position.
Figure 9B:
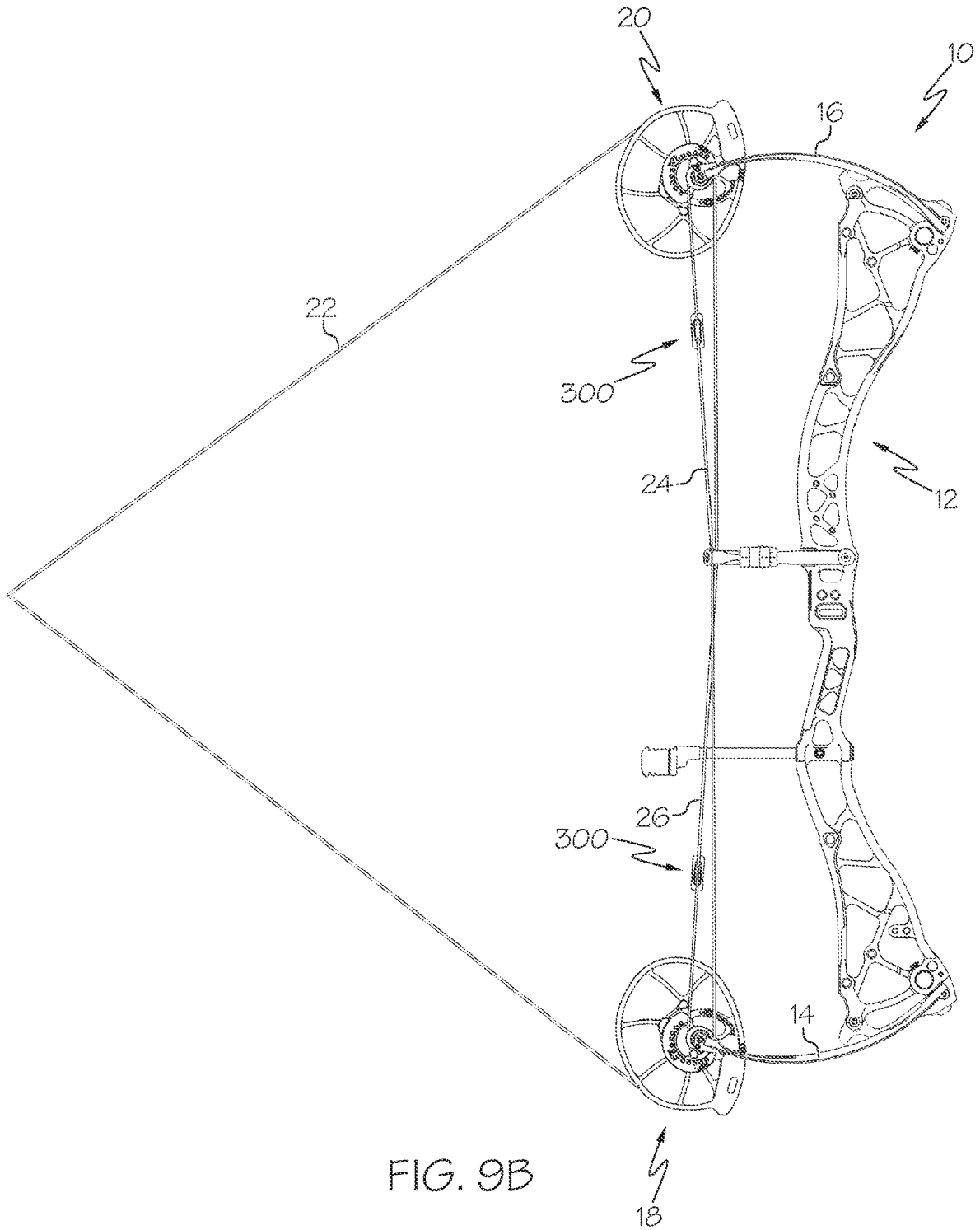
FIG. 9B is a right side elevation view of the compound bow and timing adjustment assembly of FIG. 9A illustrating the compound bow in a drawn position.

FIGS. 9A and 9B illustrate timing adjustment assembly 300 incorporated into a standard compound bow 10, which is configured similarly to bow 10 illustrated and described above (with respect to timing adjustment assembly 100 of FIGS. 1A-4C and assembly 200 of FIGS. 5A-8C) and the same reference numbers refer to the similar components of bow 10 and pulley assemblies 18 and 20. However, as further illustrated in FIGS. 9A and 9B, timing adjustment assembly 300 can be incorporated directly into one or both of power cables 24 and 26 at a distance away from pulley assemblies 18 and 20. In such a configuration, timing adjustment assembly 300 can be provided at an intermediate position along the length of power cable 24 and/or 26 between the two pulley assemblies 18 and 20.

Figure 10:
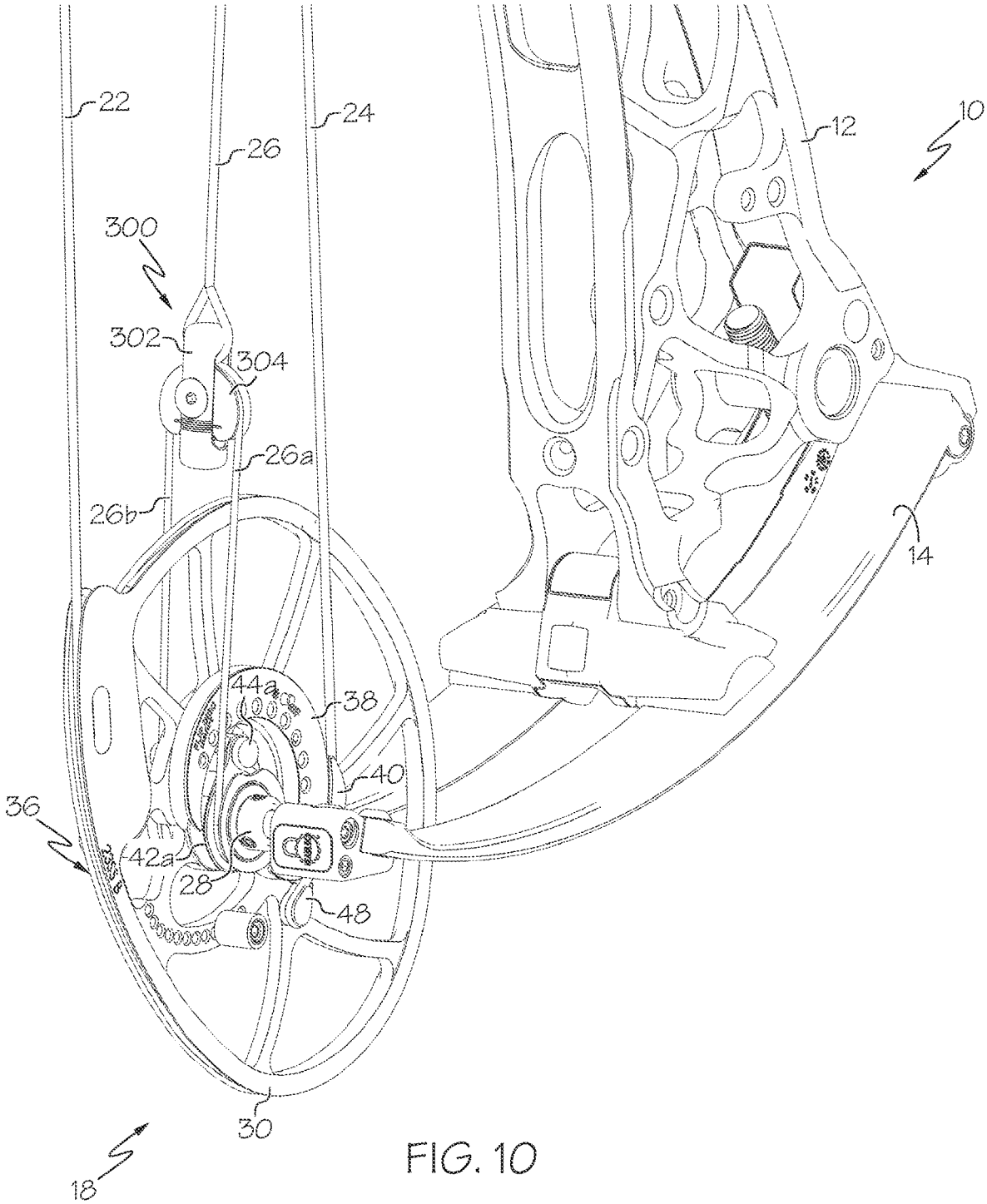
FIG. 10 is a partial right side perspective view of the compound bow of FIG. 9A illustrating the timing adjustment assembly.

FIG. 10 illustrates pulley assembly 18 and power cables 24 and 26 in greater detail with timing adjustment assembly 300 incorporated along the path of power cable 24. As shown, timing adjustment assembly 300 can be incorporated into power cable 26 adjacent to pulley assembly 20. Similarly, a second timing generally adjustment assembly 300 can be incorporated into power cable 24 generally adjacent to second pulley assembly 20 as shown in FIGS. 9A and 9B. Pulley assembly 18 can be configured as any standard or suitable cam or pulley configuration, and opposite pulley assembly 20 can be configured as a mirror image of pulley assembly 18 or as a different pulley configuration).

As shown in FIG. 10, pulley assembly 18 according to one embodiment can include a cam body 30 with take-up means and let-out means for both power cables 24 and 26. For the take-up means associated with first power cable 24, pulley assembly 18 can include a cam module 38 provided adjacent the opening for axle 28, an intermediate routing post 40, and an anchor post 48, each provided on or integral with cam body 30. First power cable 24 can be anchored to and terminate at anchor post 48 and extend to engage along a track or guide formed along the edge of routing post 40. Further, as illustrated in FIG. 9B, as pulley assembly 18 rotates during operation of bow 10, first power cable 24 can engage cam module 38 as first power cable 24 is taken-up.

As further shown in FIG. 10, pulley assembly 18 according to one embodiment can be configured to accommodate a split let-out means for second power cable 26. As shown, power cable 26 can be split into two separate cable ends 26*a* and 26*b* at timing adjustment assembly 300 and both cable ends 26*a* and 26*b* can be anchored to pulley assembly 18 at the first and second sides 32 and 32 of cam body 30, respectively. First side 32 of cam body 30 can include a power cable track 42*a* formed round and adjacent the opening for axle 28, an intermediate routing post, and an anchor post 44*a*. Second power cable end 26*a* can extend around power cable track 42*a*, then around the routing post, before terminating at anchor post 44*a*. Second side 34 of cam body 30 can include an identical configuration of a power cable track 42*b*, intermediate routing post, and anchor post 44*b* for anchoring second power cable end 26*b*. Collectively, power cable tracks 42, intermediate routing posts, and anchor posts 44 can form the let-out means for second power cable 26. In another embodiment (not shown), second separate portion of power cable 26 (which is illustrated in the figures as split cable ends 26*a* and 26*b*) can alternatively comprise a single cable end 26*a* anchored or attached to timing adjustment assembly 300 at one end and anchored to pulley assembly 18 at its other end via a single anchor post 44, power cable track 42 and optional intermediate routing post located on one side of pulley assembly 18.

Turning now to FIGS. 10-12E, timing adjustment assembly 300 will be described in greater detail. As shown in FIG. 10, timing adjustment assembly 300 can be configured along the path of second power cable 26 and positioned above and adjacent to first pulley assembly 18. Timing adjustment assembly 300 can be configured to split cable 26 into two split ends 26*a* and 26*b* that are anchored to first pulley assembly 18 while having an adjustable component that enables the length of power cable 26 to be increased or decreased so that pulley assemblies 18 and 20 and cables 24 and 26 can be synchronized.

As shown, timing adjustment assembly 300 can include a coupler component 302 and an adjustable yoke component 304 coupled to the coupler component 302. Coupler component 302 can have an elongated shape formed by a sidewall and a first end portion 306 and a second end portion 308 on opposing ends thereof. The sidewall can include a slot or opening 310 defined through the central region of coupler component 302 and between end portions 306 and 308, which are enclosed ends as illustrated in FIGS. 10-12E. Slot 310 can be configured to receive adjustable yoke component 304 and can include a height greater than adjustable yoke component 304 to enable adjustable yoke component 304 to move along the length of coupler component 302 within slot 310. According to one embodiment, adjustable yoke component 304 can move within slot 310 generally vertically in a linear path relative to first and second end portions 306 and 308. Coupler component 302 can be configured and operate as a stationary component that adjustable yoke component 304 moves in a translating motion relative thereto. FIGS. 10-12E illustrate coupler component 302 having a generally rounded, rectangular shape and adjustable yoke component 304 having a generally flat disc-shape; however, both components 302 and 304 can have any suitable shape, configuration and dimensions that enable adjustable yoke component 304 to be received within coupler component 302 and slide or move in a linear path therein.

Figure 11A:
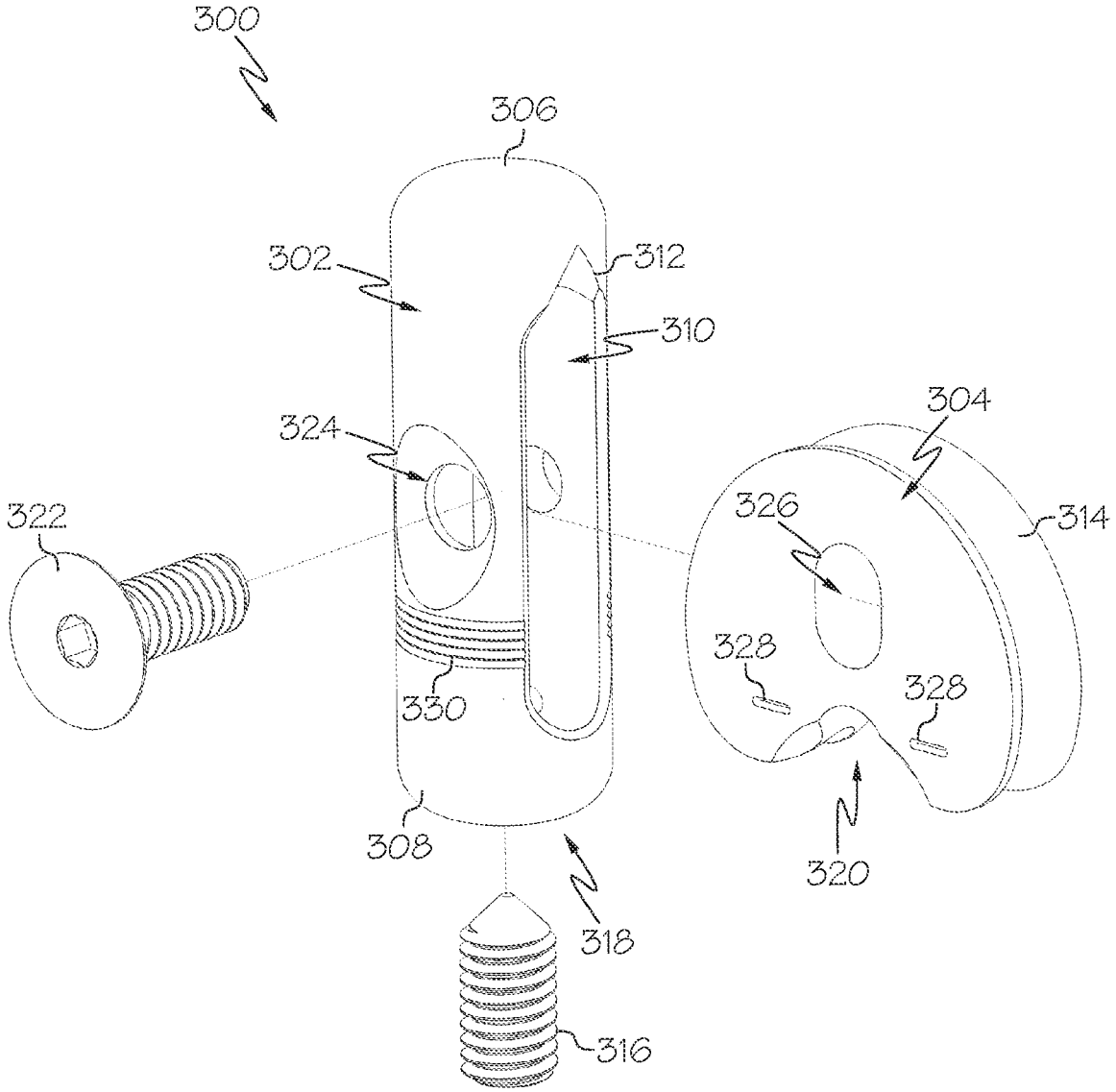
FIG. 11A is a schematic exploded perspective view of the timing adjustment assembly incorporated into the compound bow of FIG. 9A.
Figure 11B:
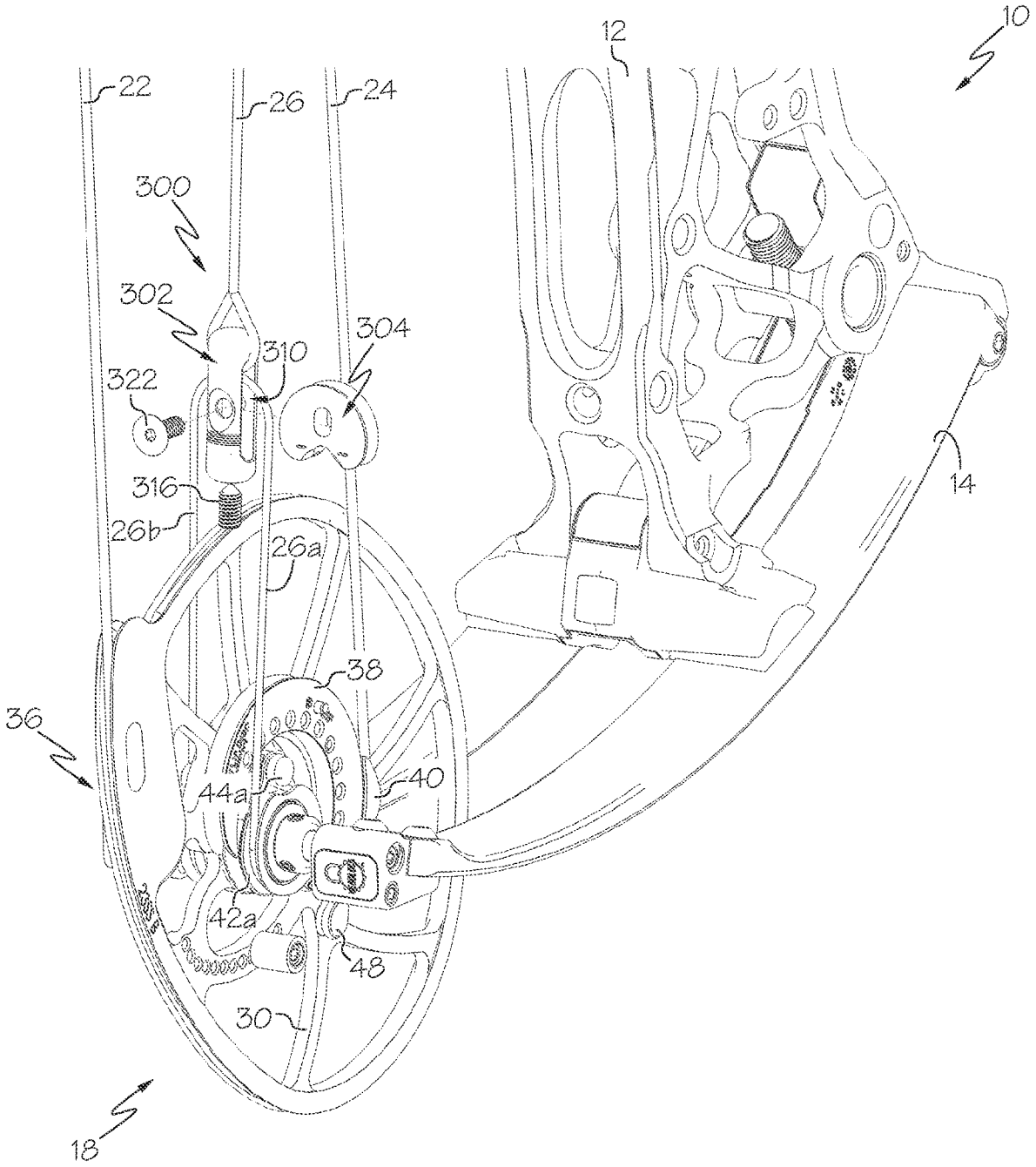
FIG. 11B is an exploded partial right side perspective view of the compound bow of FIG. 9A illustrating the timing adjustment assembly.

As best shown in FIG. 11A, first end portion 306 of coupler component 302 can include a groove or receiving surface 312 for second power cable 26 (illustrated in FIGS. 10 and 11B). Groove 312 can be configured to receive a looped end of second power cable 26 and anchor second power cable 26 to coupler component 302. As further shown in FIG. 11A, adjustable yoke component 304 can include a groove or receiving surface 314 for split ends 26*a* and 26*b* of second power cable 26 (also illustrated in FIGS. 10 and 11B). As best shown in FIG. 11A, groove 314 can be provided along the perimeter of adjustable yoke component 304 and can have a recessed surface for receiving and retaining the split ends 26*a* and 26*b* of second power cable 26 within timing adjustment assembly 300. The opposing portions of split ends 26*a* and 26*b* can extend toward pulley assembly 20 and can be anchored thereto as best shown in FIGS. 10 and 11B. While not illustrated herein, in an alternative embodiment, the second portion of power cable 26 can be configured as a single cable anchored to adjustable yoke component 304 as a looped end and similarly anchored to pulley assembly 18 as described above.

Figure 12A:
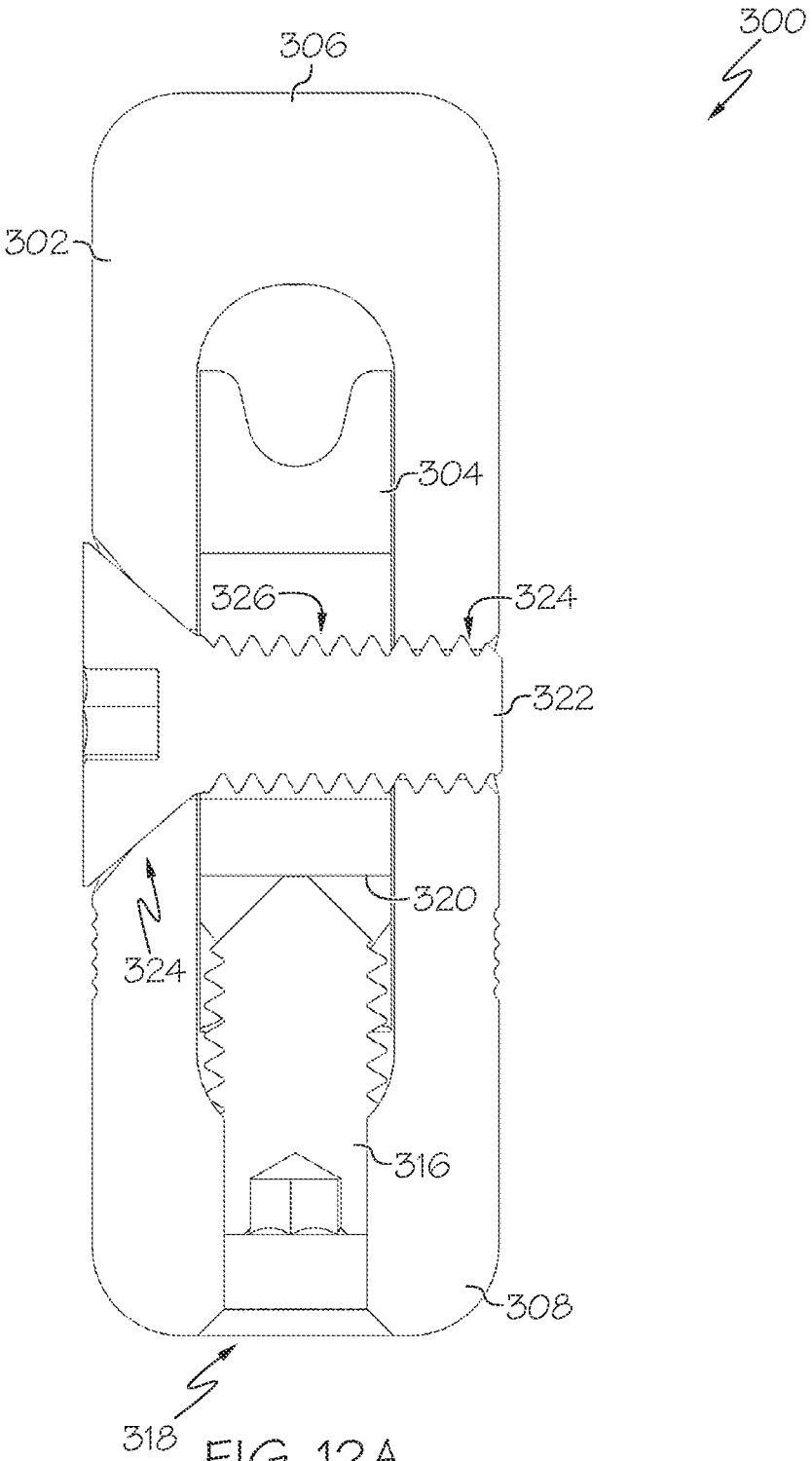
FIG. 12A is a schematic sectional view of the timing adjustment assembly of FIG. 9A illustrating the timing adjustment assembly in a first adjusted position.
Figure 12B:
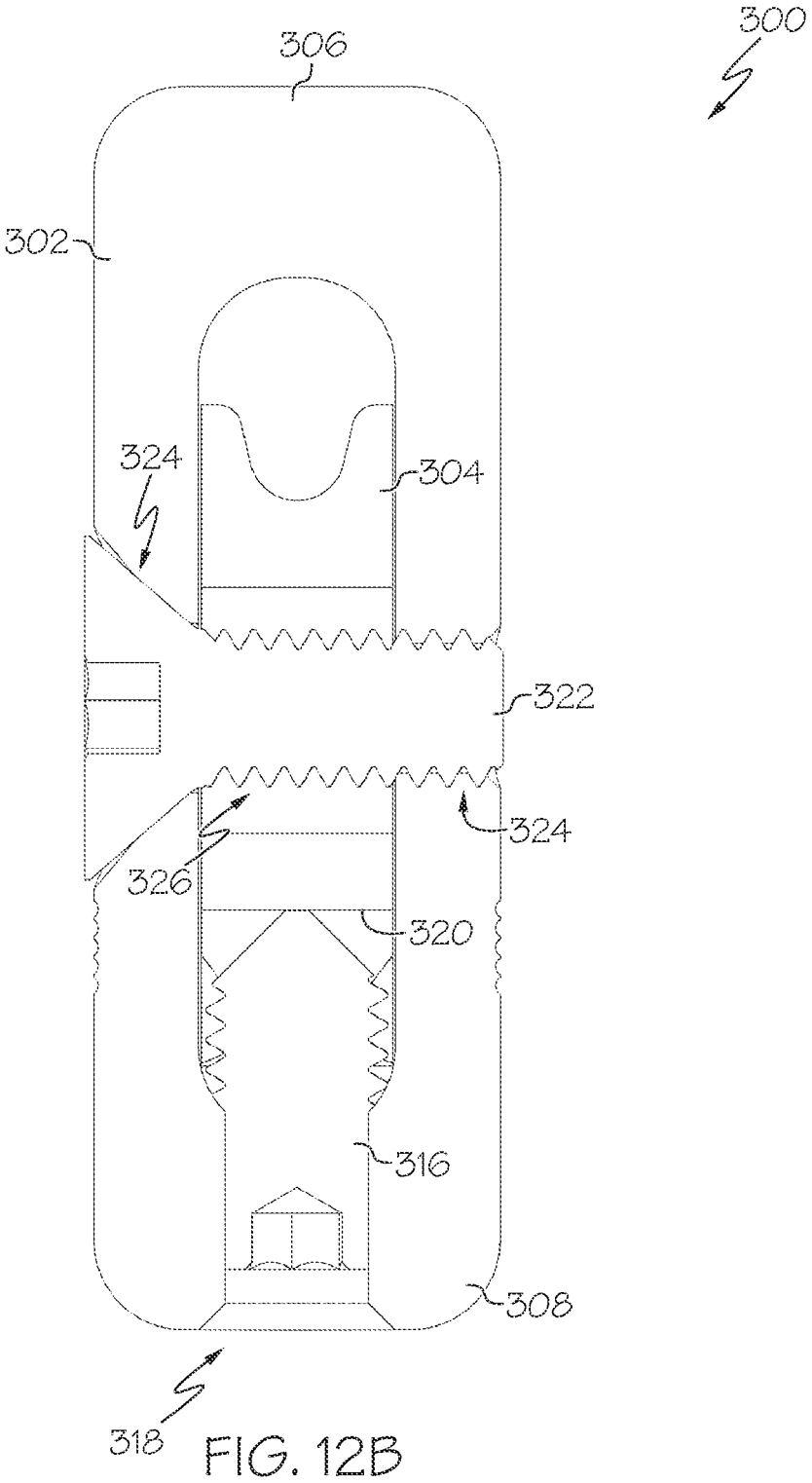
FIG. 12B is a schematic sectional view of the timing adjustment assembly of FIG. 9A illustrating the timing adjustment assembly in a second adjusted position.
Figure 12C:
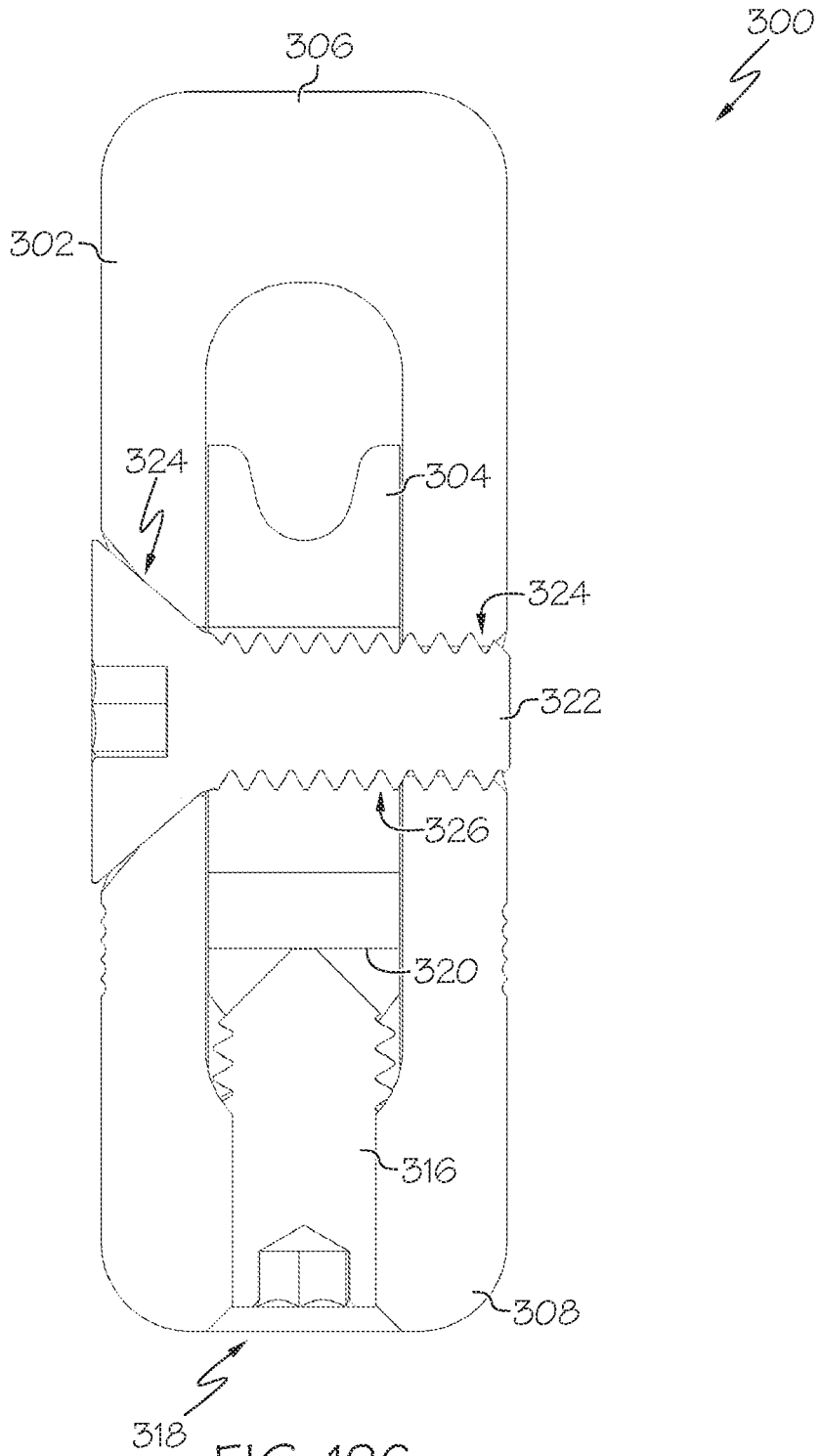
FIG. 12C is a schematic sectional view of the timing adjustment assembly of FIG. 9A illustrating the timing adjustment assembly in a third adjusted position.

As further shown in FIG. 11A, timing adjustment assembly 300 can include an adjustment fastener 316 that can be inserted through second end portion 308 of coupler component 304 in order to allow for adjustment of the positioning of adjustable yoke component 304 within slot 310. Adjustment fastener 316 can be configured as a threaded (or non-threaded) fastener, screw, bolt, pin, or any other suitable fastening means similar to the adjustment fasteners described above with respect to the previous embodiments of the invention. As best shown in FIGS. 11A and 12A-12C, adjustment fastener 316 can be inserted into and through an opening 318 provided in second end portion 308 of coupler component 302 so that an inserted end of fastener 316 is positioned within the interior of slot 310. The inserted end of adjustment fastener 316 can further be configured to contact an engaging surface 320 on adjustable yoke component 304. Engaging surface 320 is illustrated as an indention or recessed grove formed into the lower end of adjustable yoke component 304; however, engaging surface 320 can have any suitable configuration that allows for the inserted end of fastener 316 to engage and support adjustable yoke component 304 within slot 310 of coupler component 302. As best shown in FIGS. 12A-12C, when adjustment fastener 316 is inserted into slot 310 of coupler component 302, the engaging surface 320 of adjustable yoke component 304 will be supported on the inserted end of fastener 316 so that the position of fastener 316 within slot 310 defines the position of adjustable yoke component 304 relative to coupler component 302. As adjustment fastener 316 is inserted further into slot 310, it pushes upward adjustable yoke component 304 within slot 310. Similarly, as adjustment fastener 316 is unwound or pulled out of slot 310, adjustable yoke component 304 moves downward within slot 310.

As further shown in FIGS. 11A and 12A-12C, timing adjustment assembly 300 can include a locking fastener 322, which can be inserted into and through a corresponding opening 324 in coupler component 302 and a corresponding opening 326 in adjustable yoke component 304. Locking fastener 322 can be configured as any suitable threaded fastener, screw, bolt, pin, or other suitable fastening means (threaded or non-threaded) similar to the locking fasteners described above with respect to previous embodiments of the invention. As best shown in FIG. 11A, opening 324 can be defined through the sidewall of coupler component 302 between the first and second end portions 306 and 308 and configured to receive locking fastener 322 so that locking fastener 322 can be inserted generally horizontally through slot 310 of coupler component 302. Opening 324 can have a diameter or shape approximately similar to that of locking fastener 322 in order to secure and support fastener 322 once inserted therein.

As further shown, opening 326 can be defined into and through adjustable yoke component 304. According to one embodiment, opening 326 can be configured with an elongated slotted shape extending generally in the same direction and orientation as slot 310 of coupler component 302. According to this embodiment, when locking fastener 322 inserted into and through opening 324 of coupler component 302 and opening 326 of yoke component 304, locking fastener 322 secures yoke component 304 within slot 310 but allows for the vertical position of yoke component 304 within slot 310 to be adjusted by the adjustment fastener 316, as best illustrated in FIGS. 12A-12C.

FIGS. 12A-12F illustrate the operation, functionality, and adjustment of timing adjustment assembly 300 when incorporated into a bow 10 in accordance with one embodiment of the invention. FIGS. 10 and 11B best illustrate timing adjustment assembly 300 configured into bow 10, and particularly incorporated into power cable 26 above pulley assembly 18. Power cable 26 can be anchored to first end portion 306 of coupler component 302 while the split ends of power cable 26*a* and 26*b* can be anchored to adjustable yoke component 304 at timing adjustment assembly 300 and then to pulley assembly 18 on each side thereof. In the event bow 10 is not properly synchronized (particularly pulley assemblies 18 and 20 and/or power cables 24 and 26), timing adjustment assembly 300 can be used to change the "effective length" of power cable 26 to lengthen or shorten power cable 26 and synchronize pulley assembly 18. As best illustrated in FIGS. 12A-12C, the position of adjustable yoke component 304 relative to coupler component 302 may be adjusted up or down by the adjustment fastener 316 inserted into the lower second end portion 308 of coupler component 302. As adjustment fastener 316 is inserted further into slot 310 of coupler component 302, the end of adjustment fastener 316 engages the engaging surface 320 of yoke component 304 and forces yoke component 304 upward within slot 310. By moving yoke component 304 upward within slot 310, the effective length of power cable 26 is shortened because of the split ends 26*a* and 26*b* anchored to yoke component 304. Similarly, as adjustment fastener 316 is moved out of slot 310, yoke component 304 is lowered within slot 310 and lengthens the effective length of power cable 26. The engaging surface 320 of yoke component 304 us supported on and by the end of adjustment fastener 316 and results in the position of the adjustment fastener 316 determining the position of the yoke component 304 within slot 310 of coupler component 302. Locking fastener 322, which is inserted through coupler component 302 and yoke component 304 secures yoke component 304 within slot 310.

Figure 12D:
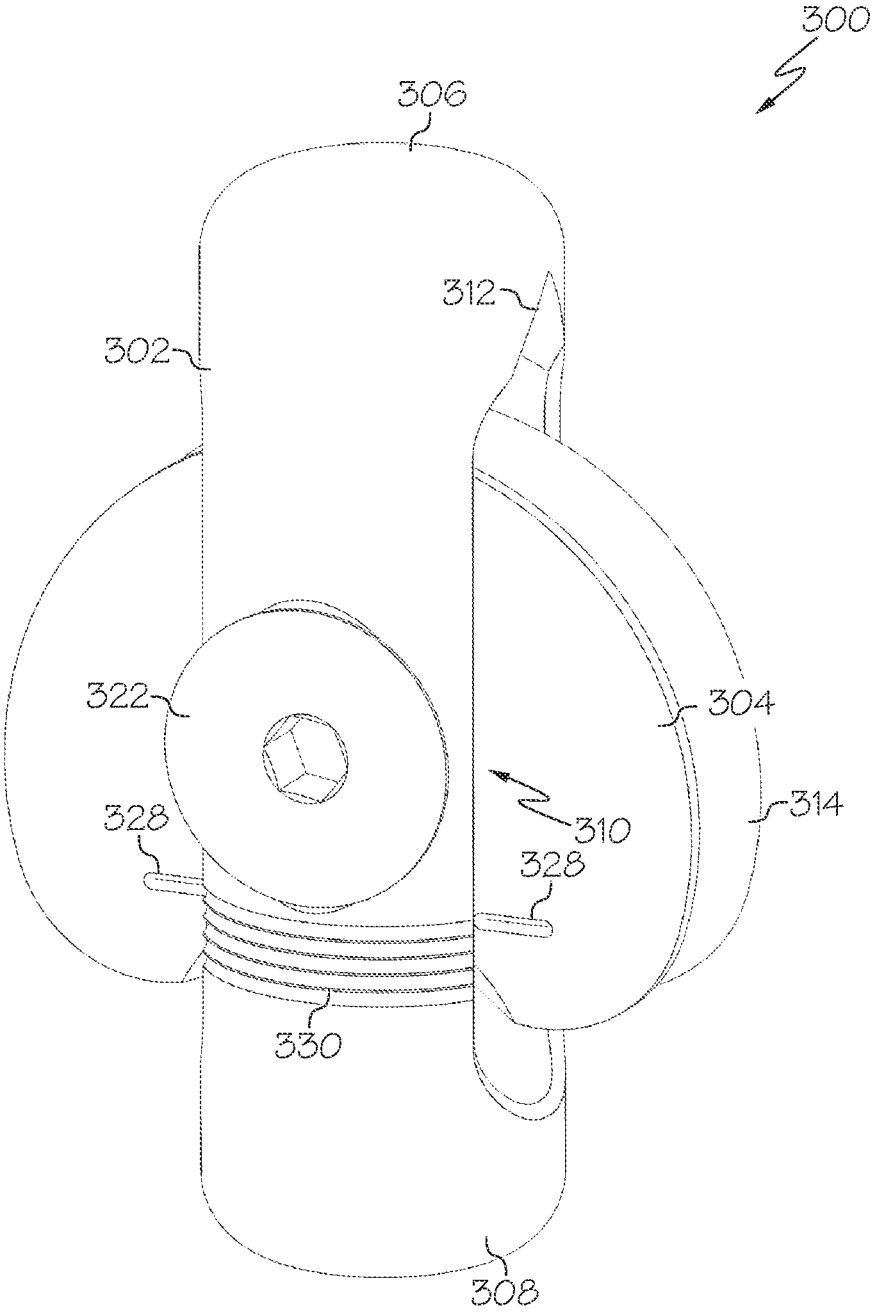
FIG. 12D is a schematic rear perspective view of the timing adjustment assembly of FIG. 12A illustrating the timing adjustment assembly in a first adjusted position.
Figure 12E:
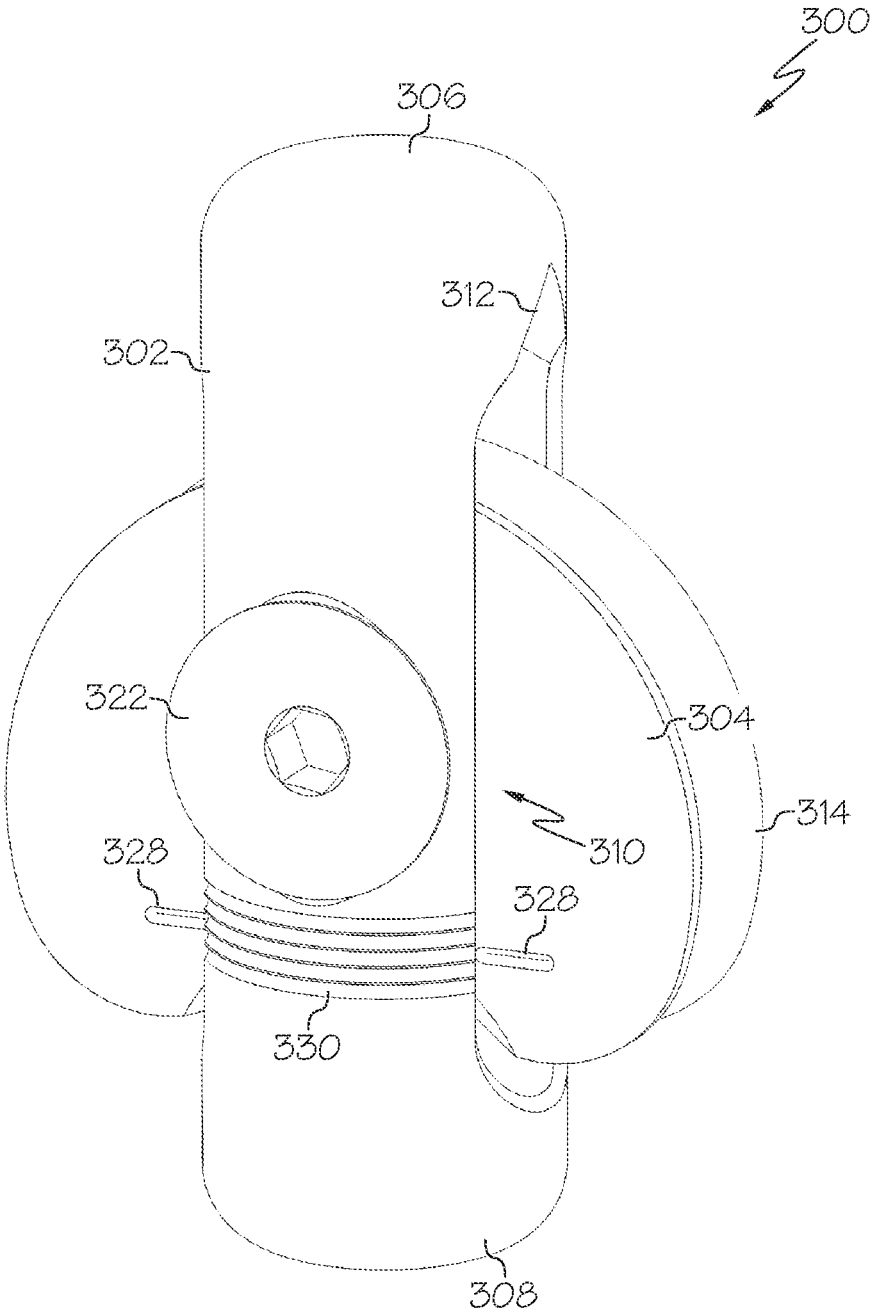
FIG. 12E is a schematic rear perspective view of the timing adjustment assembly of FIG. 12B illustrating the timing adjustment assembly in a second adjusted position.
Figure 12F:
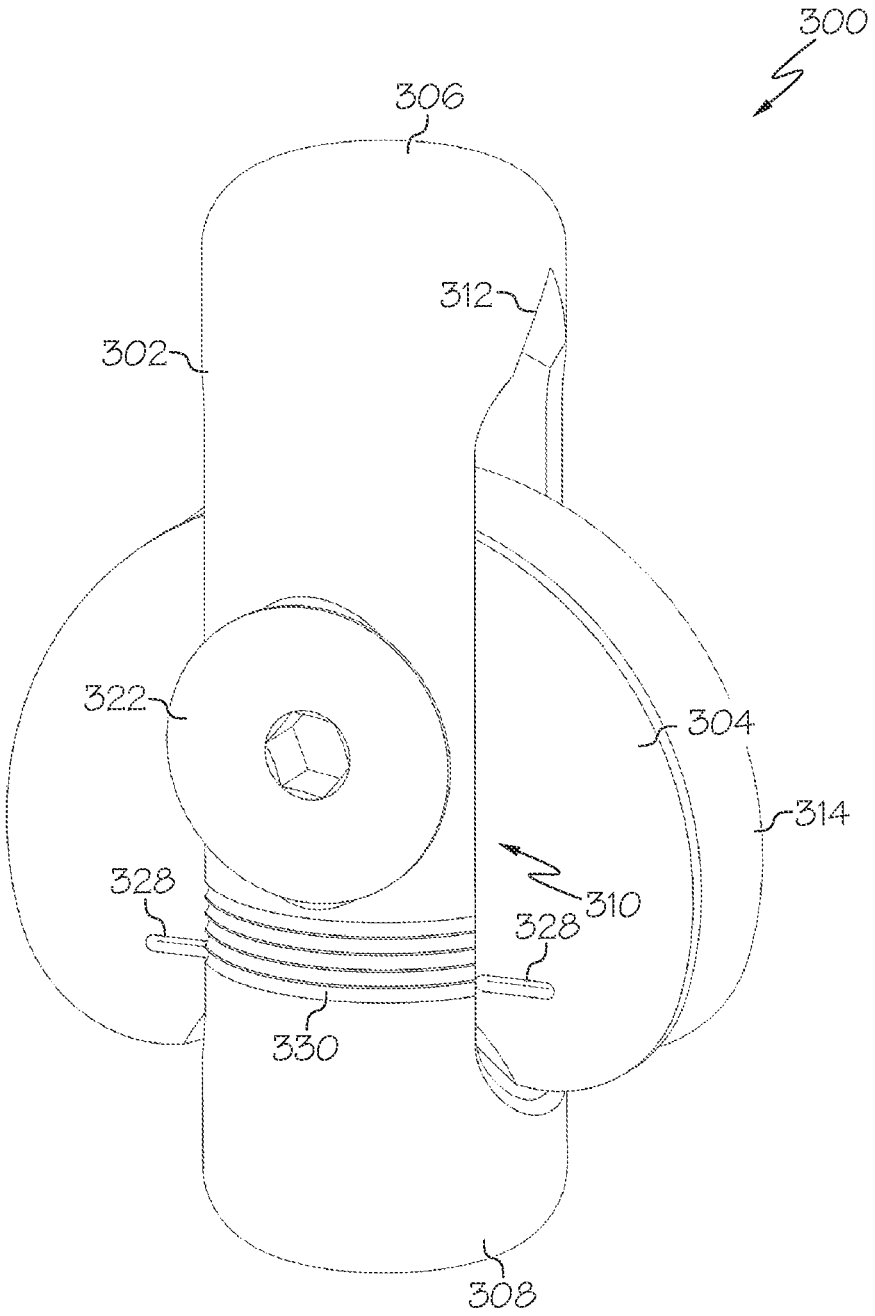
FIG. 12F is a schematic rear perspective view of the timing adjustment assembly of FIG. 12A illustrating the timing adjustment assembly in a third adjusted position.

Similar to previous embodiments, timing adjustment assembly 300 can be structurally arranged to allow for any desired positional arrangement of timing adjustment assembly 300 (and specifically adjustable yoke component 304) to impart any desired differing effective length of power cable 24 or 26 by moving adjustable yoke component 304 relative to coupler component 302. FIGS. 12D-12F illustrate three possible different positions of the adjustable yoke component 304 within slot 310 of coupler component 302 for exemplary purposes, each of which correspond to a particular "effective length" of power cable 26 in accordance with one embodiment of the invention. The different "effective lengths" of power cable 26 can be used to adjust and synchronize bow 10 and pulley assembly 18.

As shown in FIGS. 12D-12F, adjustable yoke component 304 can include a movement guide marker 328 that can be configured as any suitable indicator means to indicate the linear position of yoke component 304 relative to coupler component 302 (i.e., the location of yoke component 304 within slot 310 that corresponds to an effective length of power cable 26). Movement guide marker 328 can be defined into the surface of yoke component 304 and/or applied to the surface thereof to provide a visual indication of the position of the yoke component 304. Similarly, coupler component 302 can include a slide position indicator 330 configured as any suitable indicator means and can be defined into the surface of the sidewall of coupler component 302 and/or applied to the surface thereof. According to certain embodiments, slide position indicator 330 can be configured as a series of markings designating specific lengths or distances under the metric or imperial systems. When adjustable yoke component 304 is positioned within slot 310 of coupler component 302, movement guide marker 328 can be aligned with slide position indicator 330 in order to indicate the precise position of adjustable yoke component 304 relative coupler component 302 and the resulting change in "effective length" of power cable 26 due to the adjustment of timing adjustment assembly 300.

FIG. 12D illustrates timing adjustment 300 where adjustable yoke component 304 is placed into a first position (relative to coupler component 302), which corresponds to a first effective length of power cable 26. Similarly, FIG. 12D illustrate yoke component 304 in second and third positions, respectively, with each corresponding to second and third effective lengths of power cable 26. The third position of yoke component 304 is positioned further downward within slot 310 of coupler component 302 and results in the third effective length of power cable 26 being greater than second effective length. In the event that pulley assembly 18 is not synchronized properly, then a user can change the effective length of power cable 26 though timing adjustment assembly 300. A user may use timing adjustment assembly 300 and adjust the position of adjustable yoke component 304 relative to coupler component 302 by screwing or unscrewing adjustment fastener 316. When the user unscrews fastener 316, yoke component 304 slides linearly in the vertical direction within slot 310 of coupler component 302 and moves from the first position (FIG. 12D) to the second position (FIG. 12E) to the third position (FIG. 12F), or any other position therebetween, as indicated by movement guide marker 328. Using the timing adjustment assembly 300, the user can increase (or decrease) the effective length of power cable 26 to synchronize pulley assemblies 18 and 20 of bow 10. Similarly, a user may adjust the effective length of power cable 24 having a second timing adjustment assembly 300 incorporated into power cable 24 adjacent pulley assembly 20 as illustrated in FIGS. 9A and 9B.

Fourth Embodiment of Timing Adjustment Assembly

Turning to FIGS. 13A-16C, a timing adjustment assembly 400 in accordance with a fourth embodiment of the present invention is illustrated and described herein. Similar to the embodiments of timing adjustment assemblies 100, 200, and 300, timing adjustment assembly 400 can enable an adjustment of the "effective length" of a power cable (and/or compound bow string) and synchronization of the pulley assemblies and power cables of a bow without the need of a bow press or other specialized tools. As described in greater detail herein, timing adjustment assembly 400 can be located on the riser of a bow and can be separate from each pulley assembly. As a result, timing adjustment assembly 400 need not be provided on or otherwise incorporated into one of the pulley assemblies as in the embodiments of timing adjustment assemblies 100 and 200 disclosed previously.

Figure 13A:
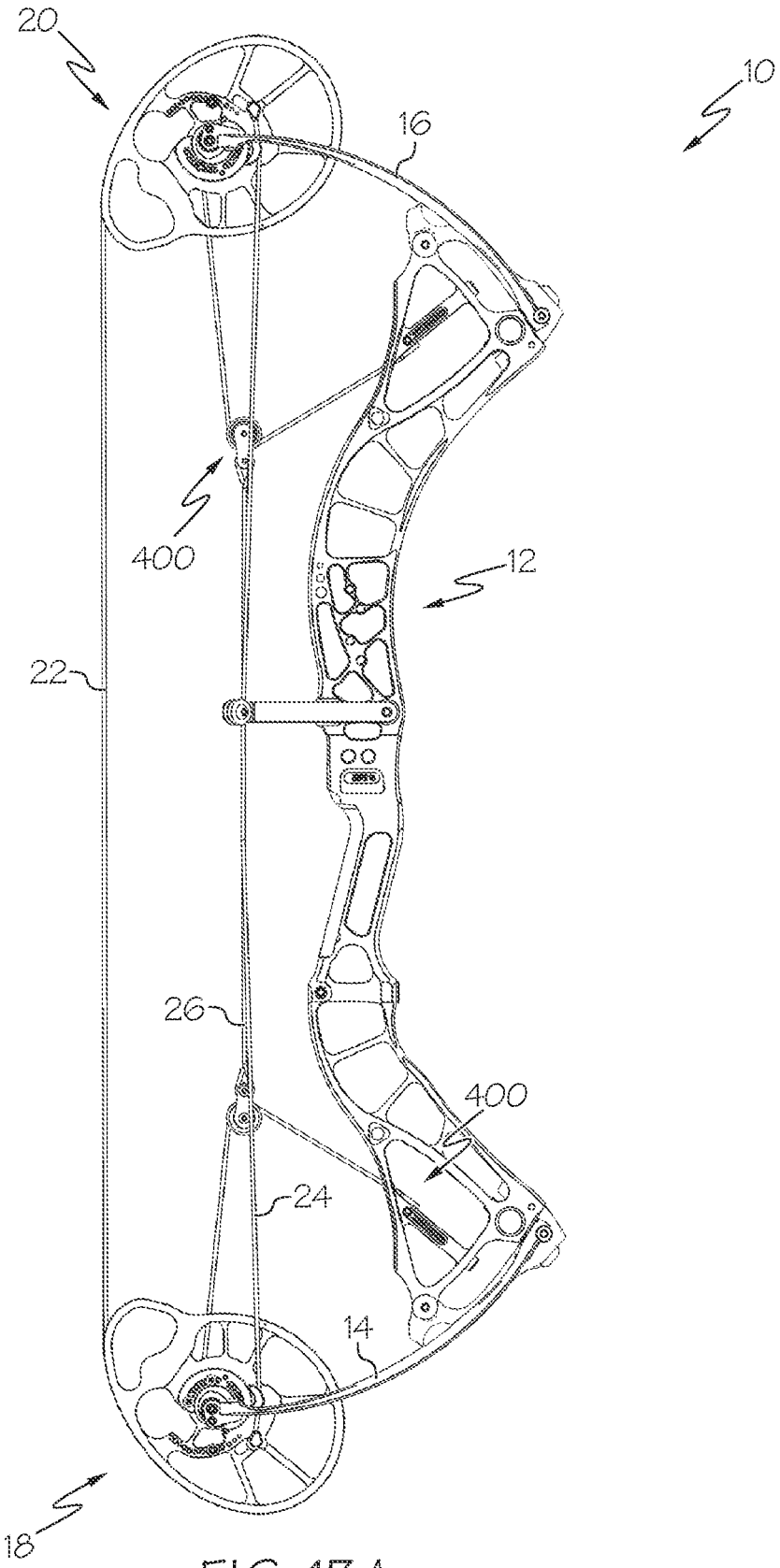
FIG. 13A is a right side elevation view of a compound bow incorporating a timing adjustment assembly in accordance with a fourth embodiment of the present invention, illustrating the compound bow in a brace position.
Figure 13B:
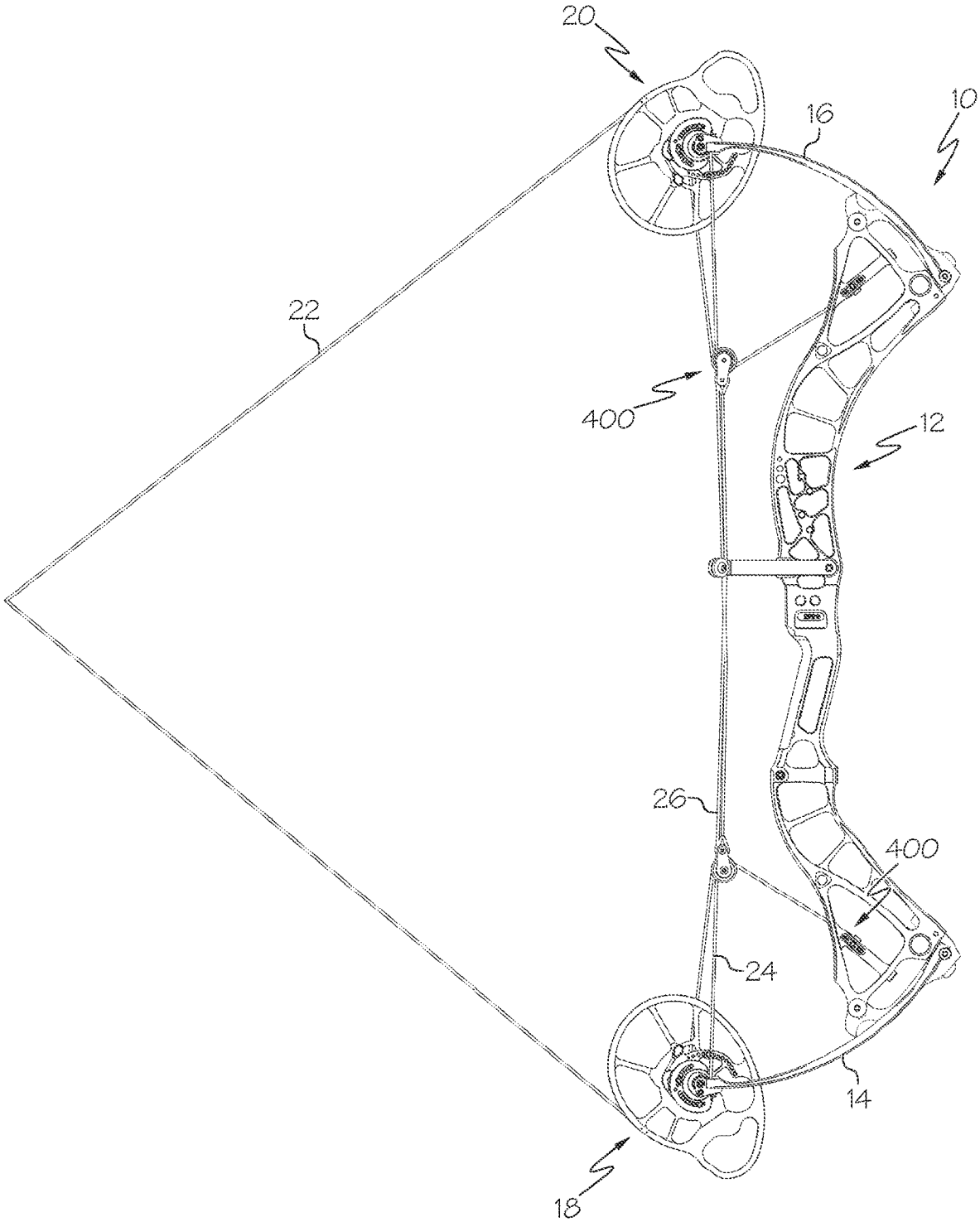
FIG. 13B is a right side elevation view of the compound bow and timing adjustment assembly of FIG. 13A illustrating the compound bow in a drawn position.

FIGS. 13A and 13B illustrate timing adjustment assembly 400 incorporated into a standard compound bow 10, which is configured similarly to bow 10 illustrated and described above with respect to prior embodiments of the timing adjustment assembly, and the same reference numbers refer to the similar components of bow 10 and pulley assemblies 18 and 20. Timing adjustment assembly 400 can also be incorporated into any suitable bow configuration containing at least one power cable.

As shown in FIGS. 13A and 13B, bow 10 can include a riser 12, opposing bow limbs 14 and 16 with pulley assemblies 18 and 20 rotatably attached to the ends thereof via and axle arrangement, a bowstring or drawstring 22, and first and second power cables 24 and 26 extending between the pulley assemblies 18 and 20. The take-up end of first power cable 24 is anchored to pulley assembly 18 and the let-out end is anchored to pulley assembly 20 and a second timing adjustment assembly 400 located at riser 12. Similarly, in a generally mirror image configuration, the take-up end of second power cable 26 is anchored to pulley assembly 20 and extends toward and the let-out end is anchored to pulley assembly 18 and a first timing adjustment assembly 400 located at riser 12. As described in greater detail below, timing adjustment assembly 400 can include an idler pulley component 404 that splits the let-out end of each power cable into split ends with one split end anchored to the pulley assembly and the second end anchored to the mounting component 402 at riser 12.

Figure 14:
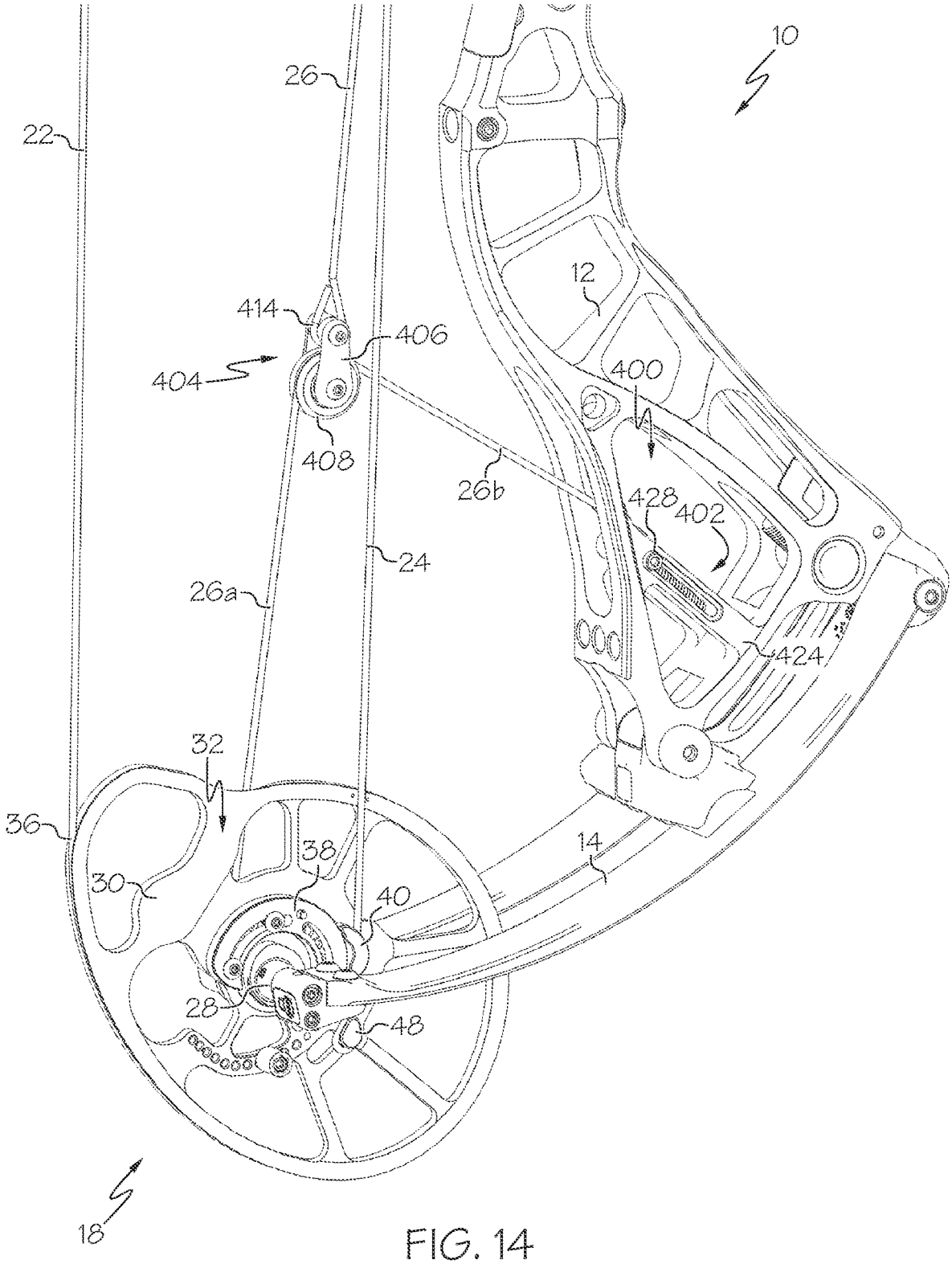
FIG. 14 is a partial right side perspective view of the compound bow of FIG. 13A illustrating the timing adjustment assembly.
Figure 15:
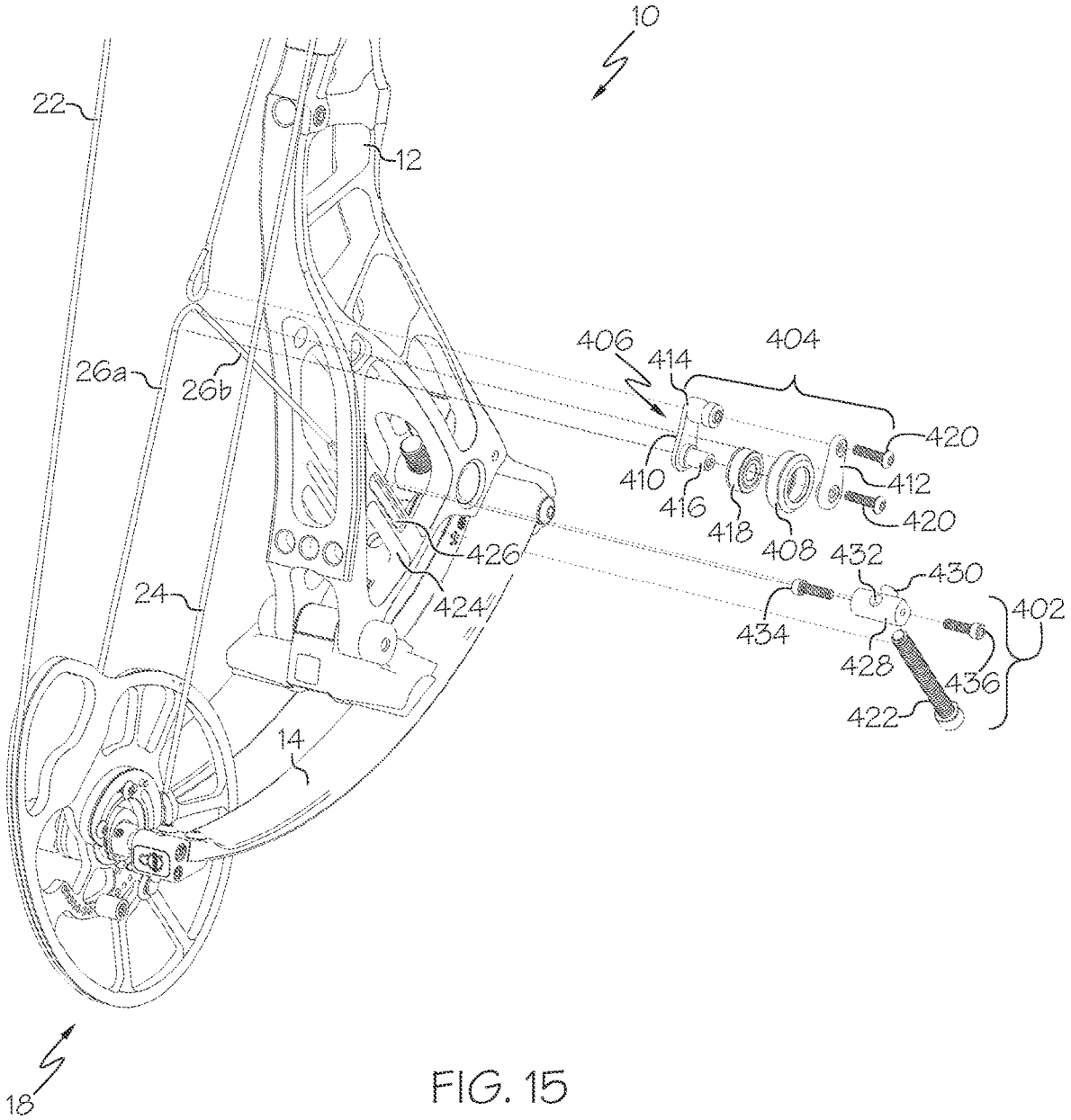
FIG. 15 is an exploded partial right side perspective view of the compound bow of FIG. 13A illustrating the timing adjustment assembly.

FIGS. 14 and 15 illustrate timing adjustment assembly 400 configured for second power cable 26 and its let-out end at pulley assembly 18. A second timing adjustment assembly 400 can similarly be configured and adapted for first power cable 24 at pulley assembly 20 in a mirror image arrangement at the other end of bow 10 as shown in FIGS. 13A and 13B. As best shown in FIG. 14, pulley assembly 18 can include a cam body 30 with take-up means and let-out means for both power cables 24 and 26. For the take-up means associated with first power cable 24, pulley assembly 18 can include a cam module 38 provided adjacent the opening for axle 28, an intermediate routing post 40, and an anchor post 48, each provided on or integral with cam body 30. Timing adjustment assembly 400 can also alternatively be configured and adapted for the take-up end of power cable 24 or 26. In such an arrangement, the take-up end of power cable 24 (as illustrated in FIGS. 14 and 15) would be split into separate ends with one anchored to pulley assembly 18 and the other end to mounting component 402 at riser 12.

As shown in FIGS. 14 and 15, timing adjustment assembly 400 can include a mounting component 402 and a pulley component 404. Mounting component 402 can be located at riser 12. As shown, mounting component 402 can be located at the lower end of riser 12 adjacent to pulley assembly 18. Mounting component 402 can be located at any suitable position along the height of riser 12 and need not necessarily be positioned near or adjacent to pulley assembly 18.

Pulley component 404 can operate to connect timing adjustment assembly 400 to pulley assembly 18 and enable the let-out component of pulley assembly 18 for second power cable 26. As shown in FIG. 14, pulley component 404 receives power cable 26 and provides split ends 26*a* and 26*b* for second power cable 26 that anchor to both the let-out means of pulley assembly 18 and the mounting component 402 on riser 12. Pulley component 404 can be located at a spaced distance from pulley assembly 18 in line with second power cable 26. Pulley component 404 can receive second power cable 26 (that extends from the take-up means at pulley assembly 20 at the opposing end of bow 10) and then split or divide second power cable 26 into first and second ends 26*a* and 26*b*, respectively. Split end 26*a* extends to and is anchored at pulley assembly 18. According to one embodiment as described above, pulley assembly 18 can include a cable track 42 and anchor post 44 configured as a let-out means for receiving and anchoring second cable end 26*a*. The opposing split end 26*b* wraps around pulley component 404 and extends toward riser 12 where it is anchored at mounting component 402.

As best shown in FIGS. 14 and 15, pulley component 404 can include a bracket 406 that houses an idler pulley 408 for split second cable ends 26*a* and 26*b*. According to one embodiment as best shown in FIG. 15, bracket 406 can include a base portion 410 and plate portion 412 spaced from base portion 410 so that idler pulley 408 can be positioned therebetween. As further shown in FIG. 15, pulley component 404 can include one or more fasteners 420 that secure base portion 410 and plate portion 412 together. Other suitable means to secure bracket 406 can also be used and/or bracket 406 can be constructed as a single, unitary component according to certain embodiments.

Bracket 406 can include a termination post 414 provided at one end of base portion 410 for receiving a looped end of second power cable 26. Termination post 414 provides receives and anchors the end of the main part of second power cable 26 extending from the other end of bow 10 and enables the remainder of second power cable 26 to be split into its separate split ends 26*a* and 26*b*. termination post 414 can extend between base portion 410 and plate portion 412 as best illustrated in FIG. 15. Bracket 406 can also include an axle shaft 416 at the opposite end (relative to termination post 414) for receiving a wheel portion 418 of idler pulley 408, and axle shaft 416 and pulley wheel 418 can collectively form a part of idler pulley 408 of pulley component 42.

FIGS. 14 and 15 illustrate pulley component 404 and bracket 406 according to one specific embodiment; however, it is also recognized that pulley component 404 can alternatively have any suitable configuration that includes a termination point for the anchoring of second power cable 26 and an idler pulley for receiving and directing the split ends 26*a* and 26*b* of power cable 26 between pulley assembly 18 and mounting component 402.

As further shown in FIGS. 14 and 15, the first split end 26*a* of extends from idler pulley 408 of pulley component 404 to pulley assembly 18. As described previously, cable end 26*a* can extend around power cable track 42 adjacent axle 28 and anchor to anchor post 44 on cam body 30 to provide the let-out means for second power cable 26. It is also recognized that any other suitable configuration for coupling second power cable end 26*a* to pulley assembly 18 can alternatively be used in other embodiments.

The second split end 26*b* extend from idler pulley 408 of pulley component 404 toward riser 12 where it is coupled to mounting component 402. As best shown in FIGS. 14 and 15, mounting component 402 can include a mounting fastener 422, a riser bracket or housing 424 with an opening or slot 426 formed therein, and an adjustable cable termination component 428. Riser housing 424 can be fixedly secured to or otherwise integrally formed within riser 12. As shown, riser housing 424 can have an elongated shape with a hollow or open interior configured to receiving mounting fastener 422. Riser housing 424 is configured to mount mounting fastener 422 to riser 12. In an alternative embodiment (not shown), riser housing 424 can be configured as an opening defined through a portion of riser 12 so that mounting fastener 422 can be inserted and secured thereto in a fixed position.

As shown in FIGS. 14 and 15, mounting fastener 422 is mounted and secured within riser housing 424 and partially visible through housing opening 426. Mounting fastener 422 can be configured as an elongated threaded bolt that is inserted and secured to riser 12 through riser housing 424. In alternative embodiments (not shown), mounting fastener 422 can alternatively be configured as any suitable threaded or non-threaded bolt, screw, pin, shaft, or other suitable fastening means that is suitable for mounting to riser 12 and having adjustable cable termination component 428 moveably coupled thereto. Mounting fastener 422 and/or riser housing 424 can be configured and operate as a stationary component that adjustable cable termination component 428 moves in a translating motion relative thereto.

As further shown in FIGS. 14 and 15, adjustable cable termination component 428 can be coupled to mounting fastener 422. Adjustable cable termination component 428 can be configured as any type of block, fixture, post, or similar component and can include an opening 432 for receiving the end of mounting fastener 422 and allowing termination component 428 to slide or move along the length of mounting fastener 422, which is fixedly mounted to riser 12. Adjustable cable termination component 428 can further include, or have connected thereto, an anchor post 430 configured for receiving and anchoring second cable split end 26*b* to mounting component 402. Anchor post 430 can be configured as any suitable attachment means to receiving the end of second cable split end 26*b* and securely attaching it to adjustable component 428. According to one embodiment, as shown in FIGS. 14 and 16A-16C, adjustable component 428 can be configured to be at least partially received within riser housing 424 with anchor post 430 extending out through housing opening 426.

Mounting component 402 can further include an adjustment fastener 434 and a locking fastener 436 for operating adjustable component 428 and enabling adjustable component 428 to move up and down along the length of mounting fastener 422. Both adjustment fastener 434 and locking fastener 436 can be configured as any suitable threaded or non-threaded fastener means, such as a bolt, screw, pin, or similar means, as described above with respect to the previous embodiments of the present invention. Adjustment fastener 434 can be inserted and received within an opening defined into one end of adjustable component 428. As fastener 434 is wound or unwound relative to the opening defined into adjustable component 428, adjustable component 428 can slide upward or downward along the length of mounting fastener 422. Locking fastener 436 can be inserted and received within a second opening defined into an opposite end of adjustable component 428. When fully inserted into adjustable component 428, locking fastener 436 can operate to lock adjustable component 428 and secure adjustable component 428 in a fixed position relative to mounting fastener 422 and riser 12.

Figure 16A:
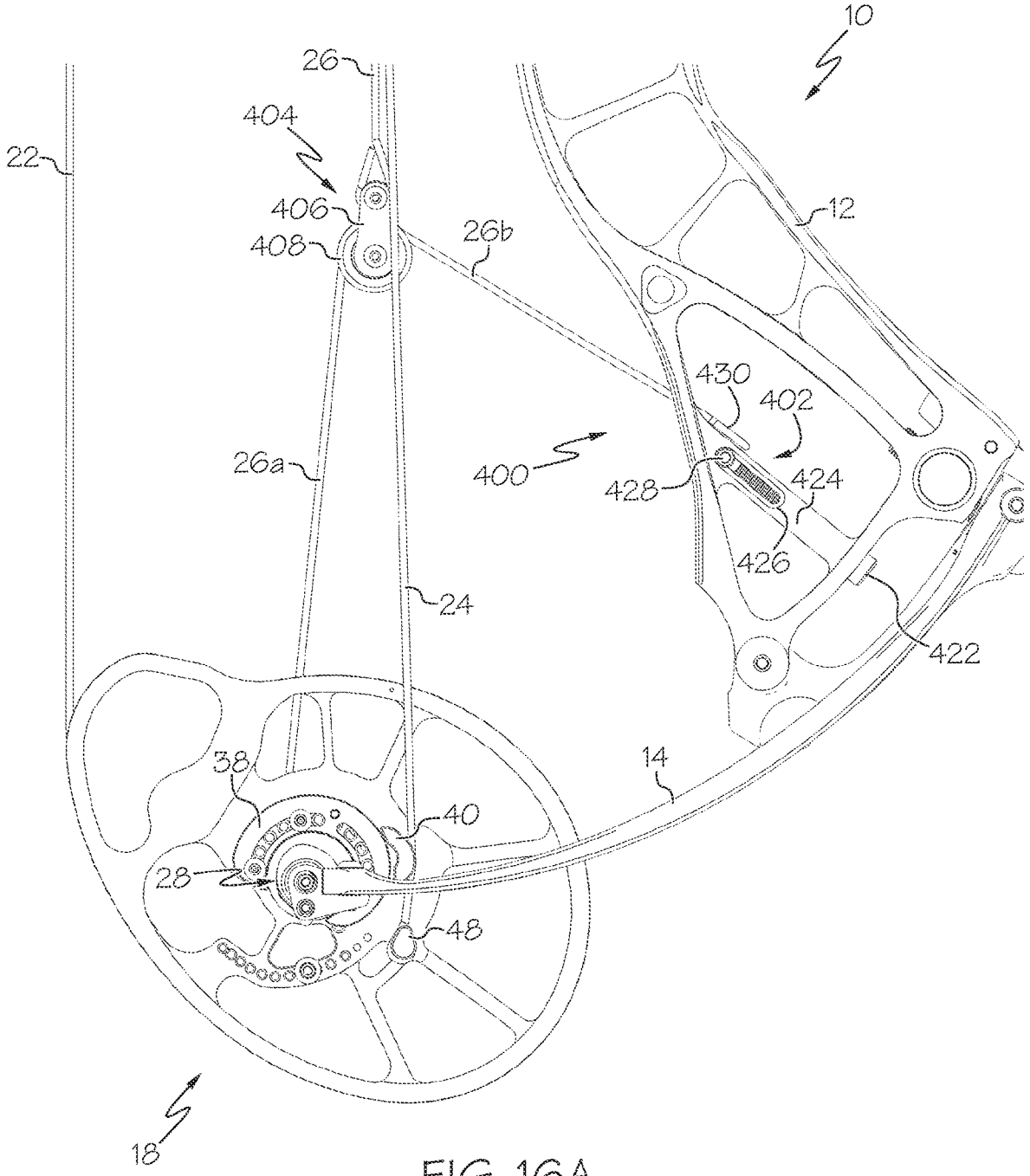
FIG. 16A is a partial right side elevation view of the compound bow of FIG. 13A illustrating the timing adjustment assembly in a first adjusted position.
Figure 16B:
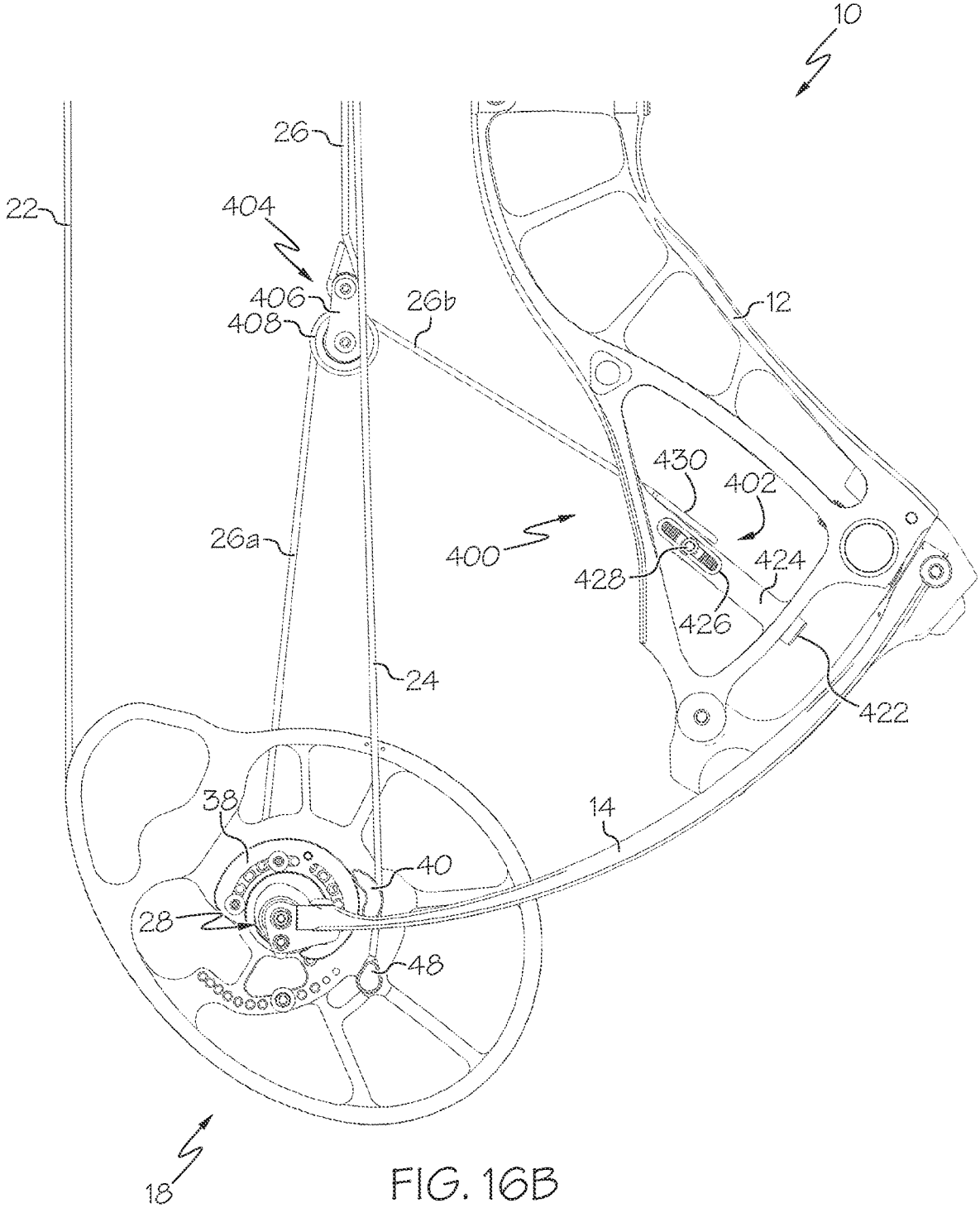
FIG. 16B is a partial right side elevation view of the compound bow of FIG. 13A illustrating the timing adjustment assembly in a second adjusted position.
Figure 16C:
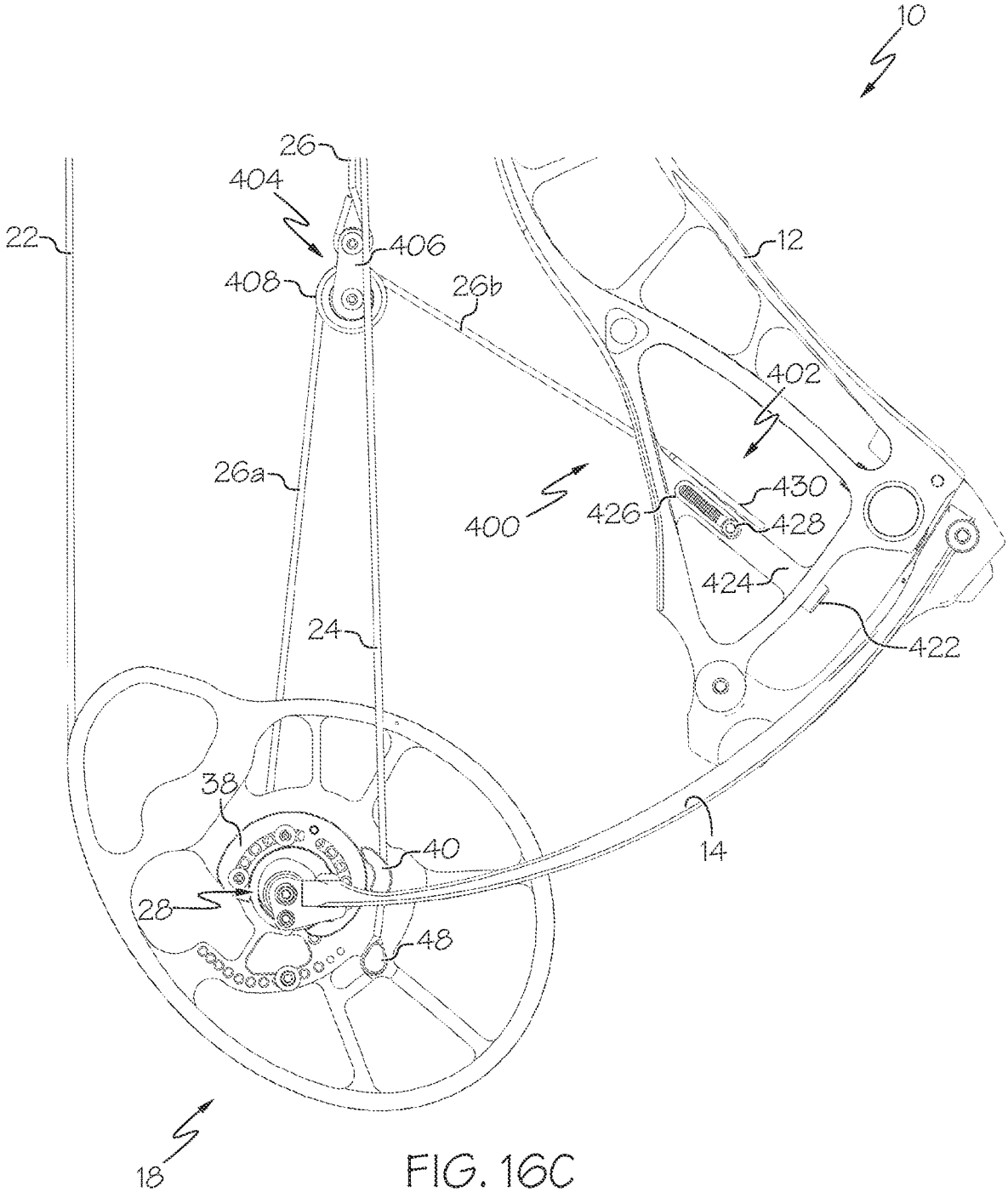
FIG. 16C is a partial right side elevation view of the compound bow of FIG. 13A illustrating the timing adjustment assembly in a third adjusted position.

FIGS. 16A-16C illustrate the operation, functionality, and adjustment of timing adjustment assembly 400 when incorporated into a bow 10 in accordance with one embodiment of the invention. In particular, timing adjustment assembly 400 can be configured to enable adjustment of the effective length of the power cables in order to synchronize the pulley assemblies (and pulley orientation thereof) and while the bow 10 is at brace and during draw and operation of bow 10. As described above and shown in FIGS. 16A-16C, one end of second power cable 26 is coupled to pulley assembly 18 and riser 12 of bow 10 through the timing adjustment assembly 400. A first cable end 26*a* is anchored to pulley assembly 18 and a second cable end 26*a* is anchored to mounting component 402 on riser 12 and both ends are routed through the idler pulley 408 on pulley component 404. The specific bow configuration illustrated for bow 10 in FIGS. 16A-16C represents just one possible embodiment and it is recognized the timing adjustment assembly 400 can also be easily configured and adapted for different particular bow configurations.

In the event bow 10 is not properly synchronized (particularly pulley assemblies 18 and 20 and/or power cables 24 and 26), timing adjustment assembly 400 can be used to change the "effective length" of power cable 26 to lengthen or shorten power cable 26 and synchronize pulley assembly 18. As illustrated in FIGS. 16A-16C, second power cable end 26*b* is anchored to adjustable component 428 of mounting component 402 at riser 12. In order to adjust timing adjustment assembly 400 to change the "effective length" of second power cable 26, adjustable termination component 428 can be moved linearly along the length of mounting fastener 422 by sliding termination component 428 forward or backward on mounting fastener 422. A user can easily operate timing adjustment assembly 400 via adjustable component 428 by loosening locking fastener 436 inserted within termination component 428 and then turning adjustment fastener 434, which slides adjustable component 428 linearly forward or backward along the length of mounting fastener 422. Because second power cable end 26*a* is anchored to anchor post 430 at adjustable component 428, changing the length of power cable end 26*b* (between adjustable component 428 and idler pulley 408) correspondingly changes the length of power cable end 26*a* (between pulley assembly 18 and idler pulley 408). This results in either increasing or decreasing the "effective length" of second power cable 26 by causing slight rotation of pulley assembly 18 and changing the position of the anchored let-out cable end 26*a* on cam body 30 of pulley assembly 18. When the desired adjustment to timing adjustment assembly 400 and second power cable 26 is made to synchronize pulley assemblies 18 and 20 and power cable 26, then the position of adjustable component 428 relative to mounting fastener 422 can be locked in place by tightening locking fastener 436, which secures adjustable component 428 in a fixed position on mounting fastener 422.

Similar to the previous embodiments, timing adjustment assembly 400 can be structurally arranged to allow for any desired positional arrangement of anchor post 430 relative to mounting fastener 422 and riser 12 by moving the adjustable component 428 along the length of mounting fastener 422. Each different position arrangement of anchor post 430 results in a different effective length of power cable 26. FIGS. 16A-16C illustrate timing adjustment assembly 400 where adjustable component 428 has been positioned in three different possible positions relative to mounting fastener 422 to result in three different effective lengths of second power cable 26 for exemplary purposes. FIG. 16A shows timing adjustment assembly 400 and adjustable component 428 in a first position which results in a first "effective length" of second cable 26. As shown, adjustable component 428 is located at its extended-most position on mounting fastener 422, which in turn increases the length of second cable split end 26*a* anchored to pulley assembly 18. FIG. 16B shows adjustable component 428 in a second position where it has been moved linearly to a midway point along the length of mounting fastener 422. This results in a second "effective length" of second cable 26 that decreases the length of second cable split end 26*a* and slightly rotates pulley assembly 18 in a clockwise orientation to synchronize pulley assembly 18. FIG. 16C shows adjustable component 428 in a third position where it has been moved linearly to its retracted-most position on mounting fastener 422 and results in a third "effective length" of second cable 426. In this position, adjustable component 428 has been slid fully along the length of mounting fastener 422 and closer to riser 12, which results in a decreased length of second cable split end 26*a* that further rotates pulley assembly 18 in a clockwise orientation to synchronize pulley assembly 18.

As illustrated through FIGS. 16A-16C, timing adjustment assembly 400 can be utilized to change the relative "effective length" of second cable 26 and cause slight rotation of pulley assembly 18 in order to synchronize pulley assembly 18 within bow 10. The adjustment of timing adjustment assembly 400 can be achieved by changing the position of adjustable component 428 (which has cable end 26*b* anchored thereto) along the length of mounting fastener 422 mounted to riser 10 and then securing the adjustable component 428 in a fixed position. A second timing adjustment assembly 400 located on an opposite end of bow 10 at pulley assembly 20 can be similarly used to rotate and orientate pulley assembly 20 and first power cable 24 to synchronize pulley assembly 20. Collectively, both timing adjustment assemblies 400 can be used to synchronize bow 10 without the use of any specialty equipment or tools.

In alternative embodiments of timing adjustment assembly 400 (not shown), a winch and ratcheting system can be used in place of mounting component 402 that can couple adjustable component 428 and cable end 26*b* to the riser end of timing adjustment assembly 400. In yet another alternative embodiment (not shown), timing adjustment assembly 400 can be configured so that second cable end 26 is looped around pulley component 404 and idler pulley 408 and then anchored back to pulley assembly 18 in place of mounting component 402 mounted on riser 12. In such an embodiment, adjustable component 428 is moveably coupled to cam body 30 of pulley assembly 18.

From the accompanying materials, it will be seen that the invention is one well adapted to attain all the ends and objects set forth herein with other advantages which are obvious and which are inherent to the structure. It will be understood that certain features and subcombinations are of utility and may be employed without reference to other features and subcombinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described in the accompanying materials and illustrated in the drawings are presented by way of example only and are not intended to limit the concepts and principles of the present invention. Thus, there has been shown and described several embodiments of a novel invention. As is evident from the description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required." Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A timing adjustment assembly for a compound archery bow comprising a riser and at least one power cable connected between two pulley assemblies, the timing adjustment assembly comprising:

a stationary component; and an adjustable component moveably connected to the stationary component and configured to selectively move and be continuously adjustable in a generally linear path relative to the stationary component between two or more different positional arrangements;

wherein the adjustable component is coupled to the at least one power cable;

wherein each positional arrangement of the two or more different positional arrangements of the adjustable component imparts a different effective length of the at least one power cable while the compound archery bow is in a brace position; and wherein selectively moving the adjustable component between two different positional arrangements changes the effective length of the at least one power cable when the compound bow is in the brace position.

2. The timing adjustment assembly of claim 1, wherein the stationary component is provided on one of the two pulley assemblies of the compound archery bow in a fixed structural arrangement.

3. The timing adjustment assembly of claim 1, wherein the stationary component is coupled to the at least power cable at an intermediate location along a length of the at least one power cable.

4. The timing adjustment assembly of claim 1, wherein the stationary component is attached to the riser of the compound archery bow.

5. The timing adjustment assembly of claim 1, wherein at least a portion of the at least one power cable is anchored to the adjustable component.

6. The timing adjustment assembly of claim 5, wherein the adjustable component includes an anchor post for anchoring a termination end of the at least one power cable.

7. The timing adjustment assembly of claim 1, further comprising:

a locking fastener connecting the stationary component and the adjustable component, wherein when the locking fastener is in a fully engaged configuration, the adjustable component is secured in a fixed position relative to the stationary component; and an adjustment fastener, wherein movement of the adjustment fastener causes the adjustable component to move in the generally linear path relative to the stationary component between the two or more different positional arrangements.

8. The timing adjustment assembly of claim 1, wherein:

the stationary component comprises a receiving slot defined into a surface of one of the pulley assemblies of the compound archery bow;

the adjustable component comprises a base portion received within the receiving slot, a sliding portion connected to the base portion and extending outwardly therefrom above the receiving slot, and an anchor post extending from the sliding portion, wherein the base portion is selectively moveable within the receiving slot; and the at least one power cable is anchored to the anchor post.

9. The timing adjustment assembly of claim 1, wherein:

the stationary component comprises a housing located on one of the pulley assemblies of the compound archery bow, the housing including an interior receiving cavity;

the adjustable component comprises a base portion received within the interior receiving cavity of the housing and a deflector member extending from an end of the base portion, wherein the base portion is selectively moveable within the interior receiving cavity; and movement of the base portion away from the housing results in the deflector member imparting a deflection amount to the at least one power cable.

10. The timing adjustment assembly of claim 1, wherein:

the stationary component comprises a coupler component having a coupler receiving slot;

the adjustable component comprises an adjustable yoke having a peripheral groove, wherein the adjustable yoke is coupled to the coupler component and selectively moveable within the coupler receiving slot; and a portion of the at least one power cable is received within the peripheral groove of the adjustable yoke.

11. The timing adjustment assembly of claim 1, wherein:

the stationary component comprises a mounting fastener fixedly attached to a riser of the compound bow;

the adjustable component comprises an adjustable block coupled to the mounting fastener and an anchor post extending from the adjustable block, wherein the adjustable block is selectively moveable along a length of the mounting fastener; and at least a portion of the at least one power cable is anchored to the anchor post.

12. An archery bow comprising:

a riser;

first and second bow limbs secured to opposing ends of the riser;

first and second pulley assemblies;

a draw cable;

at least one power cable connected between the first and second pulley assemblies; and a timing adjustment assembly comprising:

a stationary component; and an adjustable component moveably connected to the stationary component and configured to selectively move and be continuously adjustable in a generally linear path relative to the stationary component between two or more different positional arrangements;

wherein the adjustable component is coupled to the at least one power cable;

wherein each positional arrangement of the two or more different positional arrangements of the adjustable component imparts a different effective length of the at least one power cable while the compound archery bow is in a brace position; and wherein selectively moving the adjustable component between two different positional arrangements changes the effective length of the at least one power cable when the compound bow is in the brace position.

13. A pulley assembly for a compound archery bow, the pulley assembly rotatably coupled to an axle located on an end of a bow limb of the compound archery bow, the pulley assembly comprising:

a cam body having a first side and a second side;

a draw string groove extending at least partially around a periphery of the cam body for receiving a draw string of the compound archery bow;

a timing adjustment assembly located on the first side of the cam body, the timing adjustment assembly comprising:

a receiving slot defined into a surface of the cam body; and an adjustable anchor component having a base portion, a sliding portion, and an anchor post;

wherein the base portion is configured to be at least partially received within the receiving slot and the sliding portion is configured to extend beyond the surface of the cam body when the base portion is positioned within the receiving slot;

wherein the timing adjustment assembly connects a first power cable to the pulley assembly;

wherein the adjustable anchor component is structurally arranged to translate in a generally linear path along the surface of the cam body between two or more positional arrangements; and wherein each positional arrangement results in a different effective length of the first power cable.

14. The pulley assembly of claim 13, wherein the timing adjustment assembly further comprises a locking fastener configured to selectively secure the adjustable anchor component to the receiving slot, the locking fastener insertable through a wall of the receiving slot and into the base portion of the adjustable anchor component to secure the adjustable anchor component in a fixed location relative to the receiving slot.

15. The pulley assembly of claim 14, wherein the timing adjustment assembly further comprises an adjustment fastener configured to selectively change the position of the adjustable anchor component between the two or more positional arrangements, wherein the adjustment fastener is insertable into an opening defined through the adjustable anchor component, wherein rotating the adjustment fastener within the opening causes movement of the adjustable anchor component when the locking fastener is removed from the base portion of the adjustable anchor component.

16. The pulley assembly of claim 13, wherein the pulley assembly further comprises a first set of positional indicators provided on the first side of the cam body adjacent to the receiving slot and a second set of positional indicators provided on the sliding portion of the adjustable anchor component, where the positional indicators provide visual indication of the selected positional arrangement of the adjustable anchor component relative to the cam body.

17. The pulley assembly of claim 13, wherein the receiving slot comprises a lip defined at an upper edge of the receiving slot, wherein the lip is configured to retain the base portion of the adjustable anchor component within the receiving slot.

18. A timing adjustment assembly for use on a pulley assembly of a compound bow having at least one power cable coupled to the pulley assembly, the timing adjustment assembly comprising:

a receiving slot defined into a surface of the pulley assembly; and an adjustable anchor component comprising a base portion and an anchor post, wherein the base portion is at least partially receivable within the receiving slot and configured to move in a generally linear path within the receiving slot, and wherein the anchor post extends away from base portion and beyond the surface of the pulley assembly and is configured for connection to a loop end of the at least one power cable;

wherein the adjustable anchor component is structurally arranged so as to enable substantially rigid attachment of the adjustable anchor component within the receiving slot in any one of a set of multiple anchor arrangements;

wherein each one of the set of multiple anchor arrangements corresponds to a different anchor position of the at least one power cable relative to the surface of pulley assembly when the compound bow is in a brace position;

wherein selective movement of the adjustable anchor component from one anchor arrangement to another anchor arrangement imparts a change in the timing of the pulley assembly and at least one power cable.

19. The timing adjustment assembly of claim 18, wherein each one of the multiple anchor arrangements corresponds to a different effective length of the at least one power cable when the compound bow is in the brace position.

20. The timing adjustment assembly of claim 18, further comprising:

a locking fastener for selectively securing the adjustable anchor component within the receiving slot in substantially rigid engagement in one of the set of multiple anchor arrangements, wherein the locking fastener is receivable within a first opening defined through a wall of the receiving slot and second opening defined into the base portion of the adjustable anchor component; and an adjustment fastener for selectively moving the adjustable anchor component within the receiving slot between the set of multiple anchor arrangements, wherein the adjustment fastener is receivable within a third opening defined into the adjustable anchor component transversely to the second opening.

21. The timing adjustment assembly of claim 18, further comprising a first set of visual anchor position indicators defined on the surface of the pulley assembly adjacent to the receiving slot and a second set of visual anchor position indicators defined on the adjustable anchor component, wherein the first and the second set of visual anchor position indicators provide visual indication of a position of the adjustable anchor component.

22. An archery bow comprising:

a riser;

first and second bow limbs secured to opposing ends of the riser;

first and second pulley assemblies;

a draw cable;

at least one power cable connected between the first and second pulley assemblies; and a timing adjustment assembly comprising:

a stationary component;

an adjustable component moveably connected to the stationary component and configured to selectively move in a generally linear path relative to the stationary component between two or more different positional arrangements; and an adjustment fastener, wherein movement of the adjustment fastener causes the adjustable component to move in the generally linear path relative to the stationary component between the two or more different positional arrangements;

wherein the adjustable component is coupled to the at least one power cable;

wherein each positional arrangement of the two or more different positional arrangements of the adjustable component imparts a different effective length of the at least one power cable while the compound archery bow is in a brace position; and wherein selectively moving the adjustable component between two different positional arrangements changes the effective length of the at least one power cable when the compound bow is in the brace position.

* * * * *